US009545540B1

(12) United States Patent
Moschel

(10) Patent No.: US 9,545,540 B1
(45) **Date of Patent: *Jan. 17, 2017**

(54) EXERCISE EQUIPMENT AND METHODS OF USING THE SAME

(71) Applicant: DTIP.LLC, Astoria, NY (US)

(72) Inventor: Michael Moschel, Astoria, NY (US)

(73) Assignee: DTIP.LLC, Astoria, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,134

(22) Filed: Dec. 7, 2015

Related U.S. Application Data

(63) Continuation-in-part of application No. 13/967,945, filed on Aug. 15, 2013, and a continuation of
(Continued)

(51) Int. Cl.
*A63B 23/08* (2006.01)
*A63B 23/035* (2006.01)
(Continued)

(52) U.S. Cl.
CPC ..... *A63B 23/03533* (2013.01); *A63B 21/078* (2013.01); *A63B 21/0724* (2013.01);
(Continued)

(58) Field of Classification Search
CPC ..... A63B 21/00047; A63B 22/0605; A63B 23/03516; A63B 23/03558; A63B 23/03575; A63B 21/078; A63B 21/0783; A63B 21/4029; A63B 21/4031; A63B 22/0635; A63B 23/0476; A63B 23/035–23/03591; A63B 23/12; A63B 2022/0652
(Continued)

(56) References Cited

U.S. PATENT DOCUMENTS 3,833,216 A 9/1974 Philbin
3,964,742 A * 6/1976 Carnielli ..... A61H 1/0214 482/62
(Continued)

FOREIGN PATENT DOCUMENTS

| | | |
|---|---|---|
| CA | 2630430 | 11/2009 |
| KR | 1020120070239 | 6/2012 |
| WO | 9700031 | 1/1997 |

OTHER PUBLICATIONS

Declaration of Michael Moschel under 37 C.F.R. 1.132, filed in U.S. Appl. No. 13/967,945 on Oct. 5, 2015.
(Continued)

*Primary Examiner* — Loan H Thanh
*Assistant Examiner* — Gregory Winter
(74) *Attorney, Agent, or Firm* — Amster, Rothstein & Ebenstein LLP

(57) ABSTRACT

A physical exercise apparatus and method of using the same targets the balanced development of a user's deltoid, pectoralis or upper pectoralis muscles by providing for a user to perform a target, upper body, weight lifting exercise with a resistance load, such as with a barbell, while the user simultaneously performs a distraction exercise of cycling with the legs. The distraction exercise inhibits the muscles of the lower body from assisting the upper body with the target exercise. The apparatus includes a seat or bench for a user to perform the weight lifting and cycling in one of a seated position, a supine position, and a partially supine position. The apparatus also includes a single or multi-level support for holding the resistance load adjacent the seat or bench, and movable foot pedals that are adjustable to a selected location in a two-dimensional plane at which the user performs cycling.

30 Claims, 91 Drawing Sheets

Related U.S. Application Data application No. 29/542,492, filed on Oct. 14, 2015, and a continuation of application No. 29/542,493, filed on Oct. 14, 2015, and a continuation of application No. 29/542,498, filed on Oct. 14, 2015, and a continuation of application No. 29/542,500, filed on Oct. 14, 2015, and a continuation-in-part of application No. 14/104,664, filed on Dec. 12, 2013, which is a continuation-in-part of application No. 13/967,945, filed on Aug. 15, 2013, said application No. 14/961,134 is a continuation-in-part of application No. 14/154,957, filed on Jan. 14, 2014, which is a continuation-in-part of application No. 14/104,664, filed on Dec. 12, 2013, which is a continuation-in-part of application No. 13/967,945, filed on Aug. 15, 2013, application No. 14/961,134, which is a continuation-in-part of application No. 14/154,957, filed on Jan. 14, 2014, which is a continuation-in-part of application No. 14/104,664, filed on Dec. 12, 2013, application No. 14/961,134, which is a continuation-in-part of application No. 14/296,107, filed on Jun. 4, 2014, which is a continuation-in-part of application No. 14/154,957, filed on Jan. 14, 2014, which is a continuation-in-part of application No. 14/104,664, filed on Dec. 12, 2013, which is a continuation-in-part of application No. 13/967,945, filed on Aug. 15, 2013, application No. 14/961,134, which is a continuation-in-part of application No. 14/296,104, filed on Jun. 4, 2014, which is a continuation-in-part of application No. 14/154,957, filed on Jan. 14, 2014, which is a continuation-in-part of application No. 14/104,664, filed on Dec. 12, 2013, application No. 14/961,134, which is a continuation-in-part of application No. 14/296,234, filed on Jun. 4, 2014, which is a continuation of application No. 14/296,107, filed on Jun. 4, 2014, which is a continuation-in-part of application No. 14/154,957, filed on Jan. 14, 2014, which is a continuation-in-part of application No. 14/104,664, filed on Dec. 12, 2013, which is a continuation-in-part of application No. 13/967,945, filed on Aug. 15, 2013, application No. 14/961,134, which is a continuation-in-part of application No. 14/296,234, filed on Jun. 4, 2014, which is a continuation of application No. 14/296,107, filed on Jun. 4, 2014, which is a continuation-in-part of application No. 14/154,957, filed on Jan. 14, 2014, which is a continuation-in-part of application No. 14/104,664, filed on Dec. 12, 2013.

(60) Provisional application No. 61/831,903, filed on Jun. 6, 2013, provisional application No. 61/872,207, filed on Aug. 30, 2013.

(51) Int. Cl.
*A63B 21/072* (2006.01)
*A63B 21/078* (2006.01)
*A63B 22/06* (2006.01)

(52) U.S. Cl.
CPC ..... *A63B 21/4029* (2015.10); *A63B 21/4035* (2015.10); *A63B 22/0605* (2013.01); *A63B 2022/0652* (2013.01)

(58) Field of Classification Search
USPC ..... 482/51, 56–62, 79, 80, 93, 94, 97, 104, 482/133, 138, 142
See application file for complete search history.

(56) References Cited

U.S. PATENT DOCUMENTS

| | | | | |
|---|---|---|---|---|
| 4,333,644 | A | 6/1982 | Lambert, Jr. et al. | |
| 4,625,962 | A | 12/1986 | Street | |
| 4,830,362 | A | 5/1989 | Bull | |
| 4,838,547 | A | 6/1989 | Sterling | |
| 4,842,269 | A | 6/1989 | Huang | |
| 4,974,840 | A | 12/1990 | Welch | |
| 5,145,479 | A | 9/1992 | Olschansky et al. | |
| 5,178,593 | A | 1/1993 | Roberts | |
| 5,318,487 | A | 6/1994 | Golen et al. | |
| 5,405,305 | A | 4/1995 | Wilkinson et al. | |
| 5,496,236 | A | 3/1996 | Buonauito | |
| 5,569,128 | A * | 10/1996 | Dalebout | A63B 22/0005 482/57 |
| 5,580,341 | A | 12/1996 | Simonson | |
| 5,823,921 | A | 10/1998 | Dawson | |
| 5,941,803 | A | 8/1999 | Chamberlain et al. | |
| 5,976,062 | A | 11/1999 | Toups | |
| 6,071,216 | A | 6/2000 | Giannelli et al. | |
| 6,090,021 | A | 7/2000 | Flowers et al. | |
| 6,254,516 | B1 | 7/2001 | Giannelli et al. | |
| 6,413,192 | B2 | 7/2002 | Abelbeck | |
| 6,547,702 | B1 | 4/2003 | Heidecke | |
| 6,551,219 | B1 | 4/2003 | Brown | |
| 6,565,495 | B2 * | 5/2003 | Slattery | A63B 21/06 482/142 |
| 6,902,515 | B2 | 6/2005 | Howell et al. | |
| 7,285,077 | B1 | 10/2007 | Marx | |
| 7,322,907 | B2 | 1/2008 | Bowser | |
| 7,513,853 | B1 | 4/2009 | Russ | |
| 7,524,272 | B2 | 4/2009 | Bruck et al. | |
| 7,695,411 | B2 | 4/2010 | Pandozy | |
| 7,717,833 | B1 | 5/2010 | Nelson et al. | |
| 7,740,563 | B2 | 6/2010 | Dalebout et al. | |
| 7,775,936 | B2 | 8/2010 | Wilkinson | |
| 7,874,971 | B2 | 1/2011 | Reyes | |
| 7,985,167 | B2 | 7/2011 | Nizam | |
| 8,206,272 | B2 | 6/2012 | Greene | |
| 8,388,504 | B2 | 3/2013 | Ellis | |
| 8,696,526 | B1 | 4/2014 | Dew | |
| 8,821,354 | B1 | 9/2014 | Tabahi | |
| 2002/0035017 | A1 | 3/2002 | Pertegaz-Esteban | |
| 2004/0192522 | A1 | 9/2004 | Hippensteel | |
| 2005/0096196 | A1 | 5/2005 | Webber et al. | |
| 2005/0101463 | A1 | 5/2005 | Chen | |
| 2005/0277524 | A1 | 12/2005 | Bae | |
| 2006/0019804 | A1 | 1/2006 | Young | |
| 2006/0116253 | A1 | 6/2006 | Nizam | |
| 2006/0189451 | A1 * | 8/2006 | Nelson | A63B 22/0012 482/57 |
| 2006/0264304 | A1 | 11/2006 | Habing | |
| 2007/0173384 | A1 | 7/2007 | Sechrest et al. | |
| 2008/0051274 | A1 | 2/2008 | Greene | |
| 2008/0318738 | A1 | 12/2008 | Chen | |
| 2010/0035729 | A1 | 2/2010 | Pandozy | |
| 2010/0210425 | A1 | 8/2010 | Bowser | |
| 2011/0172064 | A1 | 7/2011 | Cutler et al. | |
| 2011/0245043 | A1 | 10/2011 | Mitchell | |
| 2014/0031173 | A1 * | 1/2014 | Huang | A63B 22/04 482/57 |
| 2014/0031174 | A1 * | 1/2014 | Huang | A63B 22/0007 482/62 |
| 2014/0364281 | A1 | 12/2014 | Moschel | |
| 2014/0364282 | A1 | 12/2014 | Moschel | |
| 2014/0364283 | A1 | 12/2014 | Moschel | |
| 2014/0364284 | A1 | 12/2014 | Moschel | |
| 2014/0364285 | A1 | 12/2014 | Moschel | |

OTHER PUBLICATIONS

Declaration of Michael Moschel under 37 C.F.R. 1.132, filed in U.S. Appl. No. 14/104,664 on Dec. 30, 2015.
Declaration of Michael Moschel under 37 C.F.R. 1.132, filed in U.S. Appl. No. 14/154,957 on Feb. 8, 2016.
U.S. Appl. No. 61/831,903, filed Jun. 6, 2013.

(56) References Cited

OTHER PUBLICATIONS

U.S. Appl. No. 61/872,207, filed Aug. 30, 2013.
Photograph of prior art exercise machine accessed on Dec. 5, 2013 from URL. https://encrypted-tbn2.gstatic.com/images?q=tbn:ANd9GcSllvDYh7Y4av62BDNf61YHLvSaxArhi2MxY3KgGMallS1UeuqXbA.
Photograph of prior art exercise machine. Accessed from World Wide Web on Sep. 20, 2013.
The Bench-Press Angle That Will Maximize Your Chest Workout, by Christina Simonetto, Men's Fitness, Accessed Jul. 29, 2015, http://www.mensfitness.com/print/42913.

* cited by examiner

EXERCISE EQUIPMENT AND METHODS OF USING THE SAME

CROSS-REFERENCE TO RELATED APPLICATIONS

This application is a continuation-in-part of and claims the benefit of and priority to U.S. patent application Ser. No. 13/967,945 filed Aug. 15, 2013 and published as U.S. Patent Appl. Publ. No. 2014/0364281 on Dec. 11, 2014, which claims the benefit of and priority to U.S. Provisional Patent Application Ser. No. 61/831,903, filed Jun. 6, 2013.

This application is also a continuation-in-part of and claims the benefit of and priority to U.S. patent application Ser. No. 14/104,664, filed Dec. 12, 2013 and published as U.S. Patent Appl. Publ. No. 2014/0364282 on Dec. 11, 2014, which is a continuation-in-part and claims the benefit of and priority to U.S. patent application Ser. No. 13/967,945, filed Aug. 15, 2013, which claims the benefit of and priority to U.S. Provisional Patent Application Ser. No. 61/831,903, filed on Jun. 6, 2013. U.S. patent application Ser. No. 14/104,664 also claims the benefit of and priority to U.S. Provisional Patent Application Ser. No. 61/872,207, filed Aug. 30, 2013.

This application is also a continuation-in-part and claims the benefit of and priority to U.S. patent application Ser. No. 14/154,957, filed Jan. 14, 2014 and published as U.S. Patent Appl. Publ. No. 2014/0364284 on Dec. 11, 2014, which is a continuation-in-part and claims the benefit of and priority to U.S. patent application Ser. No. 14/104,664, filed Dec. 12, 2013, which is a continuation-in-part and claims the benefit of and priority to U.S. patent application Ser. No. 13/967,945, filed Aug. 15, 2013, and claims the benefit of and priority to U.S. Provisional Patent Application Ser. No. 61/831,903, filed Jun. 6, 2013, and U.S. Provisional Patent Application Ser. No. 61/872,207, filed Aug. 30, 2013.

This application is also a continuation-in-part and claims the benefit of and priority to U.S. patent application Ser. No. 14/296,107, filed Jun. 4, 2014 and published as U.S. Patent Appl. Publ. No. 2014/0364283 on Dec. 11, 2014, which is a continuation-in-part of U.S. patent application Ser. No. 14/154,957, filed Jan. 14, 2014, which is a continuation-in-part of and claims the benefit of and priority to U.S. patent application Ser. No. 14/104,664, filed Dec. 12, 2013, which is a continuation-in-part and claims the benefit of and priority to U.S. patent application Ser. No. 13/967,945, filed Aug. 15, 2013, and claims the benefit of and priority to U.S. Provisional Patent Application Ser. No. 61/831,903, filed Jun. 6, 2013, and U.S. Provisional Patent Application Ser. No. 61/872,207, filed Aug. 30, 2013.

This application is also a continuation-in-part and claims the benefit of and priority to U.S. patent application Ser. No. 14/296,234, filed Jun. 4, 2014, published as U.S. Patent Appl. Publ. No. 2014/0364285 on Dec. 11, 2014, which is a continuation and claims the benefit of and priority to U.S. patent application Ser. No. 14/296,107, filed Jun. 4, 2014, which is a continuation-in-part of U.S. patent application Ser. No. 14/154,957, filed Jan. 14, 2014, which is a continuation-in-part of and claims the benefit of and priority to U.S. patent application Ser. No. 14/104,664, filed Dec. 12, 2013, which is a continuation-in-part and claims the benefit of and priority to U.S. patent application Ser. No. 13/967,945, filed Aug. 15, 2013, and claims the benefit of and priority to U.S. Provisional Patent Application Ser. No. 61/872,207, filed Aug. 30, 2013, and U.S. Provisional Patent Application Ser. No. 61/831,903, filed on Jun. 6, 2013.

This application is also a continuation of and claims the benefit of and priority to U.S. Design patent application Nos. 29/542,492, 29/542,493, 29/542,498, and 29/542,500, all filed on Oct. 14, 2015.

The entire contents of application Ser. Nos. 13/967,945, 14/104,664, 14/154,957, 14/296,107, 14/296,234, 61/831,903 and 61/872,207, and Design patent application Nos. 29/542,492, 29/542,493, 29/542,498, and 29/542,500 are incorporated by reference herein.

FIELD

The present invention generally relates to physical exercise equipment and methods of using the same.

BACKGROUND

Typically, when an individual exercises, the goal is to target (or develop) one or more specific muscle groups as part of the regimen. Thus, typically physical exercise equipment is designed to perform one target exercise at a time. In some cases, physical exercise equipment has been designed to perform more than one target exercise at a time, wherein each target exercise is directed to working out or developing a specific set of one or more muscles. In either case, all of the exercises are performed as target exercises, meaning that the exercises are performed in a manner that targets the development of muscles in the portions of the body.

One apparatus that allows for two target exercises to be simultaneously performed is described in Greene (U.S. Patent Application Publication No. 2008/0051274). In the apparatus of FIGS. 3 and 10 of Greene, the exercise apparatus has seat handles/knobs that can be turned or rotated but not lifted or raised and the apparatus also has pedals for cycling. As described, the user of the Greene apparatus of this embodiment, who is seated, performs two specific target exercises simultaneously, one being a handle turning exercise that is performed to exercise the user's abdominal muscles as a first target exercise and the other being a cycling exercise that is performed to exercise the user's legs as a second target exercise. Greene does not teach performing an upper body exercise simultaneously with a lower body exercise where the user is lying flat on his or her back (i.e., in a supine position).

Unfortunately, these prior art efforts to perform more than one exercise regimen simultaneously have proven to be unsatisfactory. While a user may perform two target exercises simultaneously, there is no effort at obtaining muscular balance between the left side and right side of the user body. Such prior art techniques also fail to provide a sufficient engagement of deeper muscles, ligaments and/or tendons of a target portion of a user's body.

What is needed in a new and improved exercise equipment and method of using the same which overcome these shortcomings.

SUMMARY

The present invention overcomes these shortcomings in the prior art by providing a physical exercise apparatus and/or method of using the same that includes a simultaneous target exercise portion, which includes an upper body weight lifting exercise, and a distraction exercise (or "distracting exercise") portion, which includes a cycling motion that is substantially biomechanically isolated from target exercise portion.

In embodiments, a physical exercise apparatus includes a frame with a first portion configured to support a resistance load for use in an upper body, weight lifting exercise that is a target exercise for developing at least one of the deltoid or pectoralis muscles in a user's upper body. The resistance load may be a barbell, which may be included with the apparatus, and the support for the resistance load may be a support that is configured to support the barbell when the barbell is not in use. The apparatus further includes a seat or bench, and a pair of movable foot pedals. The seat or bench is supported by the frame and is configured to provide the user with access to the resistance load and to support the user for performing the target exercise.

The pair of movable foot pedals of the apparatus is configured so that the user is capable of performing the upper body, weight lifting exercise to develop at least one of the deltoid or pectoralis muscles in the user's upper body and simultaneously cycling with the pair of movable foot pedals as a distraction exercise. The distraction exercise is to engage muscles of the lower body of the user with a distraction to inhibit the muscles of the lower body from assisting the user's deltoid and/or pectoralis muscles of the upper body in the target exercise. The movable foot pedals are connected to a second portion of the frame but not to the resistance load.

The movable foot pedals are movable to a selected location in a two-dimensional plane at which the movable foot pedals are releasably secured to be configured for cycling by the user as the distraction exercise. The movable foot pedals, which are movable in two dimensions, are configured to make the user comfortable and relaxed so that the distraction exercise performed with the movable foot pedals remains a distraction and does not become a target exercise in itself. In embodiments, the selected location for the movable foot pedals is to be based, at least in part, upon a leg length of the user.

In embodiments, the movable foot pedals of the apparatus may be configured to be adjustable rotationally and linearly. The apparatus may include, for this purpose, at least two adjustment members to adjust the movable foot pedals to the selected location. The first of the at least two adjustment members may include an arcuate member coupled to the movable foot pedals at a pivot point and having a first plurality of apertures arranged in an arc shape, such that the movable foot pedals are configured to be rotatable about the pivot point and releasably securable to one of the first plurality of apertures. The second adjustment member, which may include a linearly adjustable apertured bar having arranged linearly thereon a second plurality of apertures, is likewise coupled to the movable foot pedals and may also be coupled to the first adjustment member. The movable foot pedals are thereby configured to be linearly adjustable toward or away from the pivot point, in addition to being rotatable, and are releasably securable to one of the second plurality of apertures located along the bar.

In embodiments, the physical exercise apparatus includes a rotating arm coupled to the movable foot pedals (which may be in addition to the arcuate member and work in cooperation therewith) for the rotational adjustment of the movable foot pedals and a linearly adjustable bar coupled to the movable foot pedals to provide for the linear adjustment of the movable foot pedals to the selected location in the two-dimensional plane. In embodiments, the linearly adjustable bar slides into and out of the rotating arm and may be provided in addition to the linearly adjustable apertured bar to work in cooperation therewith for the linear adjustment of the movable foot pedals.

Thus, in an exemplary embodiment, a first adjustment mechanism includes the arcuate member with the first plurality of apertures and the rotating arm that work in conjunction with one another to rotate and releasably secure the movable foot pedals in a rotational direction. A second adjustment mechanism, in this exemplary embodiment, includes the linearly adjustable apertured bar having arranged linearly thereon a second plurality of apertures to releasably secure the movable foot pedals in a linear direction, and a linearly adjustable bar, connected to the apertured bar, that slides into and out of the rotating arm to adjust the linear position of the movable foot pedals. These two adjustment mechanisms enable the two-dimensional movement of the movable foot pedals. Each adjustment mechanism may further include an element, such as a knob or pin, that is insertable through one of the respective plurality of apertures to secure the respective adjustment mechanism so that the movable foot pedals are secured to a selected location.

In alternative embodiments, rather than having a combination of rotational and linear adjustment mechanisms, there may be multiple linear adjustment mechanisms to adjust the movable foot pedals to the selected location where they are releasably secured for cycling.

In embodiments, the physical exercise apparatus of the present invention includes a seat that is configured to position the user in a seated position. When so configured, the apparatus enables a user to perform the target upper body, weight lifting exercise to at least develop the deltoid muscles of the upper body. The seat may include a back support and a seat support, where the seat support is substantially parallel to a horizontal axis defined by the base in a backward-facing longitudinal direction of the apparatus. The back support may be disposed at an angle of approximately 90 degrees with respect to the seat support. In embodiments, the back support and the seat support are pivotably coupled to one another. The back support may be configured to be adjusted backward.

In embodiments in which the frame is configured to place a user in the seated position, a method for using the physical exercise apparatus includes the steps of adjusting the movable foot pedals to the selected location in the two-dimensional plane, positioning at least a portion of a body of a user in the seated position on the seat and positioning the user's feet on the movable foot pedals, accessing of the resistance load by the user in the seated position and performing the target exercise with the upper body of the user that includes lifting weight with the deltoid muscles using the resistance load when the user is in the seated position on the seat. The method further includes simultaneously performing the cycling motion of the distraction exercise with the movable foot pedals by the user in the seated position, while performing the target exercise, to distract the user to inhibit the muscles of the lower body from assisting the user's deltoid muscles in the target exercise. In embodiments, the distraction exercise is initiated by the user before the user initiates the target exercise. Further, in embodiments where the resistance load comprising a barbell, the target exercise may be initiated by the user by accessing the barbell from the first portion of the frame for the upper body, weight lifting after the user initiates the cycling motion with the movable foot pedals.

In alternative embodiments of the physical exercise apparatus of the present invention, the seat includes an inclined back support and a seat support that is supported by the frame. In these embodiments, the apparatus is configured to place the use in a partially supine position, rather than in the seated position, to provide the user with access to the resistance load and to support the user for performing the target exercise. When so configured, the apparatus enables a user to perform the target upper body, weight lifting exercise to develop at least the pectoralis muscles, and more particularly, the upper pectoralis muscles, in the upper body of the user. In embodiments, the apparatus has a base that is configured to rest on a flat surface and the back support is backwardly inclined at one of an angle of 29 degrees and an angle of 44 degrees relative to a horizontal axis defined by the base in a backward-facing longitudinal direction of the apparatus. Also, in embodiments, the seat support is configured to be adjustable along approximately the angle of inclination of the back support to be releasably secured in one of a plurality of seat height positions based at least in part on an arm length of the user to provide the user with the access to the resistance load.

In embodiments in which the frame is configured to place a user in the partially supine position, a method for using the physical exercise apparatus includes the steps of adjusting the movable foot pedals to the selected location in the two-dimensional plane, positioning at least a portion of a body of the user in the partially supine position on the seat and positioning the user's feet on the movable foot pedals, accessing of the resistance load by the user in the partially supine position and performing the target exercise with the upper body of the user that includes lifting weight using the resistance load when the user is in the partially supine position on the seat. The method further includes simultaneously performing the cycling motion of the distraction exercise with the movable foot pedals by the user in the partially supine position, while performing the target exercise, to distract the user to inhibit the muscles of the lower body from assisting the user's pectoralis muscles in the target exercise. In embodiments, the distraction exercise is initiated by the user before the user initiates the target exercise. Further, in embodiments where the resistance load comprising a barbell, the target exercise may be initiated by the user by accessing the barbell from the first portion of the frame for the upper body, weight lifting after the user initiates the cycling motion with the movable foot pedals.

In alternative embodiments of the physical exercise apparatus of the present invention, the apparatus includes a bench supported by the frame and configured to provide a user with access to the resistance load and to support the user for performing the target exercise comprising the upper body, weight lifting exercise while the user is lying on the bench in a supine position. The target exercise is configured to develop at least the user's pectoralis muscles in the upper body of the user. In these embodiments, the pair of movable foot pedals are configured so that the user is capable of performing the upper body, weight lifting exercise to develop the user's pectoralis muscles, while in the supine position on the bench, and the user is capable of simultaneously cycling with the pair of movable foot pedals as a distraction exercise to engage muscles of the lower body of the user with a distraction to inhibit the muscles of the lower body from assisting the user's pectoralis muscles of the upper body in the target exercise. In embodiments, the bench is a flat bench. In another exemplary embodiment, the bench is adjustable and has a seat support and a back support that are pivotably coupled to one another. When the bench is adjustable, the bench may be configured to be adjustable to place the user in one of the seated, the partially supine, or the supine positions.

In embodiments in which the frame is configured to place a user in the supine position, a method for using the physical exercise apparatus includes the steps of adjusting the movable foot pedals to the selected location in the two-dimensional plane, positioning at least a portion of a body of the user in the supine position on the bench and positioning the user's feet on the movable foot pedals, accessing of the resistance load by the user in the supine position and performing the target exercise with the upper body of the user that includes lifting weight using the resistance load when the user is in the supine position on the bench. The method further includes simultaneously performing the cycling motion of the distraction exercise with the movable foot pedals by the user in the supine position, while performing the target exercise, to distract the user to inhibit the muscles of the lower body from assisting the user's pectoralis muscles in the target exercise. In embodiments, the distraction exercise is initiated by the user before the user initiates the target exercise. Further, in embodiments where the resistance load comprising a barbell, the target exercise may be initiated by the user by accessing the barbell from the first portion of the frame for the upper body, weight lifting after the user initiates the cycling motion with the movable foot pedals.

In any of the above-described embodiments, the first portion of the frame may have a plurality of storage positions at different vertical levels for storing the barbell at one of the vertical level when it is not used. The barbell may then be pre-positioned, whether by a user or someone else, at a selected one of the different vertical levels for the user to readily access the barbell to perform the target exercise while simultaneously cycling with the movable foot pedals.

Other features and advantages of the present invention will become readily apparent from the following detailed description, the accompanying drawings and the appended claims.

BRIEF DESCRIPTION OF THE DRAWINGS

Various exemplary embodiments of this invention will be described in detail, with reference to the following figures, wherein.

DETAILED DESCRIPTION OF EMBODIMENTS

Figure 12:
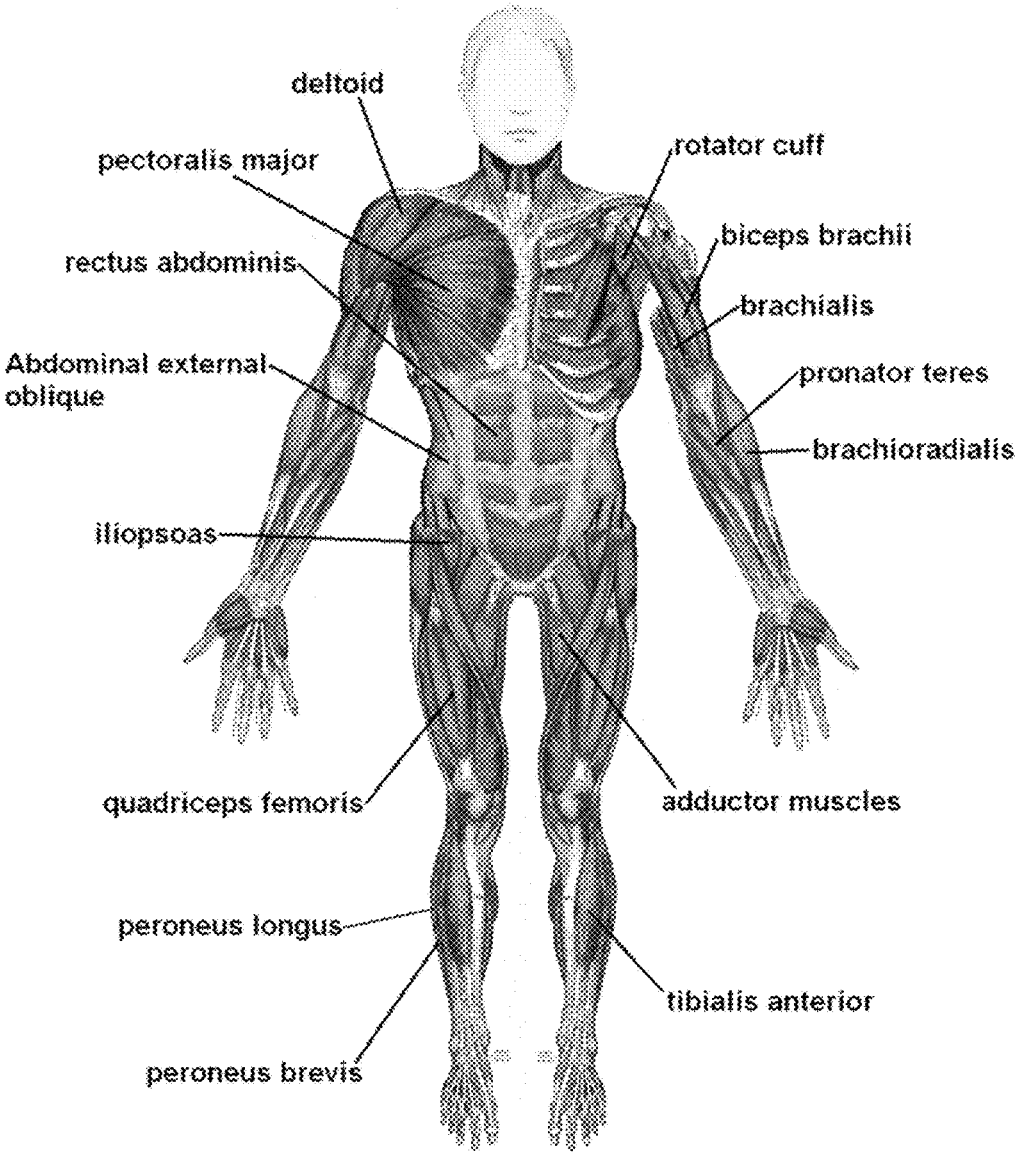
FIG. 12 is an anatomical view of the anterior muscles of a human body, including the deltoid and pectoralis muscles.

The present invention provides a physical exercise apparatus and/or method of using the same that includes a target exercise portion and a distraction exercise (or "distracting exercise") portion on which the target and distraction exercises are to be performed simultaneously. The "target" exercise is an exercise that is being targeted to one part of the body, e.g. a portion of the upper or lower body, for improved muscular development. In the present invention, the target exercise is an exercise that targets the balanced muscular development of the deltoid and/or pectoralis muscles in the user's upper body. In embodiments, the deltoid and/or pectoralis muscles are targeted by a user performing weight lifting (pressing) with a resistance load, such as a barbell. As used herein, the term "pectoralis muscles" refers generally to the pectoralis major muscles and the term "upper pectoralis muscles" refers, more particularly, to an upper portion of the pectoralis muscles. The deltoid and pectoralis muscles are illustrated in FIG. 12.

The "distraction" or "distracting" exercise, by contrast, refers to an exercise that is performed simultaneously with the target exercise and generates neuromuscular signals, works, loads or otherwise engages at least one portion of a user's body to inhibit the user's upper body from being leveraged or otherwise assisted by the distracted portion of the user's body, when the user simultaneously performs the target exercise. The distraction exercise in the present invention is a cycling exercise that is performed with movable foot pedals. In embodiments, a cycling motion of a user's legs includes flexion and/or extension of the user's leg at the knee.

To limit the cycling exercise to be a distraction, the physical exercise apparatus should place the user's lower body in a stable, comfortable and relaxing position so that the lower body activity of cycling (pedaling) requires relatively minimal effort by the lower body to avoid becoming a second target exercise that targets muscular development in the lower body and providing a cardiovascular workout. For this purpose, the foot pedals used for cycling are configured to be adjustable in two dimensions to a pedal location in a two-dimensional plane that comfortably accommodates the length of the user's legs and is adjustable to a resistance that is set, by a user, to a minimum resistance for that user so that cycling can be effective as a distraction for the intended users that range from a huge athlete to a frail older person. Also, in embodiments, portions of a seat or bench on which the user sits or lies while performing the target and distraction exercises are adjustable to make the user's body even more comfortable and relaxed. In embodiments, a distraction exercise provides little or no cardiovascular training. To remain a distraction exercise, the cycling should, without the weight lifting, contribute no more than 9% percent to the total cardiovascular burden placed on the user by the target and distraction exercises.

Without being bound by theory, the inventor has discovered that performing the distraction exercise with the lower body while simultaneously performing the target exercise with the upper body is advantageous for several reasons. First, it helps position the user's body to encourage correct postural alignment of the user's upper body during use of the apparatus, which facilitates a substantially even resistive loading of weight across an axial midline of the upper body of the user. This tends to position at least the target portion of the user's body in a manner that discourages the user from favoring and/or leveraging the targeted muscles on one side of the user's upper body over the same targeted muscles on the other side of the user's upper body. Thus, the simultaneous performance of the target and distraction exercises promotes the balanced muscular development of the user's upper body on both the right and left sides of the user. Consequently, uneven muscular development in the upper body that leads to bad posture and pain and discomfort can be avoided or remedied.

Moreover, without being bound by theory, the inventor has discovered that performing the distraction exercise facilitates increased resistance loading of the target portion of the user's body and facilitates the development of deep, e.g., sub-superficial, muscles, ligaments and/or tendons of a target portion of a user's body.

The inventor has further discovered that the simultaneous target and distraction exercises are particularly helpful to individuals who require soft tissue therapy and corrective exercise services targeted to their pectoralis and/or deltoid muscles. Such therapy may be required, for example, due to illness or injury or due to activities that result in an unbalanced or less than desired development of these upper body muscles. The benefits of performing a target exercise in conjunction with a simultaneous distraction exercise that have been identified are surprising given conventional wisdom that a user only perform simultaneous exercises that are targeted exercises, one to the upper body and the other to the lower body, because two target exercises performed simultaneously achieve a more efficient workout and better cardiovascular training than does the performance of a single target exercise.

Exemplary embodiments of the physical exercise apparatus of the present invention and methods for using same are next described. In embodiments, the exercise apparatuses of the present invention may have the user positioned in one of a "seated position," a "partially supine position," or a "supine position." The term "seated position" is used herein to mean a seated position where the user's back is positioned at approximately 90 degrees (i.e., within a range of 85 to 95 degrees) to a substantially horizontal seat support. The term "supine position" is used herein to mean a position in which the user lies on the back in a horizontal position with the user facing upward. The term "partially supine" is used herein to mean a position in which the user's back is inclined backward at an angle located between a seated position and a supine position.

FIG. 12, which is available from wikimedia.com, illustrates the location of anterior muscles in the human musculoskeletal system. As shown, the pectoralis and deltoid muscles, which are the muscles targeted in embodiments of the present invention, are located toward the top of the upper body. By contrast, the abdominal (external oblique) muscles, which are not targeted for exercise in embodiments of the present invention, are lower down.

In embodiments, the deltoid muscles are targeted for exercise when the user is exercising in a seated position. In embodiments, the upper pectoralis muscles are targeted in a partially supine position. In embodiments, the pectoralis muscles are targeted when the user is performing the weight lifting while lying in a supine position on the user's back substantially flat on the bench with the user's feet cycling on movable foot pedals. In embodiments, the targeting of upper pectoralis muscles in the partially supine position for exercise substantially isolates the deltoid muscles from being exercised during the upper body weight lifting exercise.

Embodiments of a physical exercise apparatus in accordance with the present invention and methods of using same are described in connection with FIGS. 1 to 12.

FIGS. 3A to 3I illustrates an exemplary embodiment of a physical exercise apparatus 300 for use as a seated shoulder press in accordance with the present invention. For convenience, this embodiment may be referred to as the "shoulder press" embodiment.

Figure 3A:
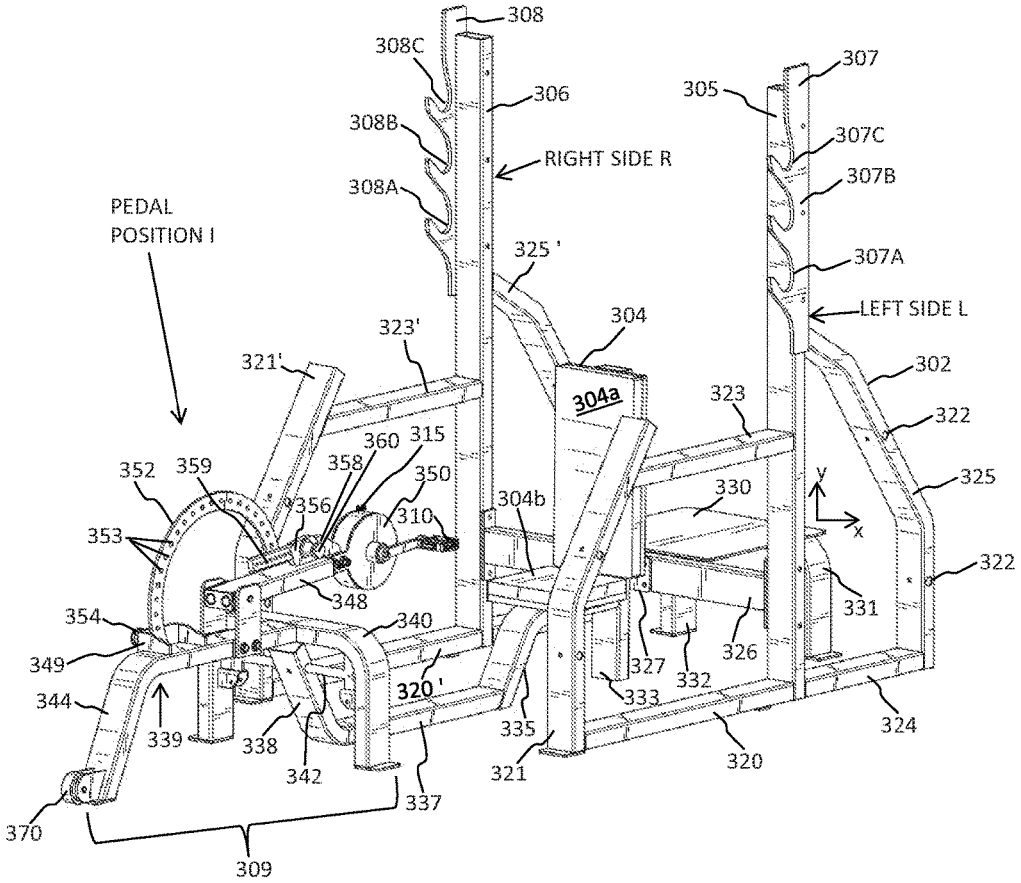
FIG. 3A is a perspective view of a physical exercise apparatus according to another exemplary embodiment of the present invention in which the apparatus is a shoulder press and in which the movable foot pedals are adjusted to the first position for a user with relatively short legs.
Figure 3B:
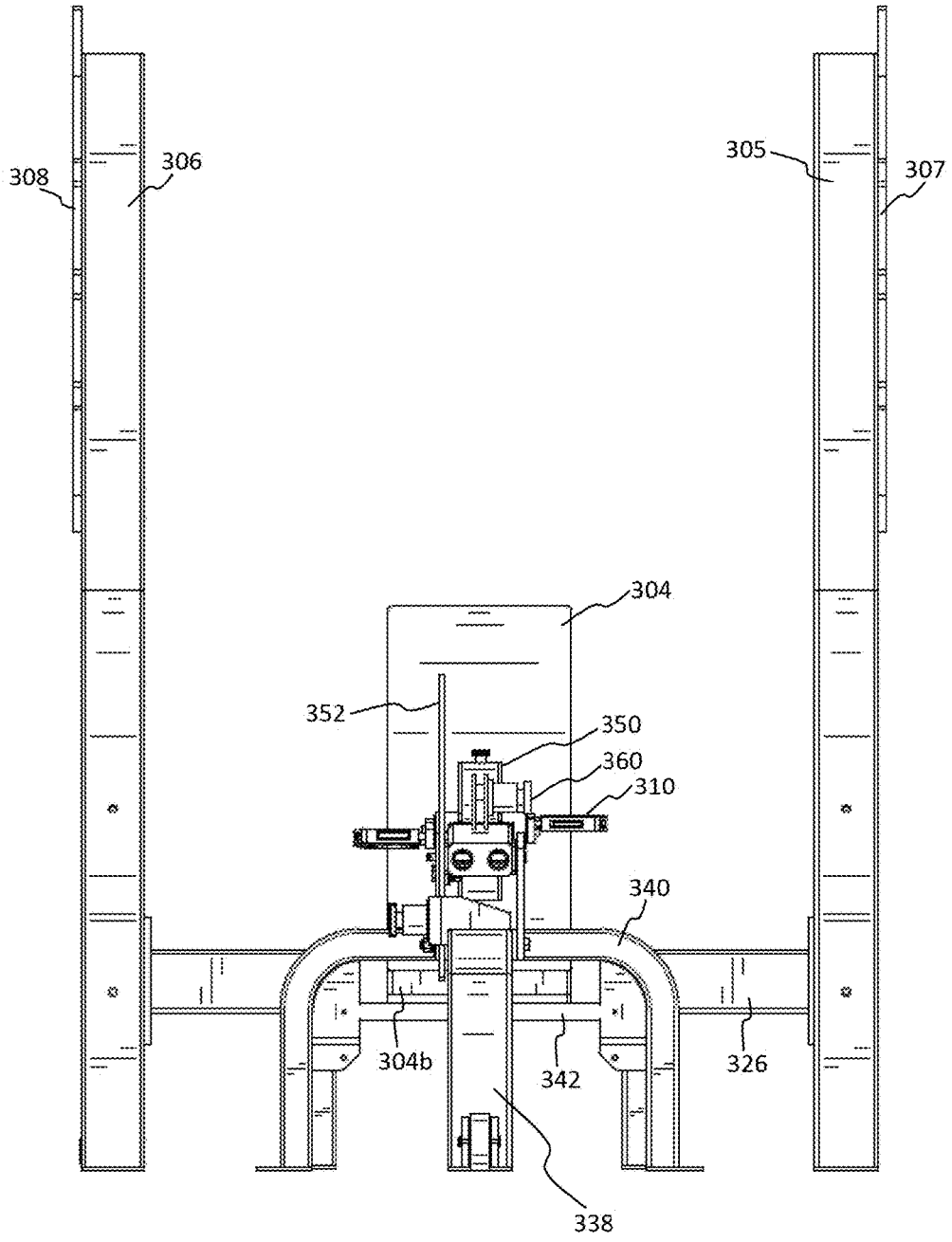
FIGS. 3B to 3G are front, rear, right side, left side, top and bottom views, respectively, of the physical exercise apparatus shown in FIG. 3A.
Figure 3C:
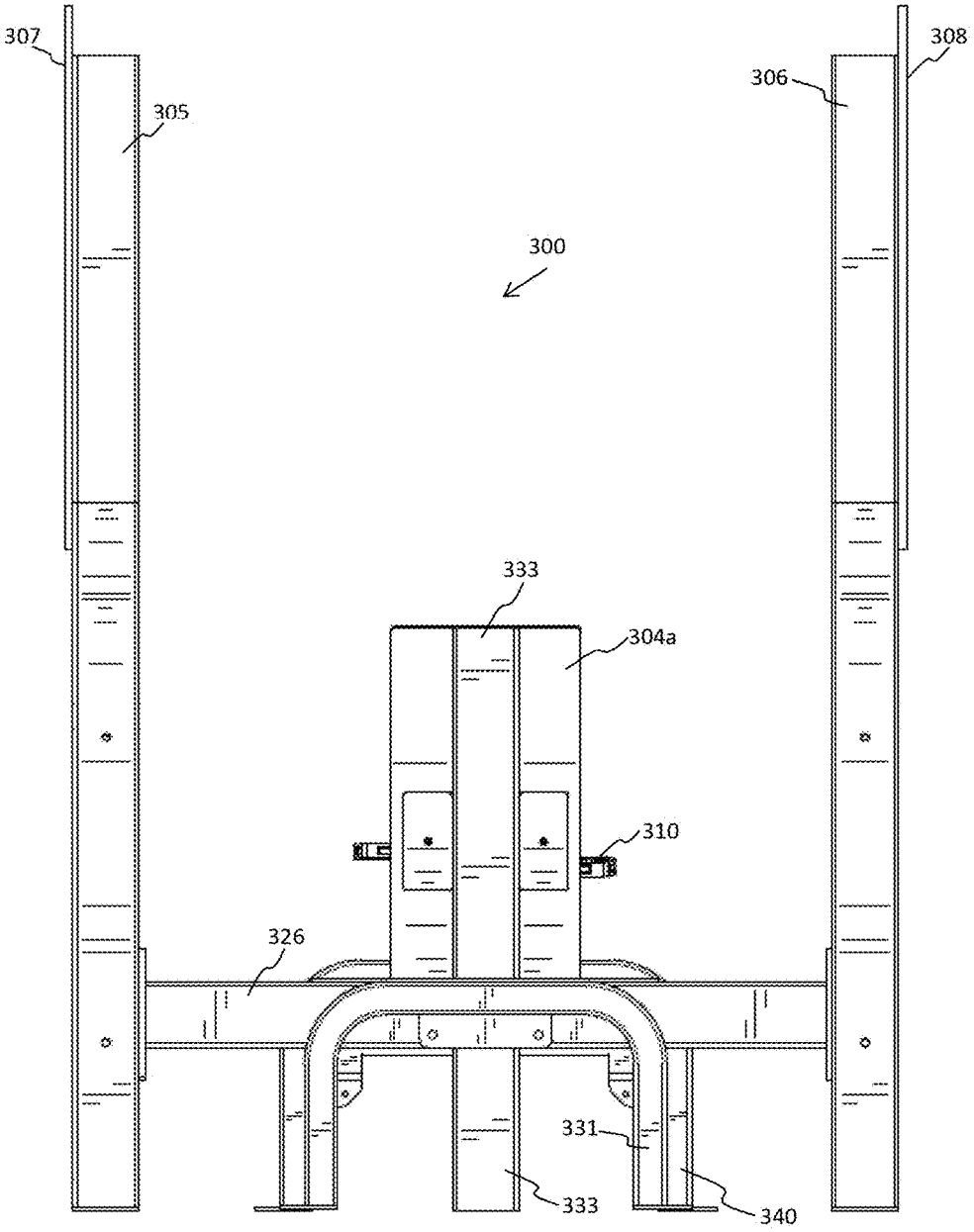
Figure 3D:
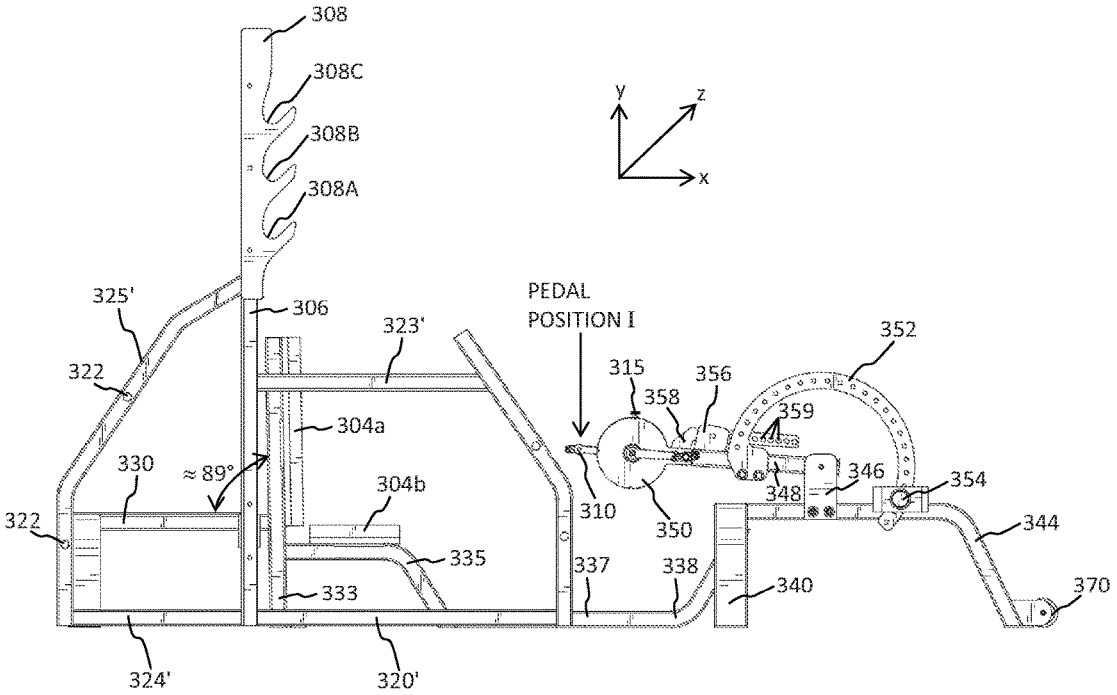
Figure 3E:
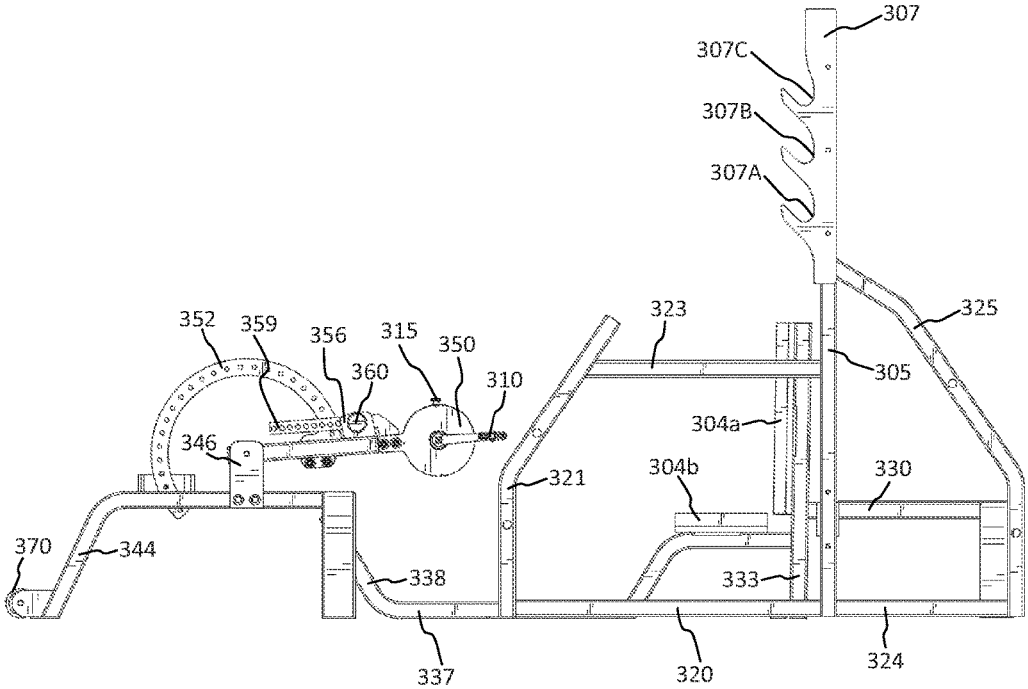
Figure 3F:
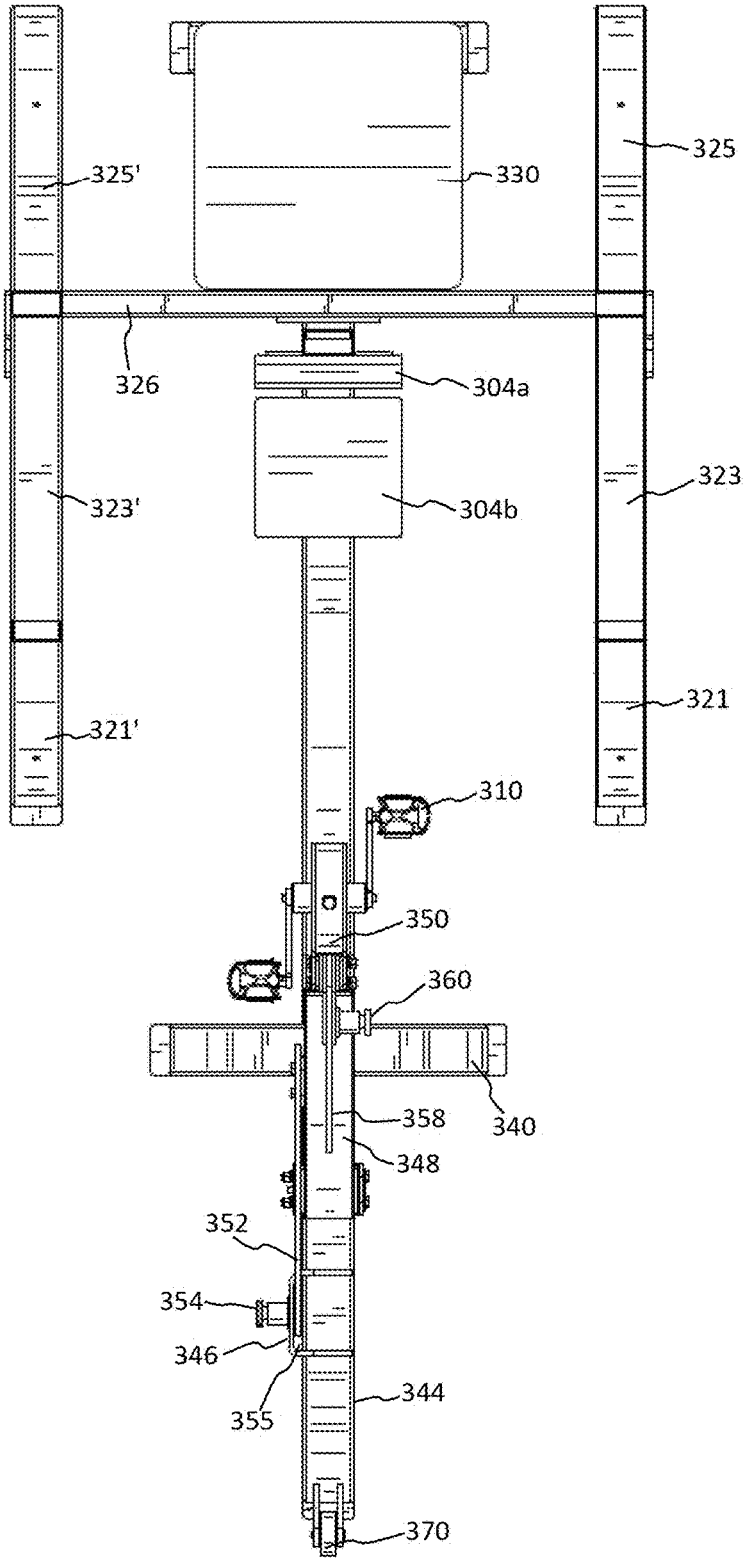
Figure 3G:
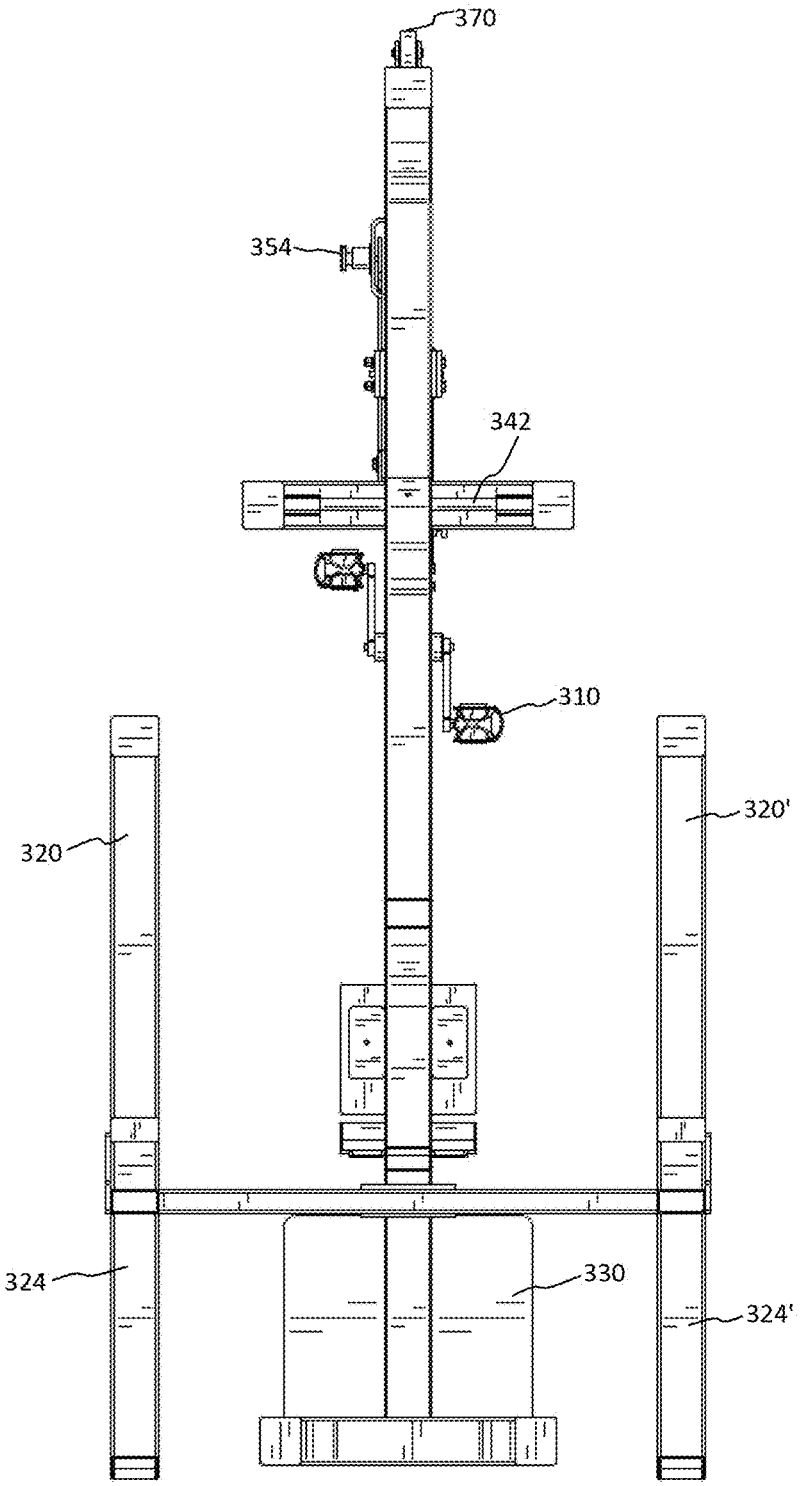
Figure 3H:
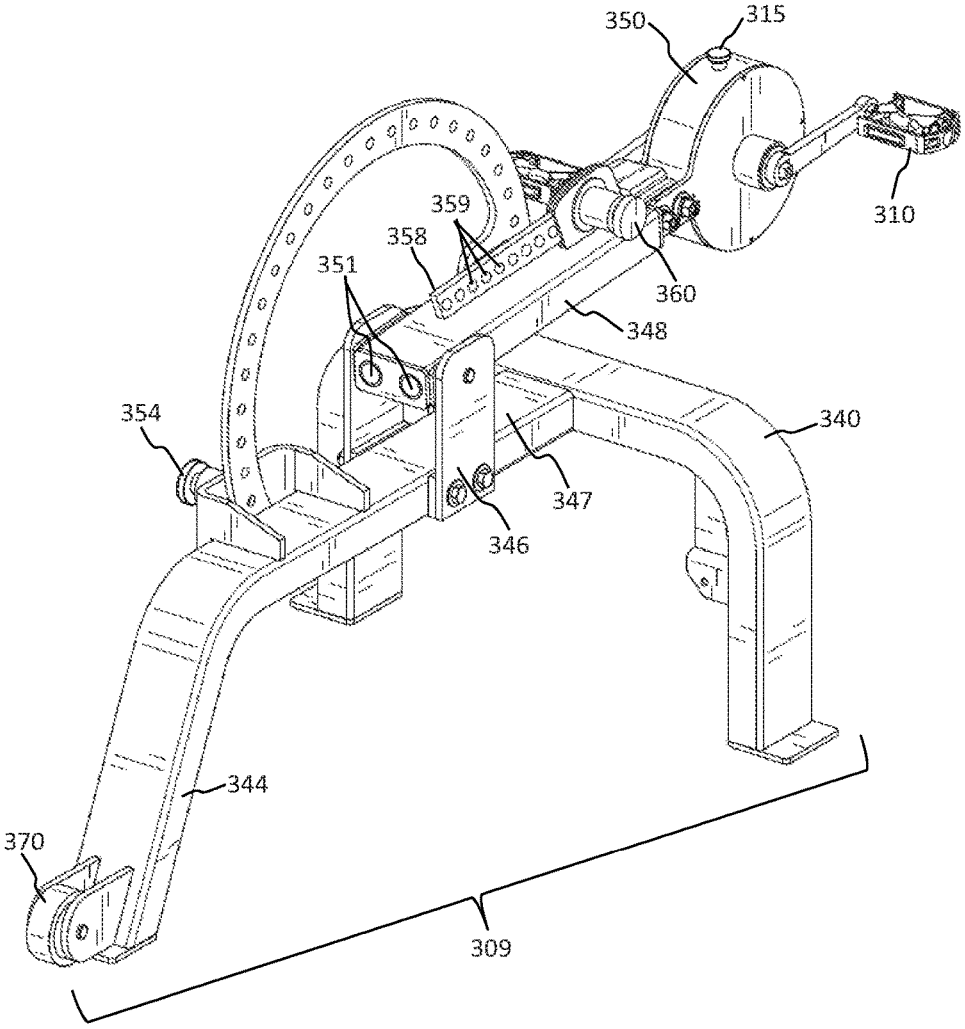
FIG. 3H is an enlarged, perspective view of the movable foot pedal assembly in the physical exercise apparatus of FIG. 3A.

FIG. 3A illustrates a perspective view of apparatus 300. In the illustrated embodiment, seat 304 is nonadjustable, although this is just a non-limiting example. In embodiments, seat 304 may comprise a back support 304*a* and a seat support 304*b*, where the back support 304*a* is at an angle of approximately 90 degrees, and more preferably 89 degrees, from the horizontal axis x defined by a base of the apparatus in a backward-facing longitudinal direction of the apparatus. As used herein, an angle of "approximately 90"

degrees includes an angle in the range of 85 to 95 degrees. In embodiments, the seat support 304*b* is positioned normal (i.e., at an approximately 90 degrees angle) to the back support 304*a*.

Also, in embodiments, there are multiple storage positions at different vertical levels on a weight support in which to store a resistance load, such as a barbell with weights, for performing upper body, weight lifting exercises, and the foot pedals are movable in two dimensions and with two mechanisms to adjust the pedals to a position appropriate to the length of the user's legs. In a preferred embodiment, the resistance load is a barbell as a barbell provides a resistance spread across both the right and left sides of the user for a balanced workout.

In FIG. 3A, frame 302 is shown with a particular one of various possible configurations. Right and left side frame portions are assembled on each side of seat 304 and are connected to each other via an intermediate frame portion. The frame is further connected to the movable foot pedal assembly 309.

In embodiments, the base of the left side frame includes horizontal frame components 320, 324 at approximately the ground level, vertical frame components 321 and 325 positioned at the front and back of the side frame, respectively, and another vertical frame component 305 positioned intermediate frame components 321 and 325. Horizontal frame component 323 connects vertical frame components 305 and 321. The right side frame is a mirror image of the left side frame with horizontal frame components 320', 323', 324' and vertical frame components 306, 321' and 325'. To provide easier access to seat 304, an upper section of each of vertical frame components 321, 321' may be angled backwards from the vertical axis, such as at an angle in the range of 30 to 60 degrees to connect to respective horizontal frame components 323, 323'. An upper section of each of vertical frame components 325, 325' is angled forward at one or more bends to connect to vertical frame components 305, 306, respectively. In this embodiment, vertical frame components 305, 306 may be positioned substantially vertically or may be inclined backwards, such as at an angle of between 4 and 8 degrees, or more preferably at an angle of 6 degrees. The right and left side frames are joined with crossbar 326. One skilled in the art will understand that the exact construction of frame 302 may vary from the illustrated configuration without departing from the spirit and scope of the invention.

In the illustrated embodiment, seat 304, including the back support 304*a* and the seat support 304*b*, is mounted to the frame. Seat 304 may be mounted to frame 302, for example, via a vertical support bar 333 that is mounted to crossbar 326 at 327. Seat 304 is further supported by a frame portion 335 that extends below seat 304 to position seat support 304*b*. In embodiments, seat support may be between 12 to 13 inches off of the ground.

A platform 330 may optionally be installed behind seat 304 and mounted above one or more support elements 331. Platform 330 may be used, for example, by a spotter to stand at a raised position near the user of the apparatus 300 as a precaution.

A support for a resistance load includes a weight rack that comprises weight supports 307, 308 mounted to frame 302 on which may be stored a resistance load, such as a weight like a barbell, when the resistance load is not in use. In the illustrated embodiment, supports 307, 308, which are mounted to respective left and right side frames, provide a choice of multiple vertical storage positions (or rungs) in which a resistance load may be stored when not in use. Three positions are shown, but fewer or more positions may be provided in any of the embodiments of the present invention. The resistance load is preferably a barbell for performing a target exercise for exercising a user's upper body.

For example, a barbell may be stored in the lowest storage position on the weight supports 307A, 308A, in the middle storage position on the weight supports 307B, 308B, or in the top storage position of weight supports 307C, 308C. The weights are for weight lifting to exercise the user's upper body as a target exercise to develop, for example, the deltoid muscles, while the user simultaneously performs a distraction exercise of cycling with foot pedals that adjust to a preferred position for a user.

In a preferred embodiment, a barbell is used for the weight lifting to provide an upper body exercise that may be best suited to a balanced workout on both the right and left sides of the user. However, it should be understood that while the weight supports are illustrated as accommodating a barbell. Different types of weights, such as dumbbells or kettlebells, may alternatively be used, and modified weight supports could be substituted on apparatus 300 to support the different type of weight such as a dumbbell or kettlebell on each side of the frame. For example, two vertically parallel weight supports can be mounted on each side of each frame to support a dumbbell or a barbell.

Apparatus 300 is shown with slots, such as slots 322 on the sides of side frame portions 302*a*, 302*b* into which optional weight holding bars, e.g. cylindrical pegs (not shown), may inserted to hold weight plates for barbell 309. Examples of weight holding bars that may be inserted are shown in FIGS. 9A to 9G (bars 921).

The movable foot pedal assembly 309 is provided for performing a cycling motion with a user's legs on foot pedals 310 as a distraction exercise simultaneously with the target upper body, weight lifting exercise. As described below, foot pedals 310 are adjustable by a user to a preferred position that is stable, comfortable and relaxing so that cycling with the foot pedals serves only as a distraction but does not itself serve as a target exercise. Foot pedal assembly may be formed integrally with frame 302 or have its own pedal assembly frame 339 connected to at the front of frame 302 that extends forward beyond seat 304. Where there is a separate pedal assembly frame 339, main frame 302 may extend from portion 335 under seat 304 through a ground level section 337 that allows a user easy access to seat 304 followed by a frame portion 338 that extends upward to connect to pedal assembly frame 339 with rod 342. Foot pedal assembly 309 enables the foot pedals 310 to be movable in a two-dimensional plane of dimensions x and y so that the foot pedals 310 can be adjusted to and releasably secured in a location that is stable, comfortable and relaxing for a particular user to position his or her legs for performing cycling as a distraction exercise. The foot pedals 310 are movable to accommodate users based, at least in part, on their leg length. Typically, a taller user will have a longer leg length and a shorter user will have a shorter leg length.

As shown in the embodiment of FIGS. 3A to 3I, foot pedal assembly 309 may have, for example, two different mechanisms to adjust the position of the foot pedals 310 to be releasably secured in a desired location within a two-dimensional plane. (Alternatively, there may be one or more than two adjustment mechanisms.) In embodiments, foot pedals 310 are rotatable and linearly adjustable to the desired location.

In the illustrated embodiment, foot pedal assembly 309 comprises components that allow for both a rotatable, angular adjustment of the foot pedals 310 about a pivot point and a linear adjustment, e.g., a telescoping adjustment, of the foot pedals 310 to accommodate different leg lengths. The range of possible rotational movements of the pedals 310 in pedal assembly may be configured to be fairly large, for example, in a range of from minus 15 degrees (toward the user) relative to a horizontal axis along the base of the apparatus (the base typically lies on a flat surface) to 175 degrees (away from the user) relative to the horizontal axis to accommodate people of different heights, e.g., 4 to more than 7 feet. Such a large range of angular rotation is generally unnecessary for most people using apparatus 300 or the apparatuses 500, 700, 900, 110 in embodiments described below, as the range of from minus 15 degrees to 90 degrees is generally adequate. However, allowing for a larger range of additional adjustment for people 0taller than 7 feet can be advantageous or may be desirable for aesthetics, safety, or other reasons.

In embodiments, foot pedal assembly 309 is supported by a foot pedal assembly frame 339 that includes lateral support member 340 and a medial support member 344 perpendicular to lateral support member 340. A first bracket/hinge 346 is mounted on the sides of medial support member 344. A rotating pedal arm ("rotating arm") 348 is connected between the sides of first bracket 346 with a pin 347 to serve as a hinge or pivot point that enables rotating pedal arm 348 to pivot about pin 347 forwards toward the front of apparatus 300 or backward towards the back of apparatus 300. A linearly adjustable bar 357 slides in and out of rotating pedal arm 348 to enable foot pedals 310 to be adjusted in a linear direction. In the illustrated embodiment, a pair of parallel guiding rods 351 may be mounted within rotating pedal arm 348 to assist in supporting the movement of bar 357. Linearly adjustable bar 357 has a pair of parallel cylindrical passageways through which the guiding rods 351 of the rotating pedal arm 348 pass. Rotating pedal arm 348 is further connected to an arcuate member 352 (which typically has a semicircular shape) having a plurality of apertures 353 (e.g., at least 20 apertures) that extend along the arcuate member 352 in an arc shape. Each of the apertures 353, which are preferably evenly spaced apart from one another, provides an available angular setting in which the foot pedals 310 may be releasably secured.

In embodiments, a second bracket 349, mounted to the right side of the foot pedal assembly 309, leaves a gap 355 (see FIG. 3F) between the right side of medial support member 344 and the inside of second bracket 349. Arcuate member 352 freely passes through gap 355 upward and downward when the angular position of pedals 310 is being adjusted. In embodiments, the bracket 349 may include a spring-loaded knob 354 that has a pin extending inward and biased toward the apertures 353 on arcuate member 352 to secure the arcuate member 352 in place when the pin engages one of apertures 353. Knob 354 is pulled outward by a user to remove the pin from aperture 353 so that the foot pedals 310 are released from their previously location and can be adjusted in an angular direction to a new location. When the foot pedals 310 have been adjusted to the desired new location, knob 354 is released by the user to thereby engage another of the apertures 353 that secures arcuate member 352 into place. There may also be an aperture in the right side of medial support member 344 of foot pedal assembly 309 into which the pin attached to knob 354 can extend, after passing through one of apertures 353 on arcuate member 352, to reinforce the locking of the assembly 309 into the desired angular position. An angular or "rotational" adjustment mechanism may thus include, in this exemplary embodiment, arcuate member 352 with apertures 353 and knob 354. In the illustrated embodiment, foot pedals 310 are therefore rotatably adjustable by coupling the rotating pedal arm 348 to movable foot pedals 310 and by coupling the rotating pedal arm 348 to the angular adjustment mechanism to secure foot pedals 310 into a desired angular position.

Although it is not illustrated, it will be understood that arcuate member 352 may be alternatively located at a position that is outside of and to the right of second bracket 349 without passing through any gap 355, or second bracket 349 may be omitted.

In embodiments, foot pedals 310 may also be linearly adjustable by also coupling foot pedals 310 to a linear adjustment mechanism. As noted above, this coupling of the foot pedals may be achieved by coupling the foot pedal housing 350 to rotating pedal arm 348, such as via the linearly adjustable bar 357 (see FIG. 3I) that slides in and out of rotating pedal arm 348 to adjust pedals 310 in a linear direction. To releasably secure pedal housing 350 into a desired linear position, pedal housing 350 is also connected to a second linearly adjustable apertured bar 358 that extends lengthwise substantially parallel to the linearly adjustable bar 357. Bar 358 has a plurality of apertures 359 (e.g., 8 or 10 apertures), that are preferably evenly spaced along bar 358 for securing the position of pedal housing 350 in or out of rotating pedal arm 348 to a fixed position in a linear direction. A third bracket 349 356 mounted to the front of rotating pedal arm 348 includes a spring-loaded knob 360, with an inner pin, that is mounted on the right side of the bracket 356 and is used to releasably secure the linear position of apertured bar 358 and the connected linearly adjustable bar 357 relative to rotating pedal arm 348 by engaging the pin in one of apertures 359. Thus, in this exemplary embodiment, a linear adjustment mechanism includes linearly adjustable bar 357 and apertured bar 358 connected thereto, and further includes knob 360, for moving foot pedals 310 linearly in or out of rotating pedal arm 348 to a more retracted or extended position that may be selected by the user. The linear adjustment of the pedals 310 may cover a range of between 7 to 8 inches, and more preferably 7.4 inches. The linear adjustment mechanism works in conjunction with the rotational adjustment mechanism to enable foot pedals 310 to be moved to a selected location in the two-dimensional x-y plane.

While one example of rotational and linear adjustment mechanisms has been described, in embodiments, alternative adjustment mechanisms may be substituted. For example, instead of using a spring loaded knob with these mechanisms, a conventional removable pin may be inserted into or removed from the apertures for exercise equipment. As another alternative example, rather than providing spring-loaded knobs, the knobs can have threaded pins that screw into corresponding apertures.

In another embodiment, a different rotational adjustment mechanism may be used, such as a rotational plate coupled to movable foot pedals 310, where the rotational plate has detents that work in cooperation with a releasable lever to releasably secure the rotating pedal arm to a position that is selected by a user. A similar set of detents may be alternatively used to maintain the selected position of the linear adjustment mechanism.

In another exemplary embodiment, linearly adjustable bar 357 may be releasable secured to a selected location within rotating pedal arm 348 by a securement means in the pedal arm 348 so that the connected linearly adjustable apertured bar 358 may be omitted.

Alternatively, rather than use a combination of a rotational adjustment mechanism and a linear adjustment mechanism, two linear adjustment mechanisms can be used to adjust foot pedals 310 to the desired position in a two-dimensional plane. For example, two perpendicular linear adjustments mechanisms could be provided for a user to select a desired location of the movable foot pedals 310 in a two-dimensional plane.

The provision of two adjustment mechanisms in the illustrated embodiment allow the pedals to be adjusted to one of a relatively large range of positions within two dimensions that is most stable, comfortable and relaxing to the legs of a particular user. For example, to accommodate most users, who fall within a typical height of from 4 to 7 feet, the pedal adjustments may be to be adjustable in the x and y dimensions to settings that can be stable, comfortable and relaxing for users as short as 4 feet to users as tall as 7 feet tall and heights therebetween. (The illustrated foot pedal assembly 309 may also accommodate users outside this range.) As a result of the attention to user comfort and avoidance of over-exertion or under-exertion, the cycling motion with the foot pedals 310 will serve only as a distraction exercise, and not as a target exercise. The versatile movement of the foot pedals 310 also allows the same foot pedal assembly 309 to be used with other exemplary embodiments of the physical exercise apparatus described below, such as apparatuses 500, 700, 900, and 1100, in which the user may be positioned in a backwardly inclined seat or lying with the user's back in a substantially horizontal position on a flat bench.

Figure 3I:
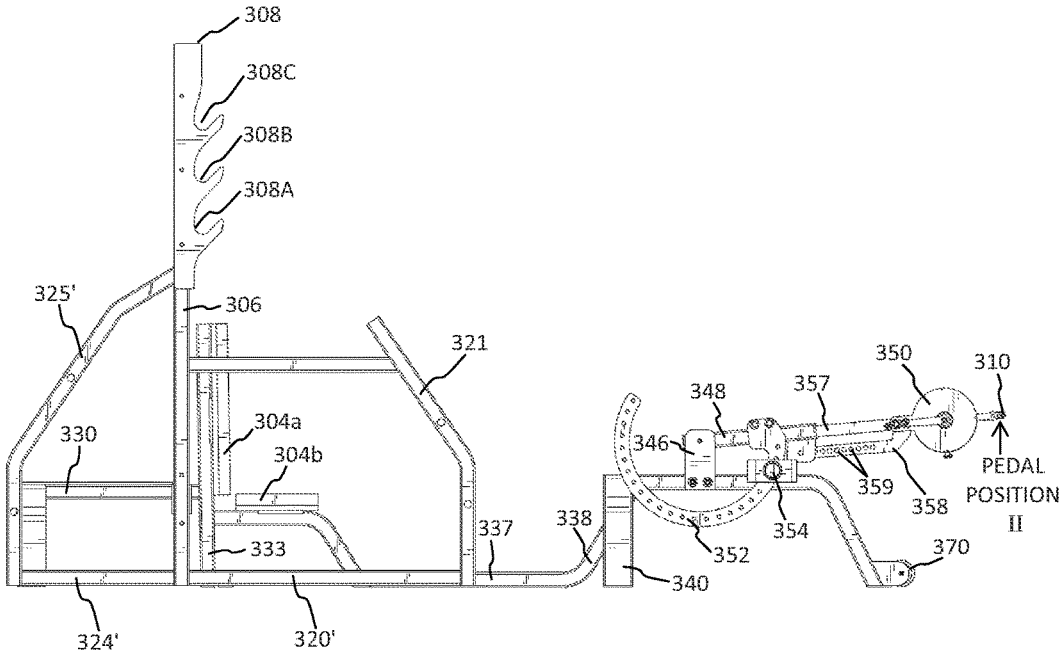
FIG. 3I is a right side view of the apparatus shown in FIGS. 3A to 3G that shows the movable foot pedals adjusted to a second, extended position that is more distant from the seat to accommodate a user with relatively longer legs.

FIGS. 3A to 3H show pedals 310 generally rotated to a pedal position I in which the pedals 310 are rotated fully inward toward a user and bar 358 is adjusted fully inward. This adjustment would generally be better suited for a user who has relatively short legs. A very short person might want to extend foot pedals 310 linearly outward at this same angular rotation of rotating pedal arm 348 so that the pedals 310 are easier to reach. On the other hand, a very tall person may rotate the pedals 310 fully forward to a different pedal position II, as shown in FIG. 3I where the pedals are rotated completely forward and foot pedals 310 are extended fully outward linearly for a user with longer legs. It should be understood, however, that the foot pedals 310 should be set to the individual comfort level of each individual so that the cycling motion can be performed without substantial effort. Indeed, most people would not use pedal position II but would rather set the pedals 310 to a position between pedal positions I and II.

Figure 3J:
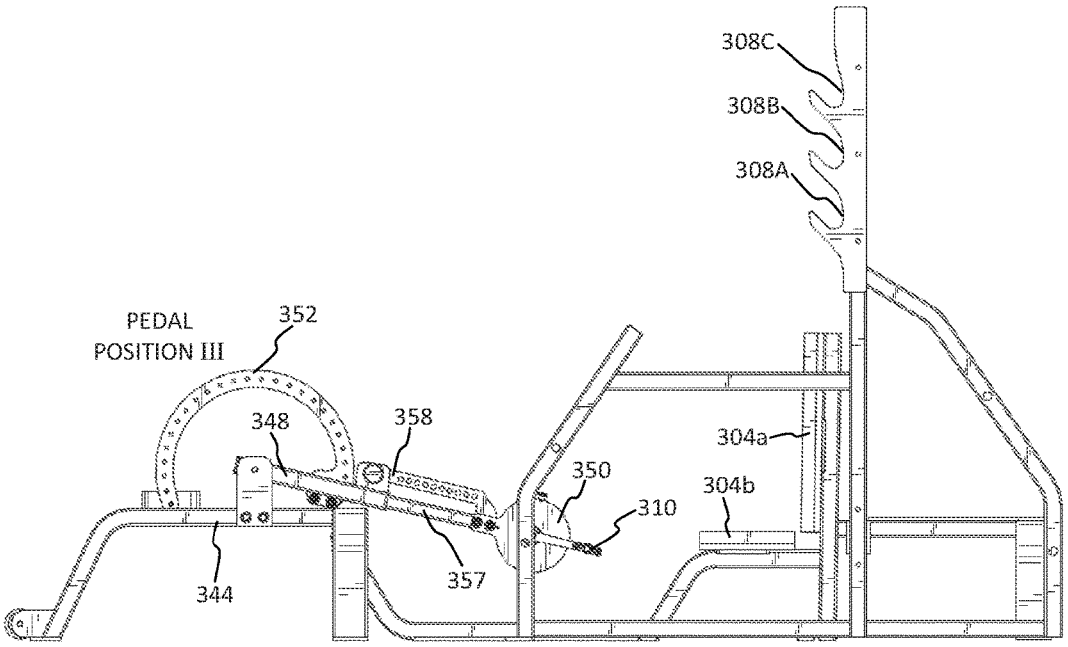
FIG. 3J is a left side view of the apparatus of FIG. 3A that shows the movable foot pedals adjusted to a third position.
Figure 3K:
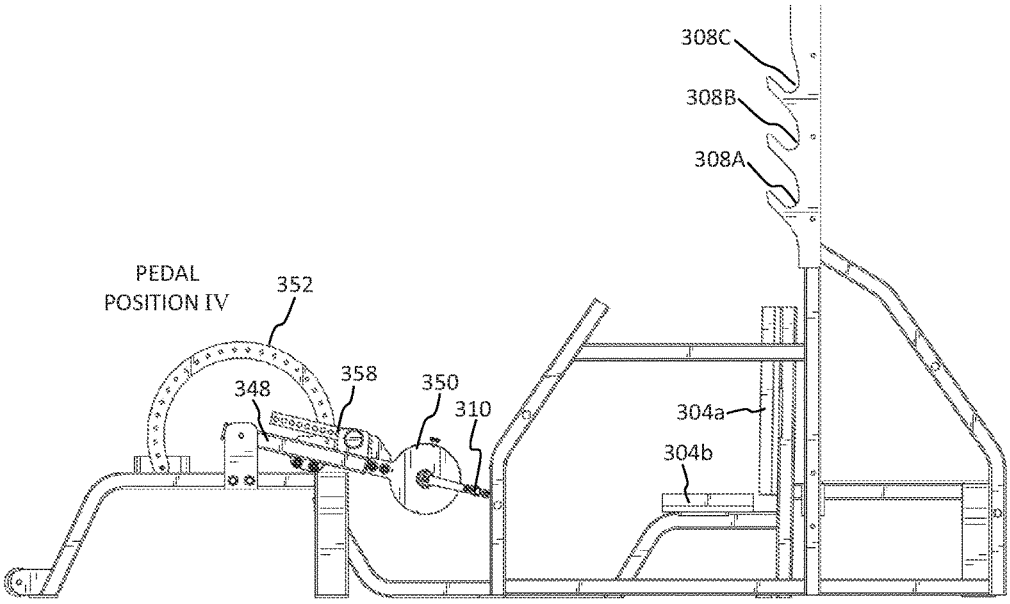
FIG. 3K is a left side view of the apparatus of FIG. 3A that shows the movable foot pedals adjusted to a fourth position.

FIGS. 3J and 3K show other examples of how the movable foot pedals 310 are adjustable to accommodate the leg lengths of users. For example, a user who is 4 feet tall may find it optimal to adjust the foot pedals to the selected location, pedal position III, shown in FIG. 3J to accommodate the user's leg length. In FIG. 3J, the foot pedals 310 are rotated backward, such as minus 15 degrees relative to the horizontal axis as defined by the base of the apparatus and the foot pedals may be fully extended linearly toward the user. As another example, a user who is a different height, such as 5 to 5.5 feet tall, may find it optimal to adjust the foot pedals to the selected position shown in FIG. 3K, pedal position IV. For example, in FIG. 3K, the foot pedals 310 may be set to approximately the same angle as in FIG. 3J, but the pedals are fully retracted in a linear direction. Alternatively, pedals 310 may be raised higher or lower than these values, as desired by a user.

In embodiments, the resistance on foot pedals 310 is generally kept to zero or a nominal amount so that the cycling requires minimal effort and remains a distraction exercise. However, in embodiments, some resistance may be selected by a user by a user, such as via an adjustable dial 315 near pedal housing 350, that raises or lowers the resistance on the pedals, such as with a mechanical resistance. The resistance control is not to be used to dial up the resistance and transform the cycling into a target exercise for increased cardiovascular training. Rather, the user control of the foot pedal resistance is provided to keep the foot pedal resistance to a minimum that is specific to a user. People with weaker leg muscles may select an extremely minimal to no resistance on the foot pedals to prevent the cycling from becoming more than a mere distraction. By contrast, users with stronger leg muscles may be uncomfortable cycling without having some more resistance applied to pedals 310. For such people, too little foot pedal resistance may make the cycling burdensome for them. Thus, if the cycling is too simple for a particular user, the user will have to focus on the cycling and lose focus on the target exercise performed by the upper body, thereby missing out on the benefits of performing a distraction exercise. By increasing the resistance on pedals 310 by adjusting dial 315, a user with stronger leg muscles is able to cycle in a more stable, comfortable and relaxing manner so that the cycling functions as a distraction. For example, in embodiments, the resistance may be selected within a range of ¼ pound of pressure until 19 pounds of pressure.

Significantly, the resistance applied to the foot pedals is not in any way coupled to or dependent upon the resistance load, such as the barbell, that is used for the upper body, weight lifting exercise.

Exercise apparatus 300 may optionally be provided with a ground-level wheel 370 at the front of the apparatus to allow the apparatus to be more easily relocated by lifting the back of the apparatus and rolling the apparatus along wheel 370 to a new location. Other exemplary embodiments of exercise apparatuses of the present invention may be similarly equipped with a wheel 370.

FIGS. 4A to 4J illustrate an example of how the physical exercise apparatus 300 of FIGS. 3A to 3I may be used by a user 401 in a seated position, to perform an upper body weight lifting exercise as a target exercise using the resistance load, such as a barbell, while simultaneously performing a distraction exercise of cycling with the foot pedals 310.

Figure 4A:
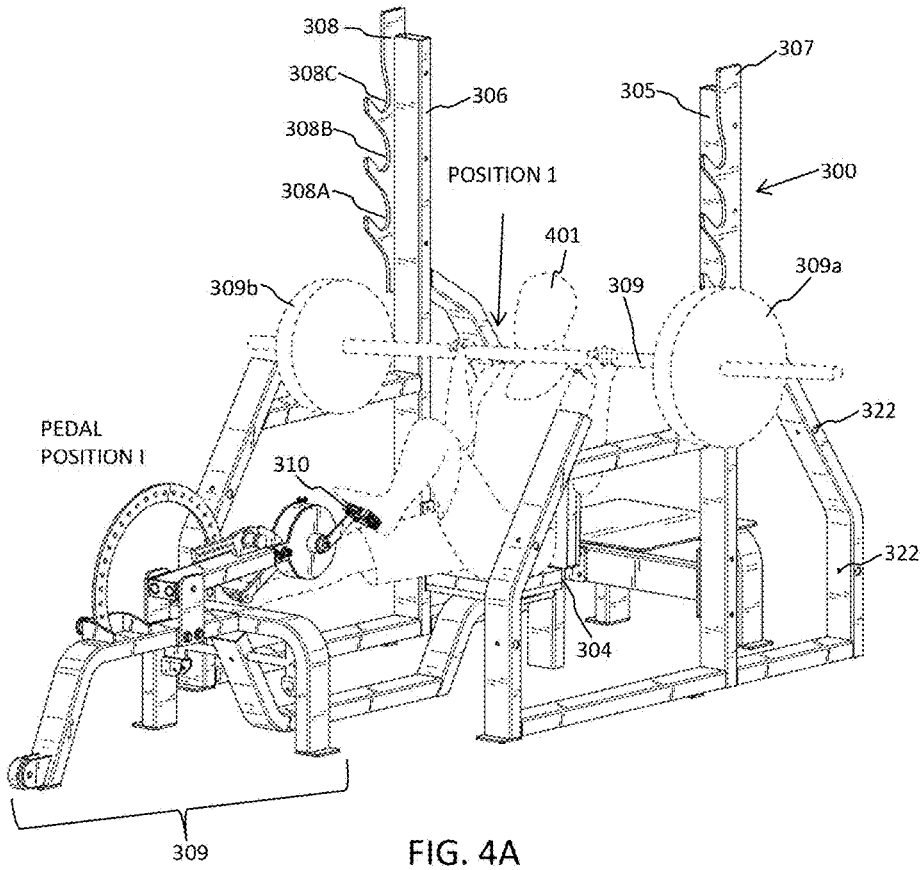
FIG. 4A is a perspective view showing a user using the physical exercise apparatus of FIG. 3A.
Figure 4B:
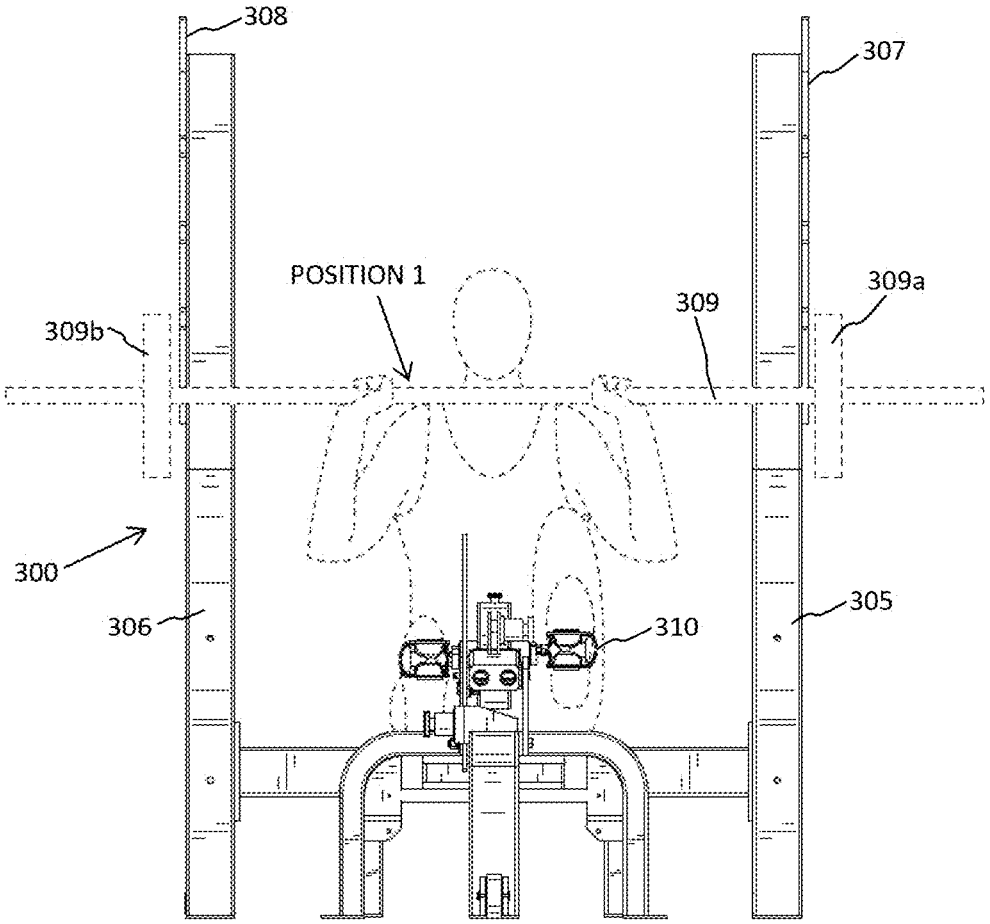
FIGS. 4B to 4G are front, rear, right side, left side, top and bottom views, respectively, that show the user using the physical exercise apparatus shown in FIG. 4A.
Figure 4C:
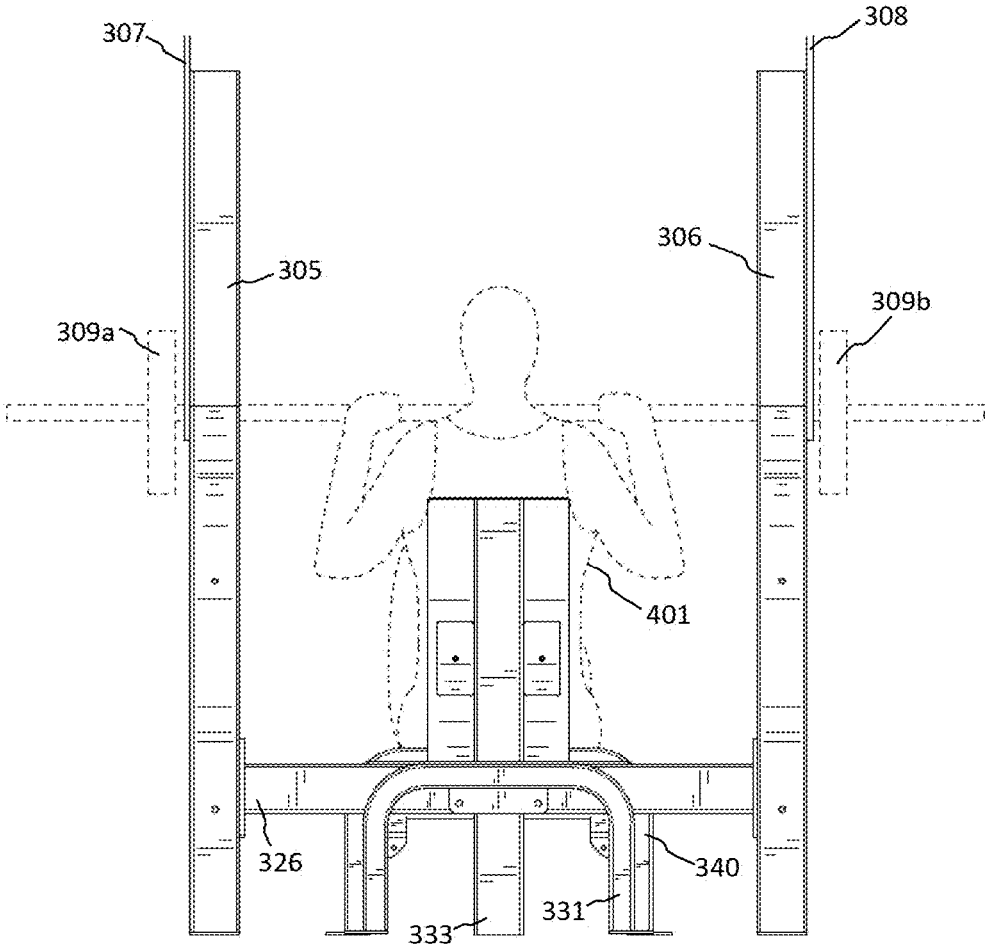
Figure 4D:
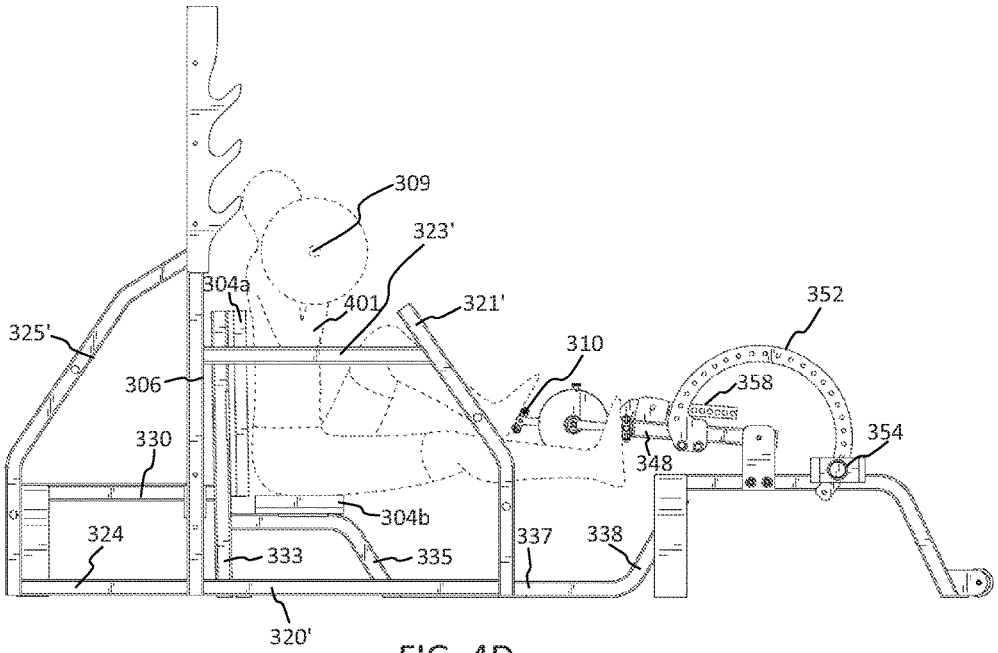
Figure 4E:
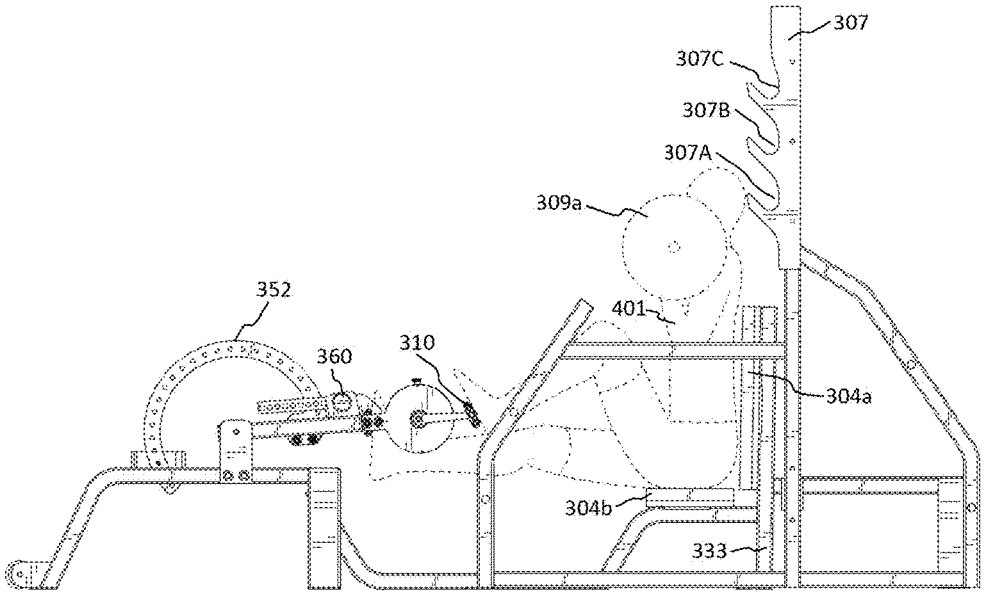
Figure 4F:
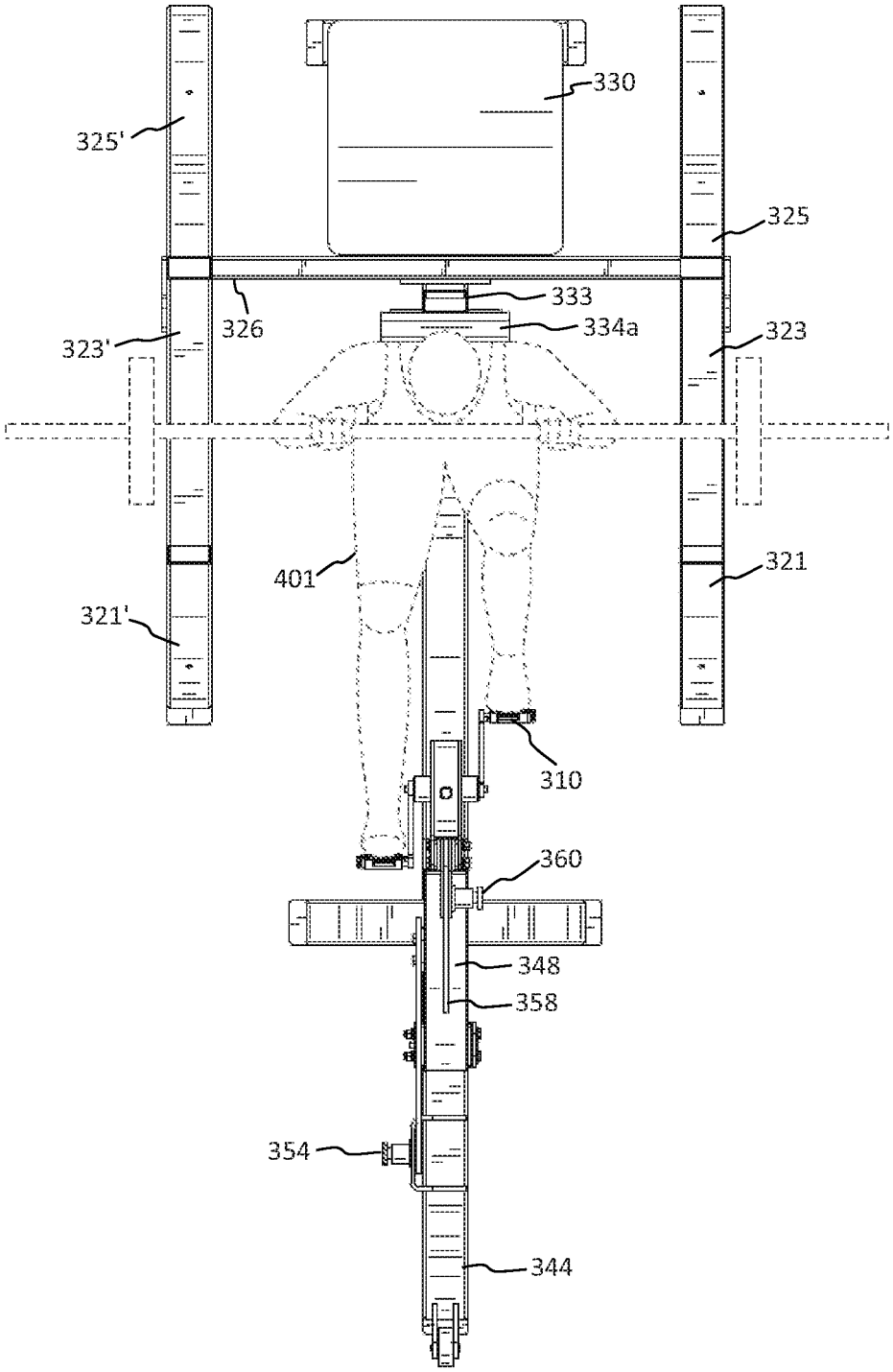
Figure 4G:
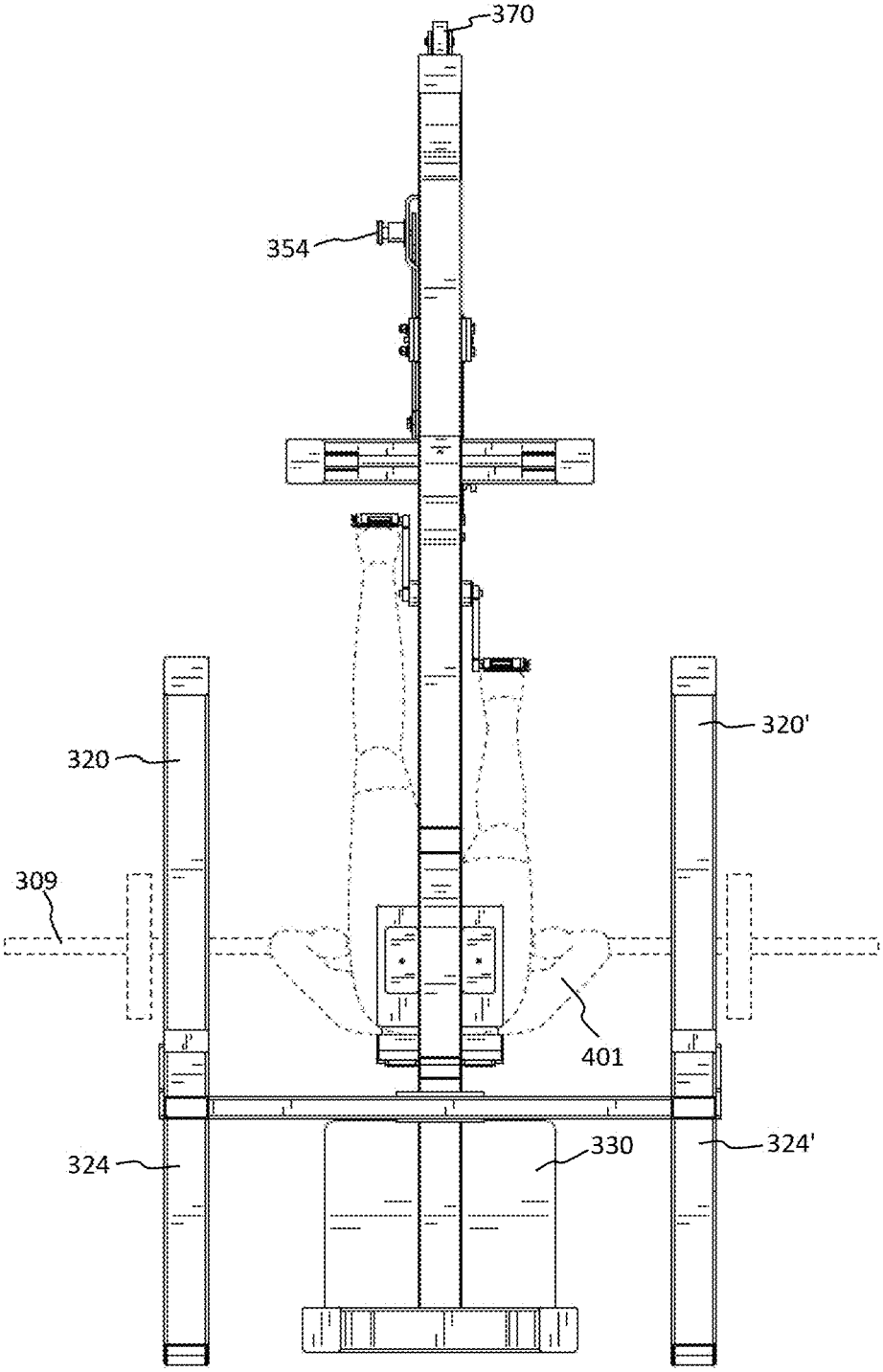

FIG. 4A shows the user 401 seated in seat 304 performing a shoulder press by lifting weights as a target exercise with the user's upper body that preferably targets the user's deltoid muscles, while simultaneously performing a cycling motion as a distraction exercise with foot pedals 310. User 401 lifts the weights by raising and lowering barbell 309, comprising weight plates 309*a* and 309*b* on either side of the bar. Performing the simultaneous distraction exercise allows the target exercise to be performed in a more balanced, symmetrical manner than would otherwise be possible so that both sides of the user's upper body achieve substantially the same amount of exercise and, consequently, substantially the same amount of strength and muscular development. FIGS. 4B to 4G are front, rear, right side, left side, top and bottom views, respectively, that show the user using the apparatus as shown in FIG. 4A. User 401 is shown holding the barbell 309 in a first vertical position "1" approximately level with the user's neck.

Before beginning the simultaneous exercise target and distraction exercises on apparatus 300, user 401 must first set the foot pedal position by setting the angular and linear adjustments and test the resistance of the foot pedals using dial 315 to adjust the resistance applied to foot pedals 310. Additionally, where a barbell is used, as in the illustrated embodiment, the barbell must be stored in the weight supports 307, 308. A relatively short user shown in FIGS. 4A to 4I would typically stow the barbell in the lowest rung 307A, 308A of the left and right weight supports so that the barbell 309 is within reach and set the pedal position, e.g. using the provided adjustment mechanisms to pedal position I. A taller user would typically stow the barbell in a higher rung.

Figure 4H:
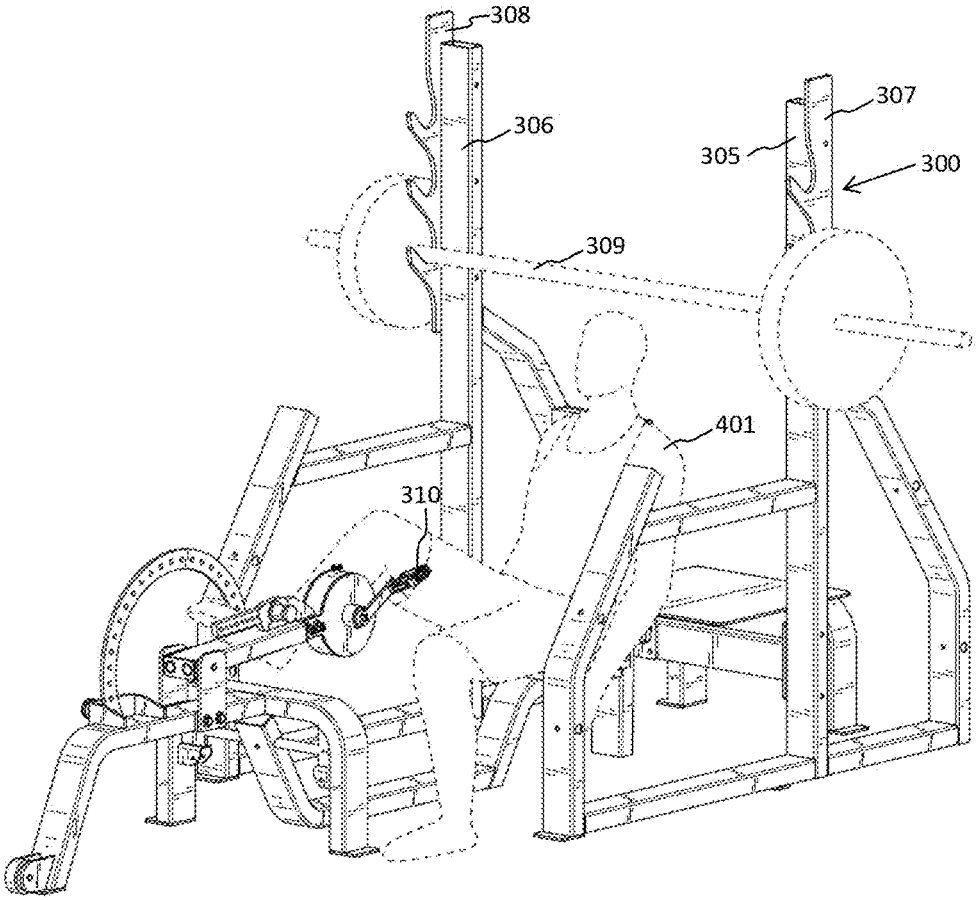
FIG. 4H is a perspective view of the user positioning one foot on a foot pedal of the physical exercise apparatus of FIG. 3A to position the user's feet for cycling before the user initiates the target exercise and removes the barbell from a weight support rack to simultaneously perform an upper body, weight lifting as a target exercise and a distraction exercise with the foot pedals.

To begin the exercises using a barbell, after making the necessary user-specific adjustments, user 401 sits in seat 304, as shown in FIG. 4H, and positions one foot on one foot pedal, such as the right foot as shown onto the right pedal 310, and thereafter places the other foot onto the other foot pedal. While mounting the exercise apparatus and placing the feet on the foot pedals 310, barbell 309 continues to be held in the weight supports 307, 308.

Figure 4I:
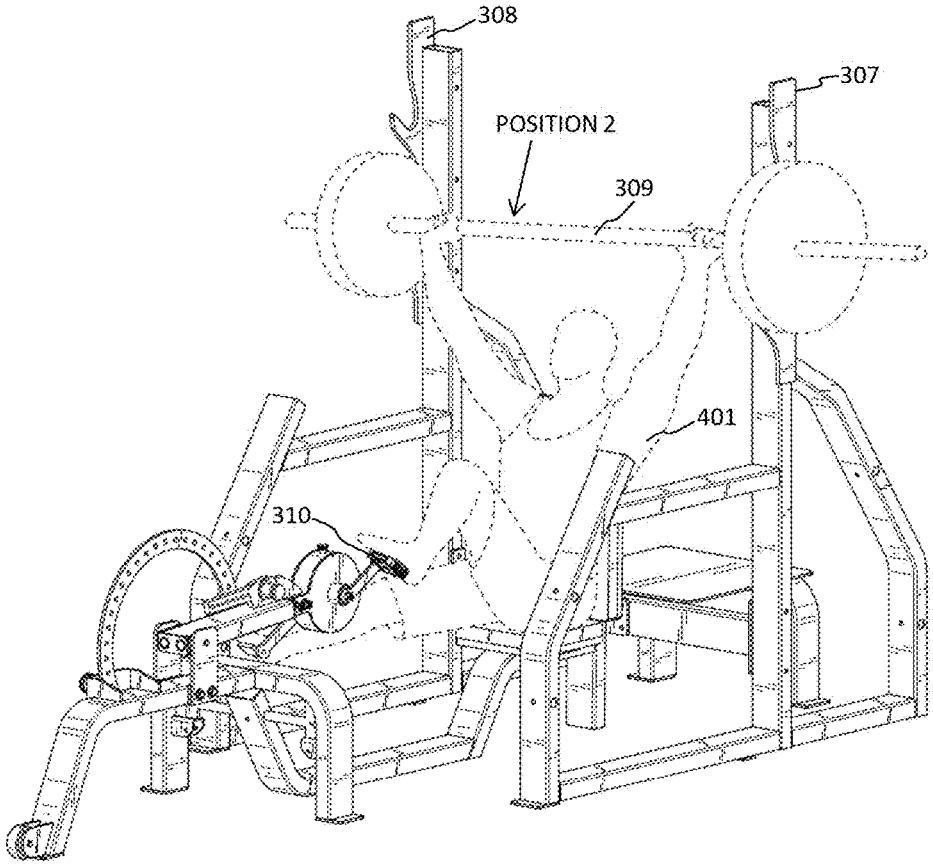
FIG. 4I is a perspective view of the user positioned on the apparatus of FIG. 3A with the user's feet on the foot pedals and fully raising the barbell from the weight support rack upon initiating the upper body weight lifting exercise to be performed as a target exercise simultaneously with the distraction exercise of cycling with the foot pedals.

Next, as shown in FIG. 4I, after the user's feet are positioned on the foot pedals 310, the user removes the barbell 309 from the weight supports 307, 308 and begins cycling with the foot pedals as a distraction exercise in a gentle, controlled manner. For example, the user should maintain a pedaling speed of between 1 mph and 4 mph while simultaneously performing an upper body, weight lifting as a target exercise in a continuous controlled manner. FIG. 4I shows user 401 lifting barbell 309 to a fully raised position "2". In all embodiments, the weight lifting is performed by a user by lifting and lowering the weight in a controlled and continuous manner, with the user taking care not to lock the user's elbows during the weight lifting.

The positioning of the feet on the foot pedals 310, before beginning the upper body target exercise with the barbell reduces the risk of injury to the user that might occur were user 401 to try to begin the lifting of the barbell and then positioning the feet on the foot pedals. Also, pre-positioning the resistance load, such as barbell 309, in proximity to user 401, helps prevent other injuries, such as a tear in the user's rotator cuff, more specifically, in the user's Infraspinatus rotator cuff muscle, that could result, for example, if a barbell were prepositioned on the ground and had to first be lifted from the ground.

To safely discontinue the exercise, the user 401 will preferably first return barbell 309 to the weight supports 307, 308 and then remove the feet from the foot pedals 310.

While FIGS. 4A to 4I illustrate the use of apparatus 300 for weight lifting with a barbell, it is also possible to lift other free weights, such as dumbbells or kettlebells. Dumbbells or kettlebells of larger weight can be pre-stored in weight supports modified to hold dumbbells or kettlebells for a user to access for weight lifting.

Figure 4J:
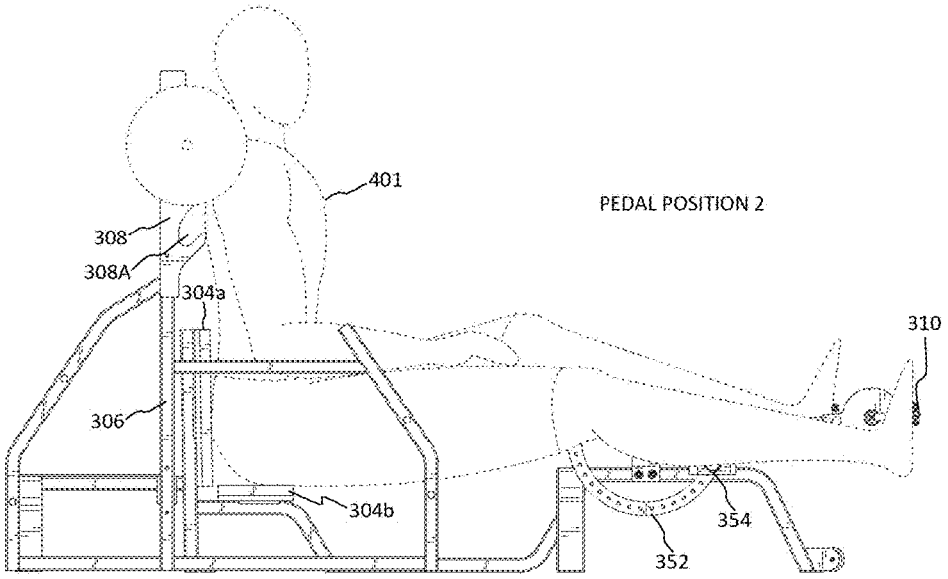
FIG. 4J is a right side view of a user preparing to use the physical exercise apparatus, where the user has relatively longer legs than the user shown in FIGS. 4A to 4I and the movable foot pedals are adjusted to an extended position to accommodate the user's longer legs.

FIG. 4J shows a right side view of a taller user 401' seated on the apparatus 300 of the present invention with the foot pedals 310 adjusted to the extended, pedal position II, as shown in FIG. 3I. Pedal position II can accommodate the longer legs of taller user 401'. FIG. 4J also shows that providing multiple rungs in weight supports 307, 308 allow the taller user to more comfortably and safely stow barbell 309 in a higher rung, such as rung 307B, 308B.

Figure 5A:
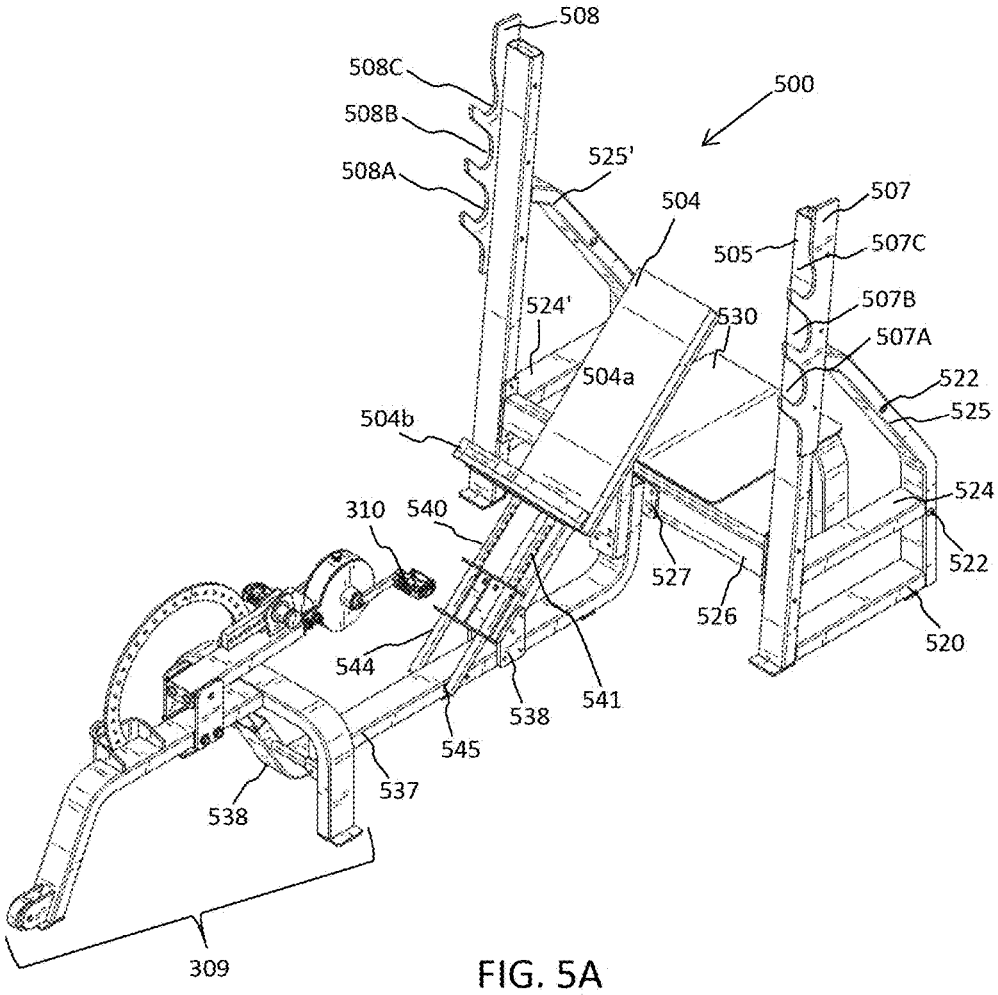
FIG. 5A is a perspective view of a physical exercise apparatus according to another exemplary embodiment of the present invention in which the apparatus has a seat that is inclined at approximately 44 degrees from the horizontal position with the movable foot pedals adjusted to a position for a user with relatively short legs.
Figure 5B:
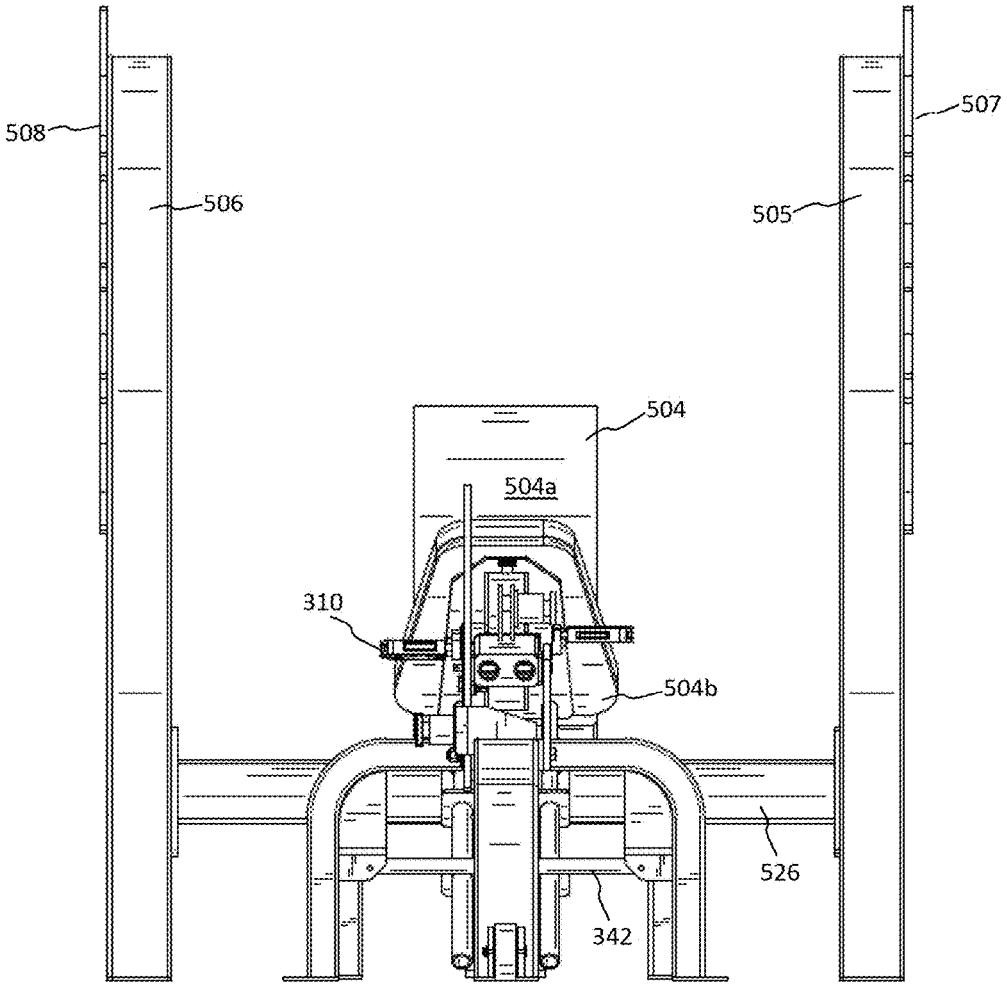
FIGS. 5B to 5G are front, rear, right side, left side, top and bottom views, respectively, of the physical exercise apparatus shown in FIG. 5A.

FIGS. 5A to 5G illustrate another exemplary embodiment of a physical exercise apparatus 500 in accordance with the present invention and generally for use as a seated shoulder press in accordance with the present invention. FIG. 5A illustrates a perspective view of the physical exercise apparatus 500. Apparatus 500 includes a frame 502, a seat 504 mounted to frame 502, weight supports 507, 508 on the frame located above and toward the back of seat 504, and a movable foot pedal assembly 309 that, in embodiments, is identical to the foot pedal assembly 309, shown in FIG. 3A. In this embodiment, seat 504, including both back support 504*a* and seat support 504*b* that are approximately perpendicular to one another, is reclined at a backward incline within a range of 40-50 degrees, and more preferably at an incline of 44 degrees relative to a horizontal x-axis relative to the ground (the "44 degree seat" embodiment). As shown, the seat's back support 504*a* may be stationary while the seat support 504*b* may be raised and lowered to a selected position along the 44 degree angle of inclination. For example, the range of adjustment between the highest and lowest positions of seat support 504*b* may be 15 inches, where the position will typically be based, at least in part, on user height and comfort. As in the embodiment of FIG. 3A, weight supports/weight support plates 507, 508 are provided to store a resistance load, such as a barbell, for performing an upper body, weight lifting exercise as a target exercise, and a foot pedal assembly 309 is provided to simultaneously perform cycling with the user's legs as a distraction exercise.

In FIG. 5A, frame 502 is shown with side frame portions 503 on each side of seat 504. The left side frame portion 503 includes a horizontal frame component 520 at the ground level, two vertical frame components 505 and 525 positioned at the front and back of the side frame, respectively, and another horizontal frame component 524 positioned above horizontal frame component 520 that further joins vertical frame components 505 and 525. The right side frame has a similar construction, with horizontal frame component 520' at approximately the ground level, vertical frame components 506 and 525' positioned at the front and back of the side frame, respectively, and another horizontal frame component 524' that connects vertical frame components 521' and 525'. An upper section of each of vertical frame components 525, 525' is angled forward at one or more bends to connect to vertical frame components 505, 506, respectively. Vertical frame components 505, 506 may be inclined backwards at an angle of approximately 6 degrees from the vertical position to account for the incline of seat 504. The right and left side frames are joined with crossbar 526. This frame configuration offers a sturdy support for upper body weight lifting and also offers easy access for a user to sit on seat 504. However, one skilled in the art will understand that the frame configuration in accordance with the invention may vary from the illustrated configuration.

Figure 5C:
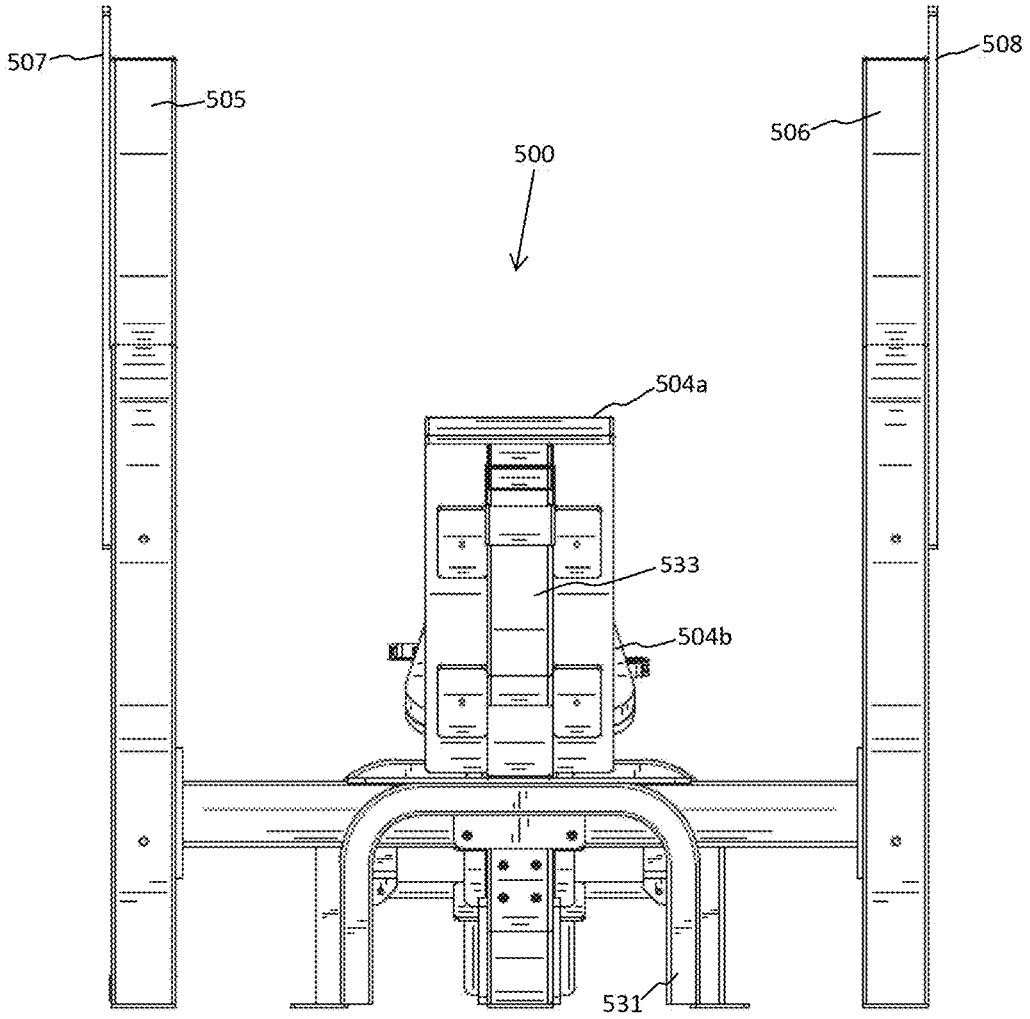
Figure 5D:
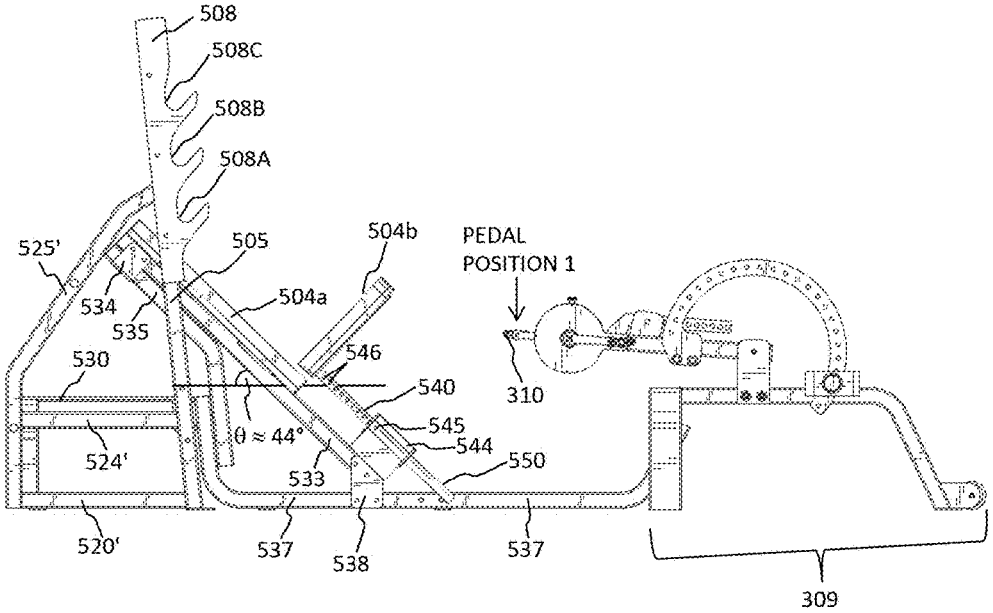
Figure 5E:
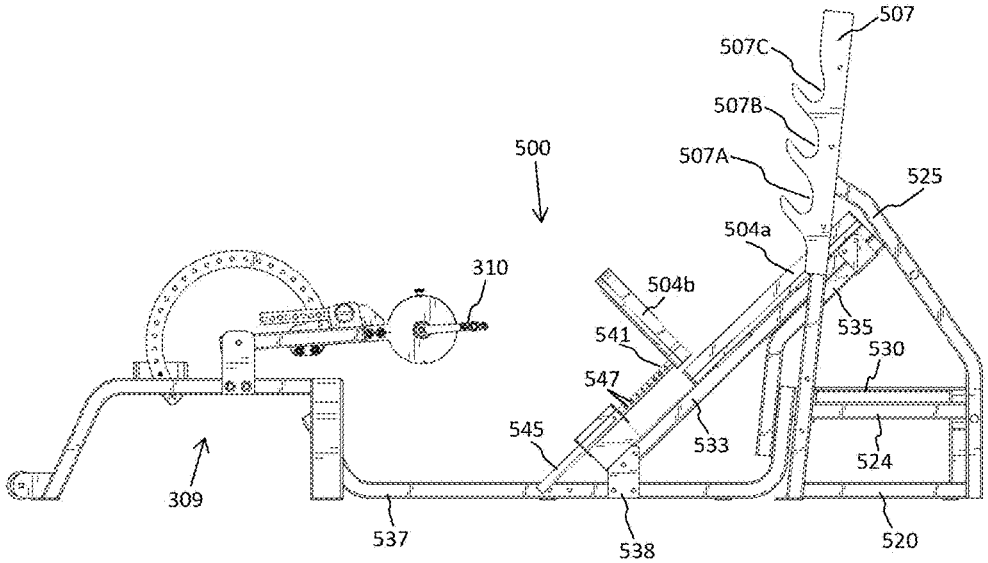
Figure 5F:
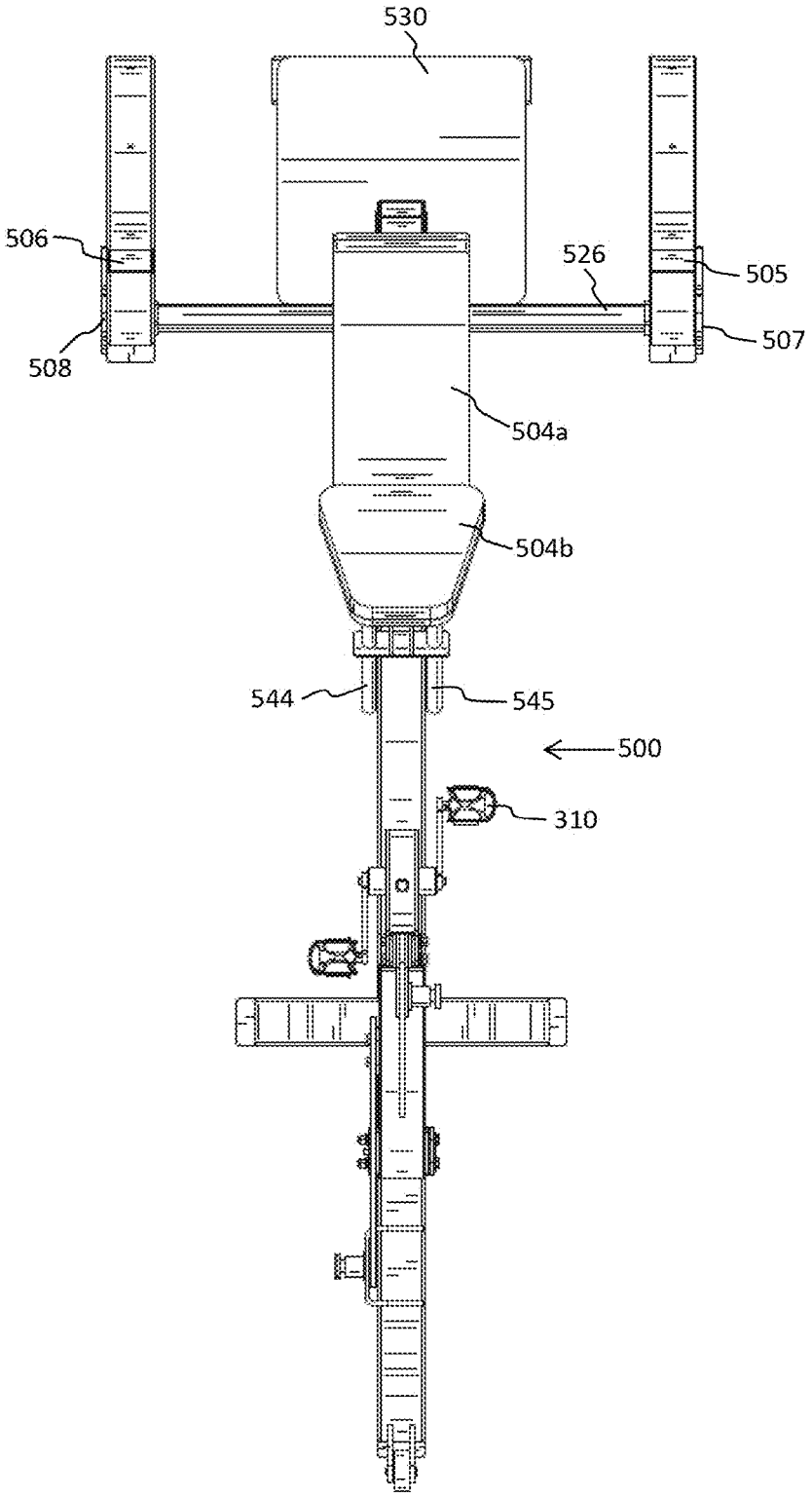
Figure 5G:
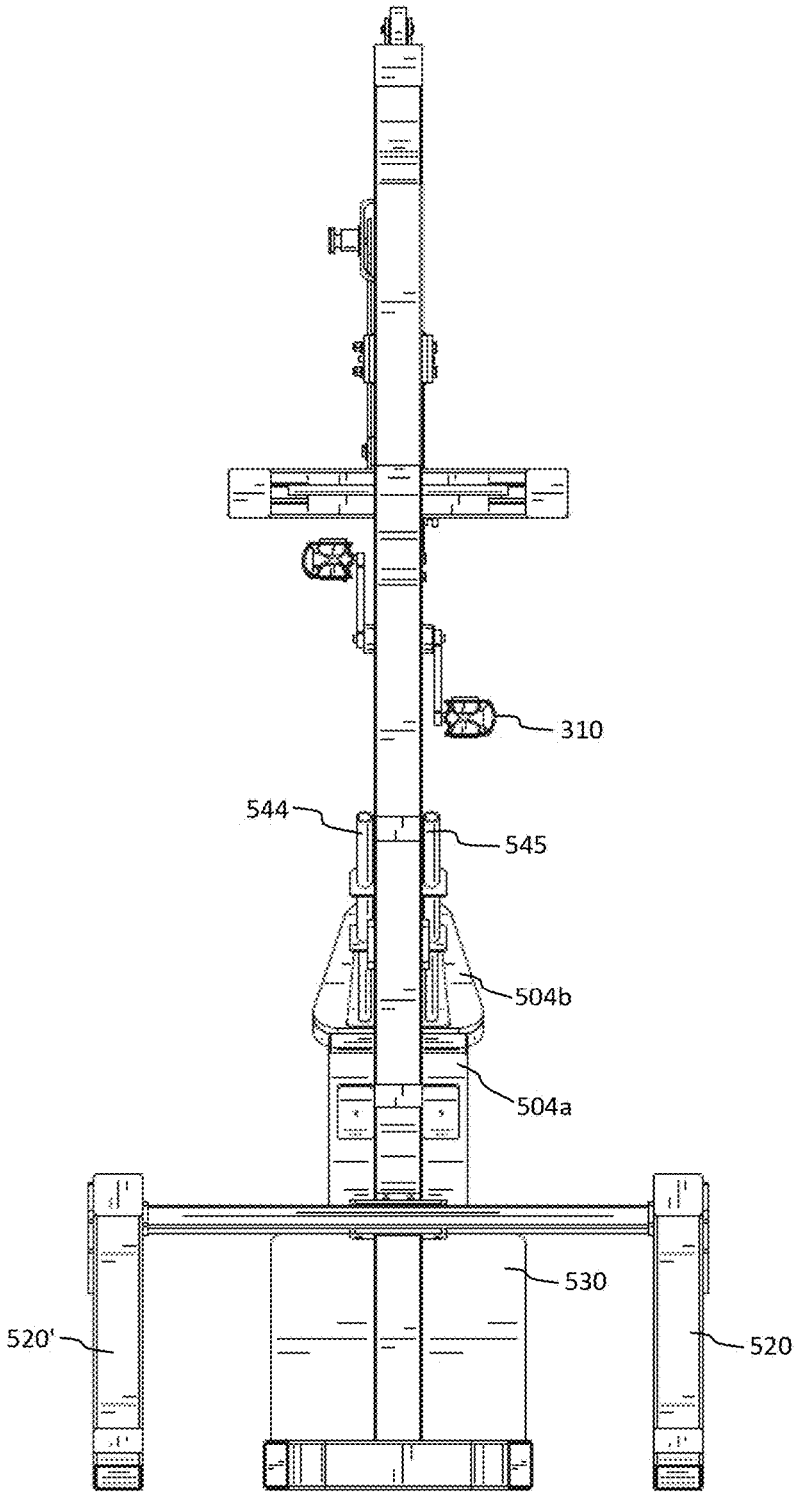

A frame portion 537 extends laterally below seat 504 and forward along section 538 to a connection with foot pedal assembly 309. Frame portion 537 is also connected to crossbar 526 at 527. As shown in FIGS. 5C and 5D, seat back support 504*a* is supported with an inclined support bar 533 that is mounted with a bracket 534 to the top of a support element 535 that is behind, and is inclined parallel to, support bar 533, and is mounted with a bracket 538 to frame portion 537 at the ground level. The top of support element 535 is further connected toward the back of frame portion 537. Support element 535 is angled downward around the middle of the support element and then connects to frame portion 537. Thus, in embodiments, back support 504*a* is nonadjustable. However, the height of seat support 504*b* along an incline is adjustable via an attachment to two adjustment rods 540, 541 under seat support 504*b* that can be moved up and down at an approximately 44 degree incline within respective right and left tubular sleeves 544, 545 that are connected to the bottom of inclined support bar 533. The height adjustment of seat support 504*b* is based at least in part on an arm length of the user to provide the user with the access to the resistance load for a target exercise. Rods 540, 541 have respective sets of multiple slots 546, 547 spaced from one another along the rods so that the seat support 504*b* can be secured into a location that is comfortable for the user using, for example, a pin 545 inserted through holes in sleeves 544, 545 and slots 546, 547.

As an option, a platform 530 may be installed behind seat 504 and mounted above one or more support elements 531. Platform 530 may be used, for example, by a spotter to be positioned near the user of the apparatus 500, as a precaution.

Apparatus 500 is also shown with slots 522 on the sides of side frame portions 502*a*, 502*b* into which optional weight holding bars/pegs (not shown) may inserted to hold weight plates for barbell 309.

Weight supports 507, 508 are provided with frame 502 to store a resistance load, such as a weight like a barbell, dumbbell, kettlebell or other free weight, to be used for performing a target exercise for exercising a user's upper body. In this embodiment, supports 507, 508, which are on respective left and right side frames, provide a choice of multiple vertical positions in which a weight may be stored when not in use. For example, a barbell may be stored in a lowest position 507A, 508A, a middle position 507B, 508B, or a top position 507C, 508C of weight supports 507, 508. The weights are for exercising the user's upper body as a target exercise.

The movable foot pedal assembly 309 is provided for performing a cycling motion with a user's legs on foot pedals 310 as a distraction exercise simultaneously with the target upper body, weight lifting exercise. In embodiments, foot pedal assembly 309 is identical to foot pedal assembly 309 shown in the embodiment of FIGS. 3A to 3I. Thus, the above description of foot pedal assembly 309 applies to exercise apparatus 500 as well. Foot pedals 310 are rotationally and linearly adjustable by the user and the resistance is user adjustable as described above.

Typical adjustments of movable foot pedals 310 and seat support 504*b* on apparatus 500 for users who are 4 feet tall leave the foot pedals 310 rotated upward in a range of 3 to 8 degrees, and more preferably 5 degrees, relative to the horizontal axis and fully extended toward the user, and have the seat support 504*b* adjusted to its highest position. The lowest part of seat support 504*b* may be in a range of 19 to 20 inches off the ground, and more preferably 19.6 inches off of the ground.

Typical adjustments of movable foot pedals 310 and seat support 504*b* on apparatus 500 for users who are 7 feet tall may leave foot pedals 310 angled upward at a higher angle such as in a range of 10-15 degrees and more preferably in a range of 12-13 degrees from the horizontal axis, and the seat support 504*b* adjusted to its lowest position. The lowest part of seat support 304*b* may then be between 11.5 to 12.5 inches, and more preferably 12 inches off of the ground. Alternatively, pedals 310 may be raised higher or lower than these values as desired by a user.

Figure 6A:
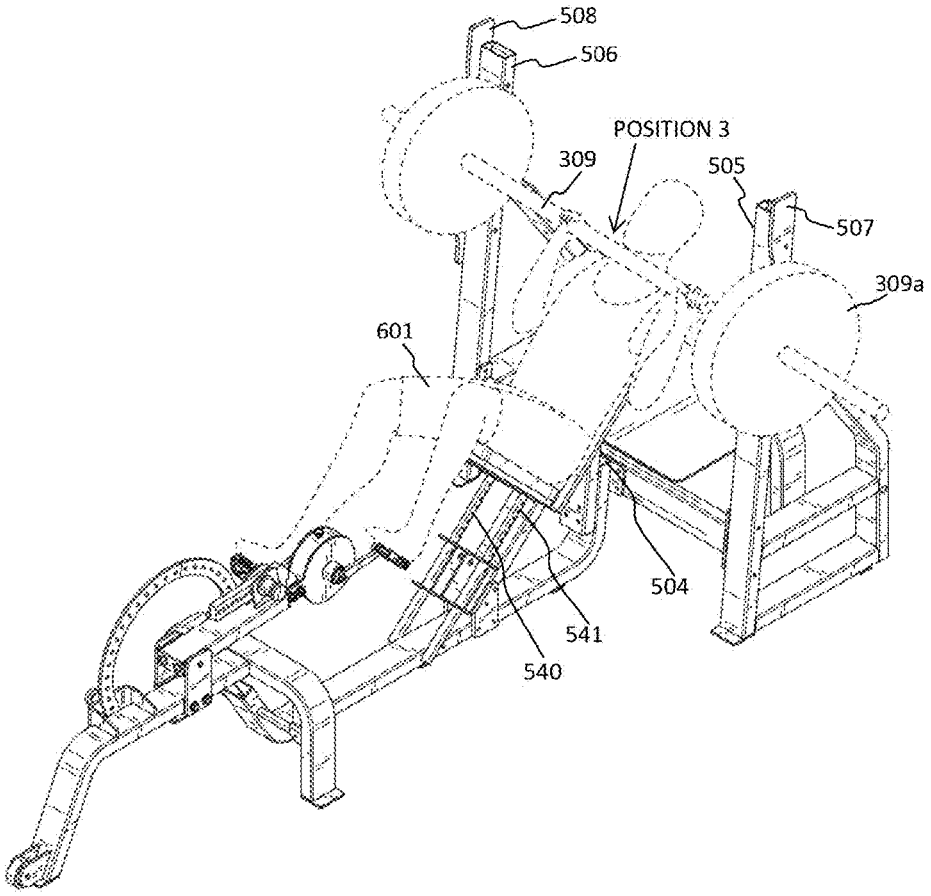
FIG. 6A is a perspective view showing a user using the physical exercise apparatus of FIG. 5A.
Figure 6B:
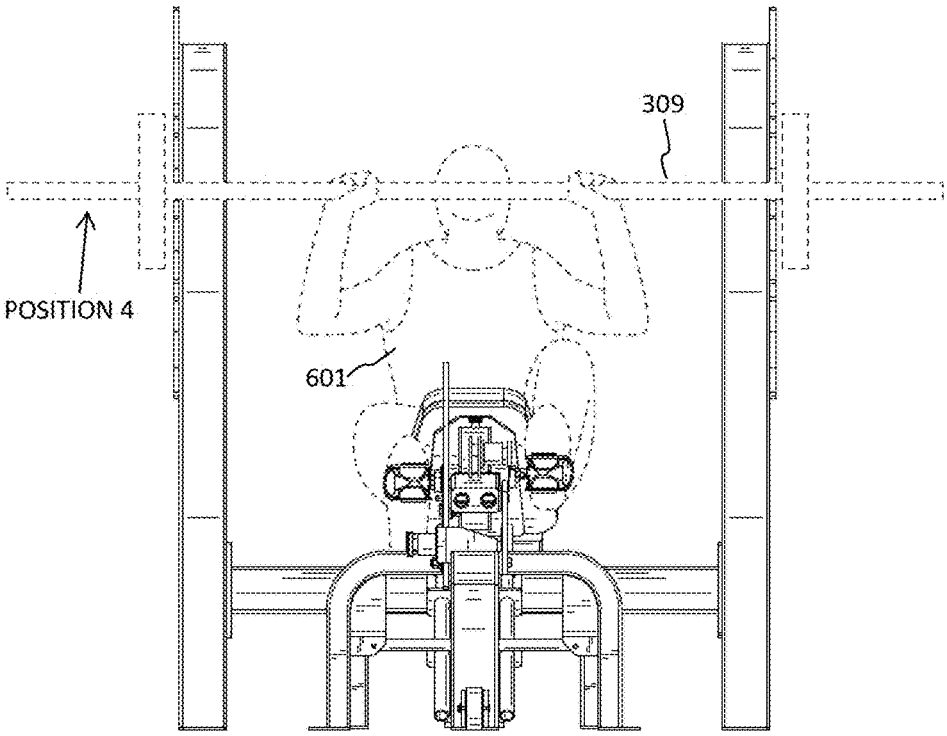
FIGS. 6B to 6G are front, rear, right side, left side, top and bottom views, respectively, that show the user using the apparatus shown in FIG. 5A.
Figure 6C:
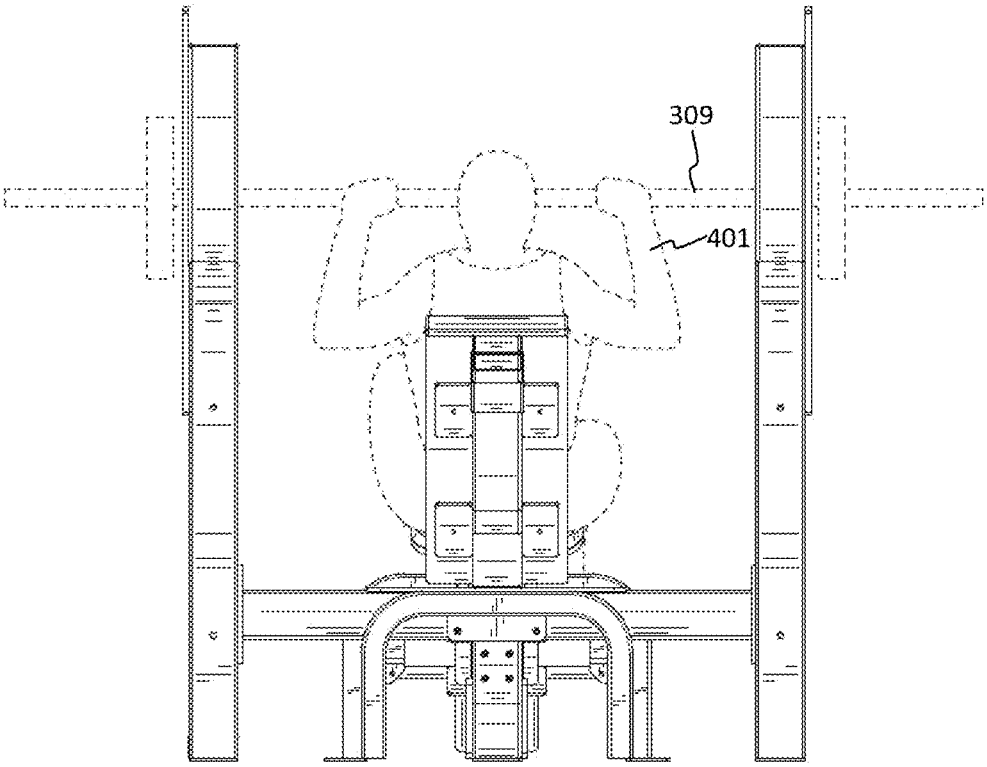
Figure 6D:
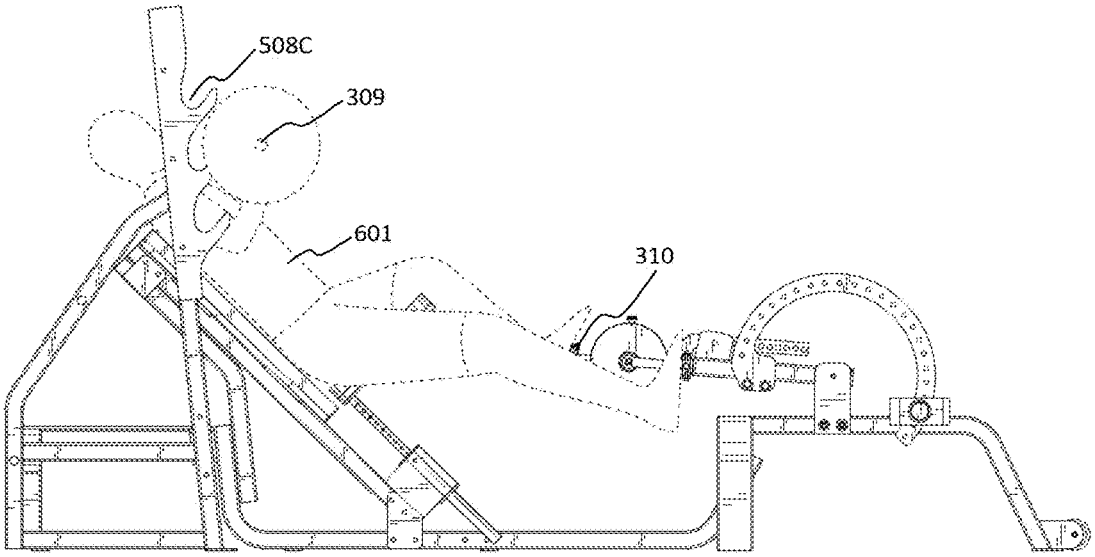
Figure 6E:
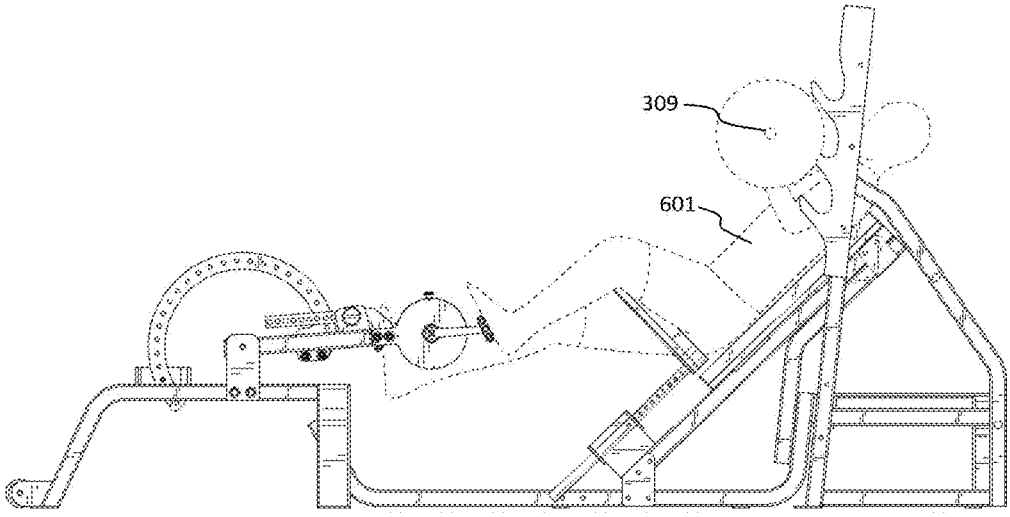
Figure 6F:
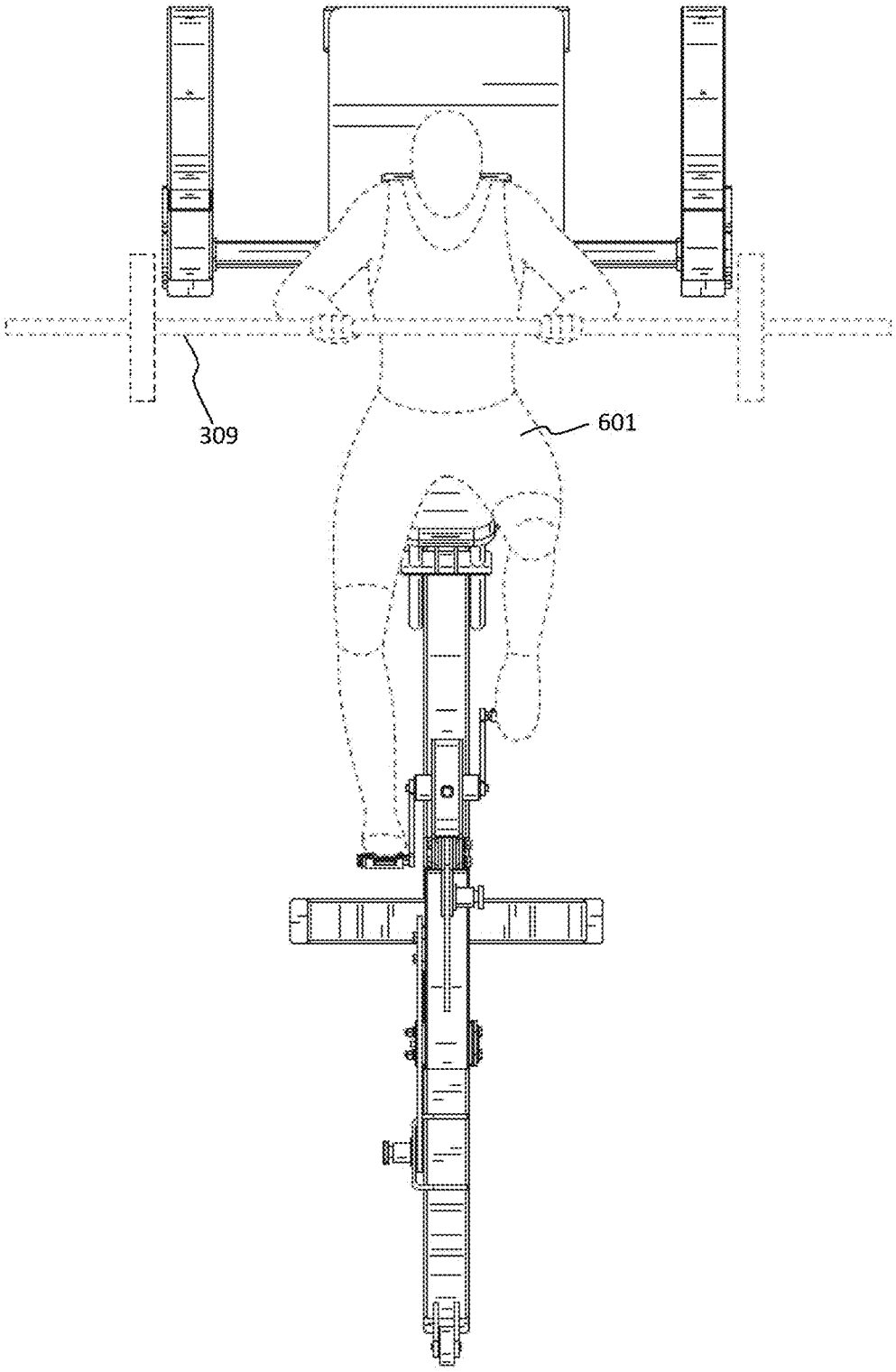
Figure 6G:
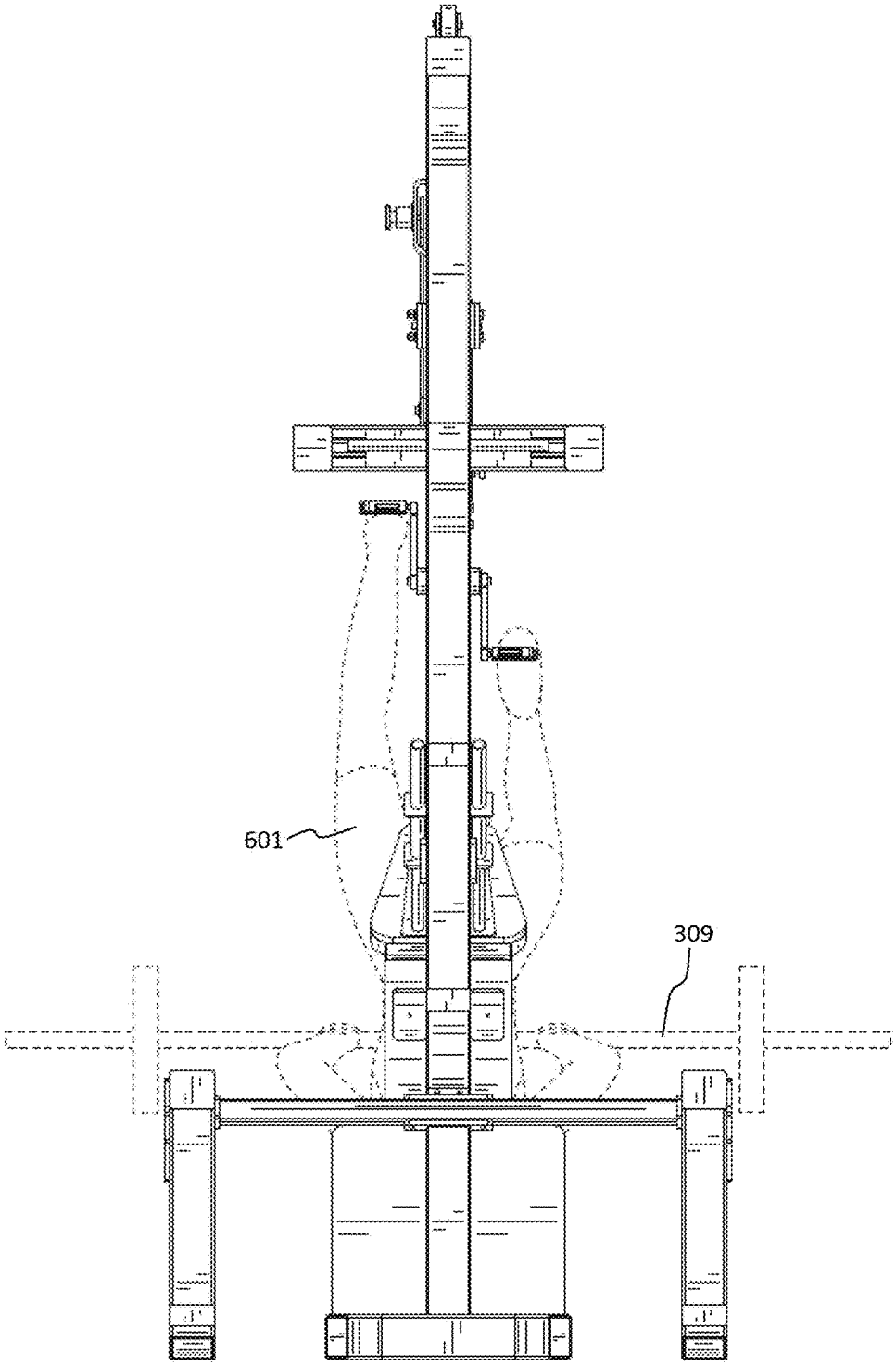
Figure 6H:
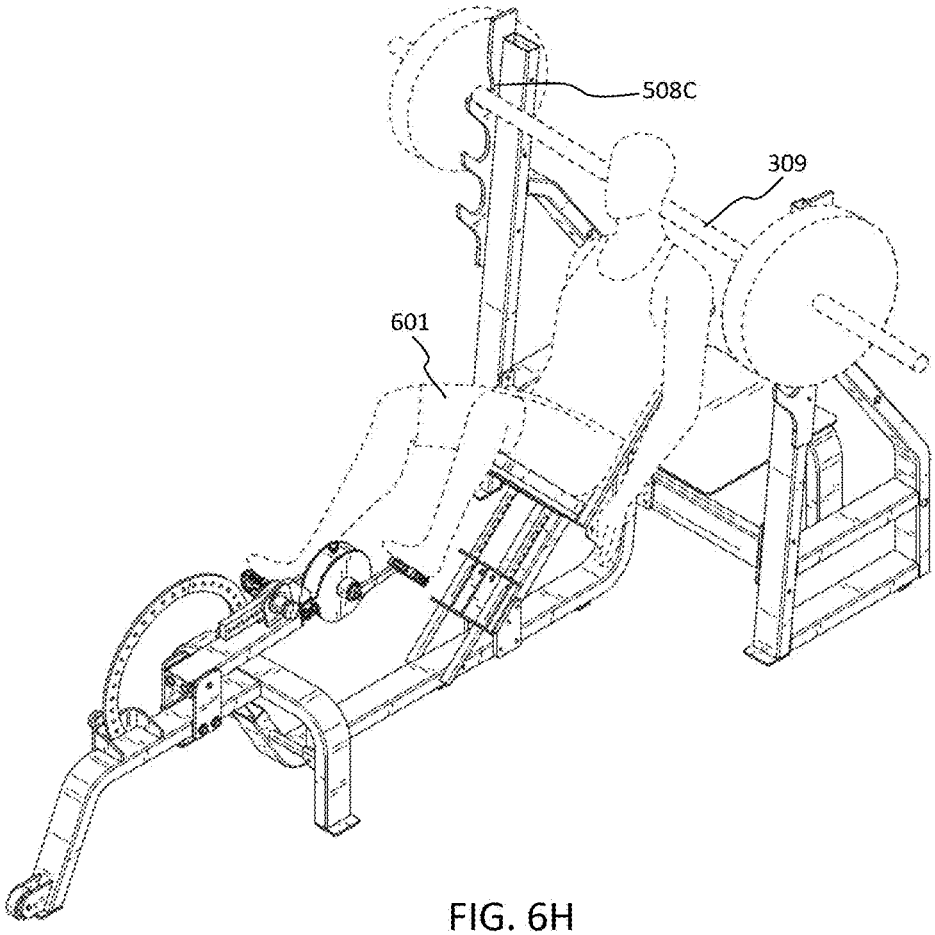
FIG. 6H is a perspective view of a user positioning the user's legs on the movable foot pedals of the apparatus of FIG. 5A before initiating the upper body, weight lifting exercise.
Figure 6I:
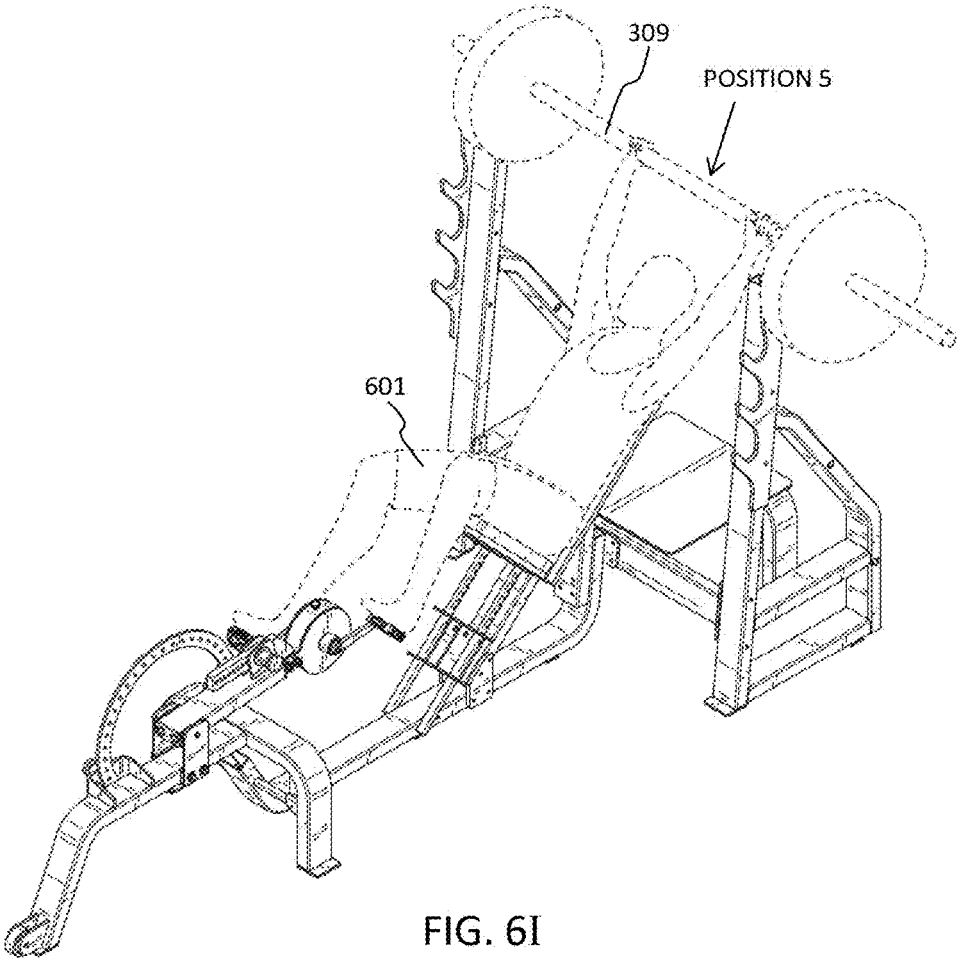
FIG. 6I is a perspective view of the user of FIG. 6H after initiating the upper body, weight lifting exercise.

FIGS. 6A to 6I illustrate how the physical exercise apparatus of FIGS. 5A to 5G is used to perform an upper body weight lifting exercise as a target exercise using the resistance load, while simultaneously performing a distraction exercise of cycling with the foot pedals 310. In FIG. 6A, user 601 is seated in seat 504, with the seat support 504*b* and adjusted to and secured in a raised position. User 601 is performing an incline press as a target exercise that preferably targets at least the user's upper pectoralis muscles (i.e., the upper portion of the pectoralis major muscles), by raising and lowering barbell 309, and is simultaneously cycling as a distraction exercise. User 601 is illustrated as being relatively short, which is why the pedals are rotated inward to a pedal position "I". Significantly, in contrast to the apparatus of FIG. 3A where the seat is not adjustable, the necessary height of seat support 504*b* along the inclined support bars 540, 541 needs to be selected from one of the rungs on the weight supports to configure seat 504 in manner that barbell 209 is comfortably accessed. Thereafter, user 601 selects the optimal positioning of the foot pedals 310 to perform a distraction exercise. Thus, for example, in FIG. 6H, user 601 sitting in the fully raised seat might find it ideal to stow the barbell 309 in the uppermost position 507C, 508C of the weight supports 507, 508. If the actual user is taller than user 601, seat support 504*b* may be lowered and/or foot pedals 310 may be repositioned to be comfortable for the taller user and the location of the foot pedals 310 in the two-dimension plane is subsequently adjusted.

FIGS. 6B to 6G are front, rear, right side, left side, top and bottom views, respectively, that show user 601 using the apparatus 500 of FIG. 6A. Although not specifically illustrated, it will be understood in view of the above discussion that, after positioning the resistance load 309, the seat 504 and pedals 310, for safety and stability reasons, user 601 should preferably position the feet on the pedals 310 first before initiating the weight lifting as a target exercise. Likewise, to safely discontinue the exercise, the user will preferably first return the resistance load to the weight supports and then remove the feet from the pedals. Also illustrated by the figures are various positions to which a user 601 moves barbell 309 while raising and lowering barbell 309 during the target exercise. Illustrated positions include holding the barbell at a neck level (e.g., FIG. 6A—position "3"), in front of the user's head (e.g., FIG. 6B—position "4"), and fully raised (e.g., FIG. 6I—position "5"). Noticeably, the user in the figures is raising the weights in a substantially even manner across the right and left sides of the body to develop the upper body muscle's evenly on both sides of the body, as facilitated by the distraction exercise.

FIGS. 7A to 7G illustrate another exemplary embodiment of an exercise apparatus 700 in accordance with the present invention. In this embodiment, a seat 704 is reclined backward at an incline of between 25 to 35 degrees, and more preferably at an incline of 29 degrees from the horizontal axis (the "29 degree seat" embodiment) relative to the ground to perform an incline press to target the upper pectoralis muscles as a target exercise. Apparatus 700 is nearly identical to apparatus 500 in the 44 degree seat embodiment, but has a seat that is positioned at a steeper backward incline. Seat 704 includes a stationary back support 704*a* and a seat support 704*b* that may be raised and lowered to a selected position along the angle of inclination. As in the earlier described embodiments, weight supports 707, 708 are provided for storing a resistance load, such as a barbell, for performing an upper body, weight lifting exercise as a target exercise, and a foot pedal assembly 309 is provided to perform cycling with the user's legs as a distraction exercise.

Figure 7A:
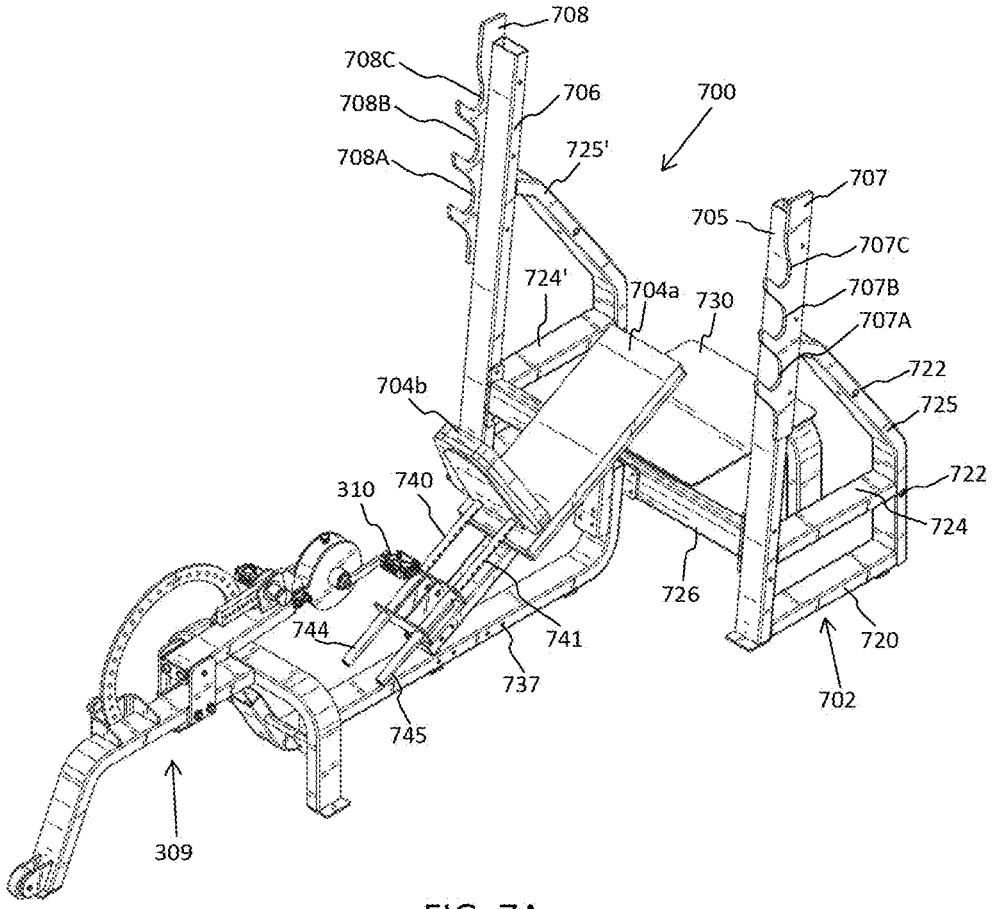
FIG. 7A is a perspective view of a physical exercise apparatus according to another exemplary embodiment of the present invention in which the apparatus has a seat that is inclined at approximately 29 degrees from the horizontal position with the movable foot pedals adjusted to a position for a user with relatively short legs.
Figure 7B:
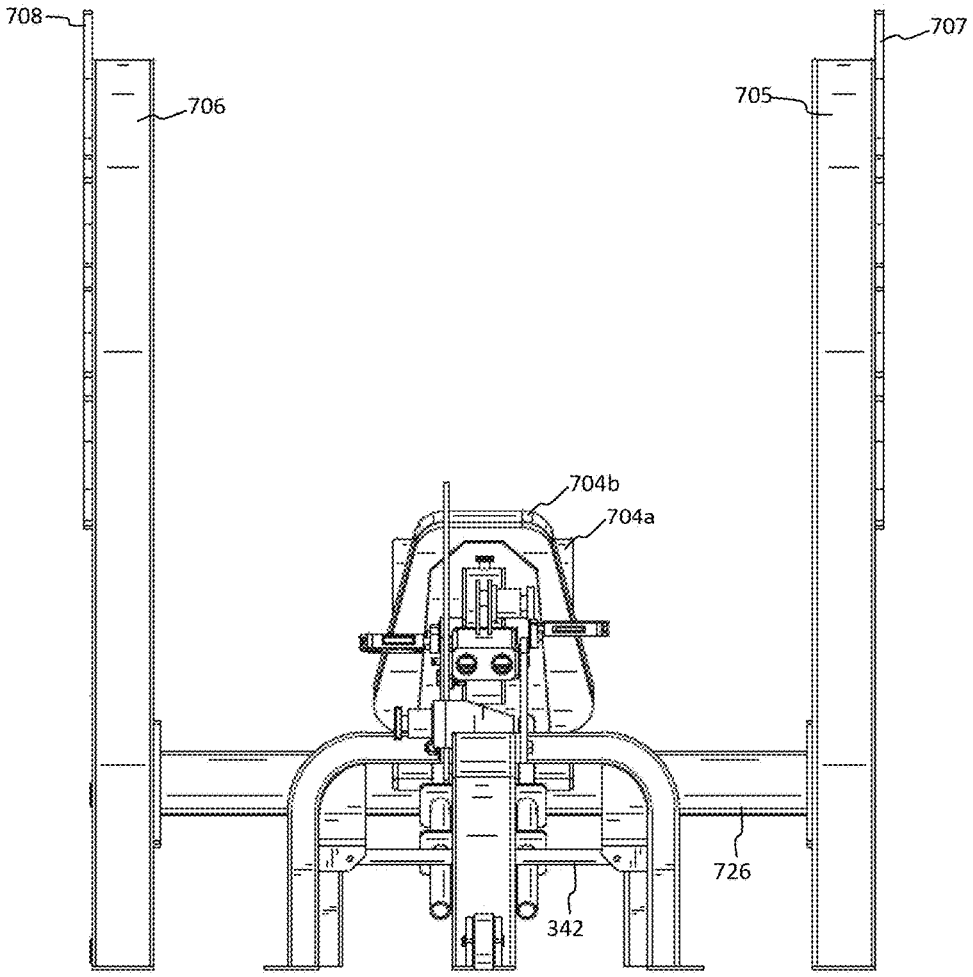
FIGS. 7B to 7G are front, rear, right side, left side, top and bottom views, respectively, of the physical exercise apparatus shown in FIG. 7A.

FIG. 7A illustrates a perspective view of the exercise apparatus 700 of this embodiment. Exercise apparatus 700 includes a frame 702, a seat 704 mounted to frame 702, weight supports 707, 708 on the frame mounted above and toward the back of seat 704, and a movable foot pedal assembly 309 that, in embodiments, is identical to foot pedal assembly 309 shown in FIG. 3A, with foot pedals 310 attached to foot pedal housing 310, for cycling as a distraction exercise.

Frame 702 is shown with side frame portions, which may be identical to the side frames shown in FIG. 5A. The left side of frame includes a horizontal frame component 720 at the ground level, two vertical frame components 705 and 725 positioned at the front and back of the side frame, respectively, and another horizontal frame component 724 that connects vertical frame components 705 and 725 positioned above horizontal frame component 720. The right side frame has a similar construction, with horizontal frame component 720' at approximately the ground level, vertical frame components 706 and 725' positioned at the front and back of the side frame, respectively, and another horizontal frame component 724' that connects vertical frame components 706 and 725'. An upper section of each of vertical frame components 725, 725' is angled forward at one or more bends to connect to vertical frame components 705, 706, respectively. Vertical frame components 705, 706 may be inclined backwards at an angle of approximately 6 degrees from the vertical position to account for the incline of seat 704. The right and left side frames are joined with crossbar 726.

Figure 7C:
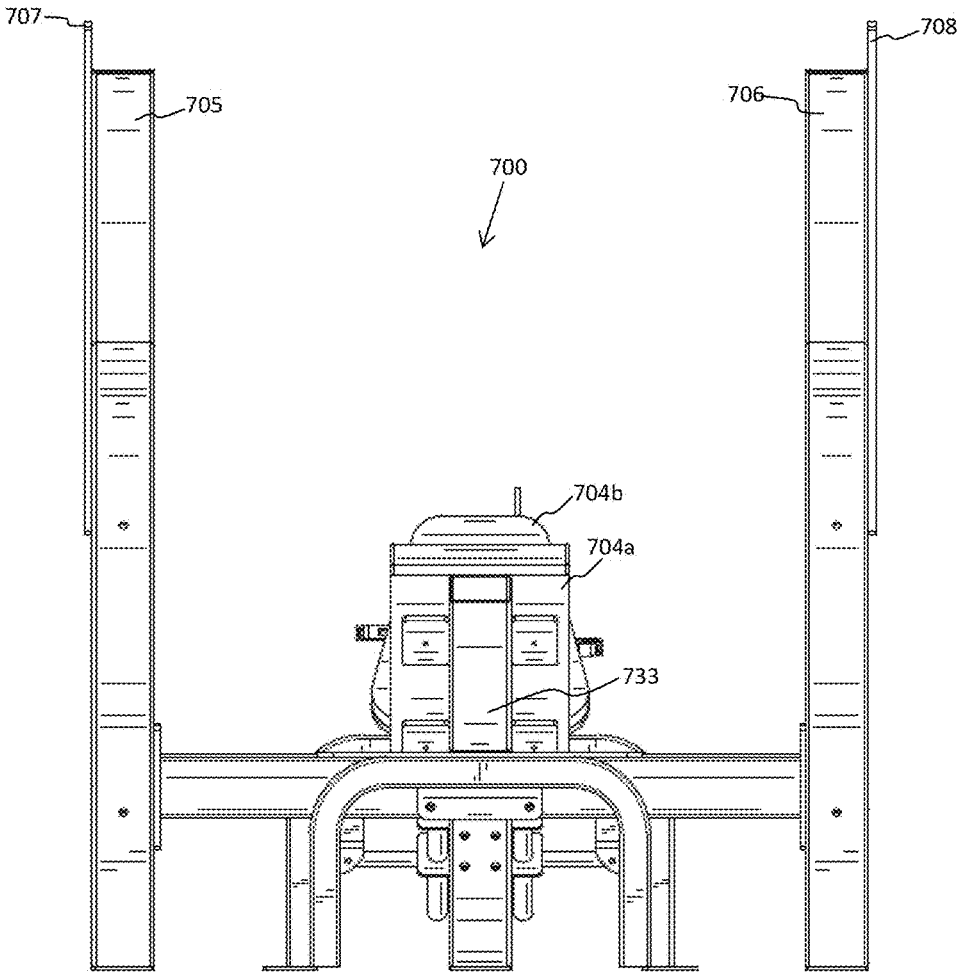
Figure 7D:
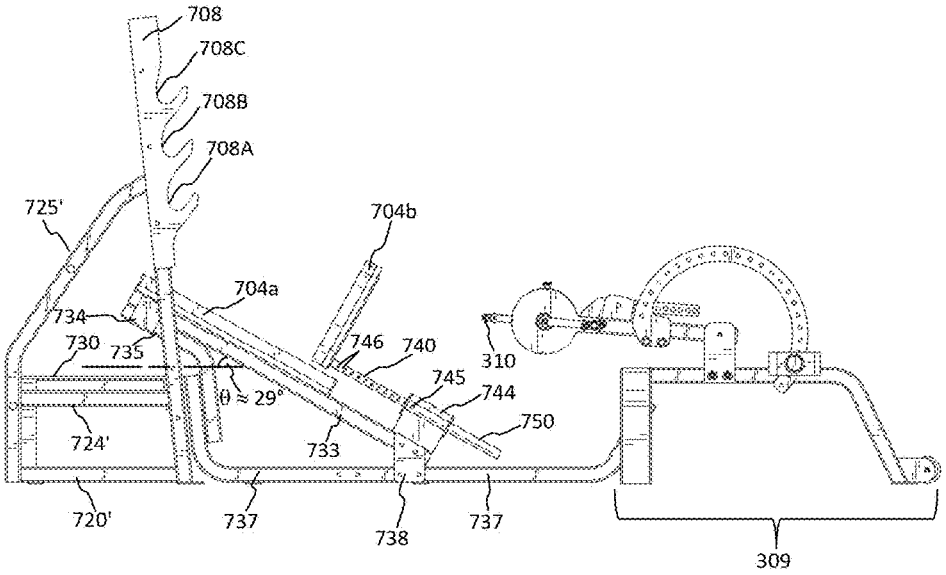
Figure 7E:
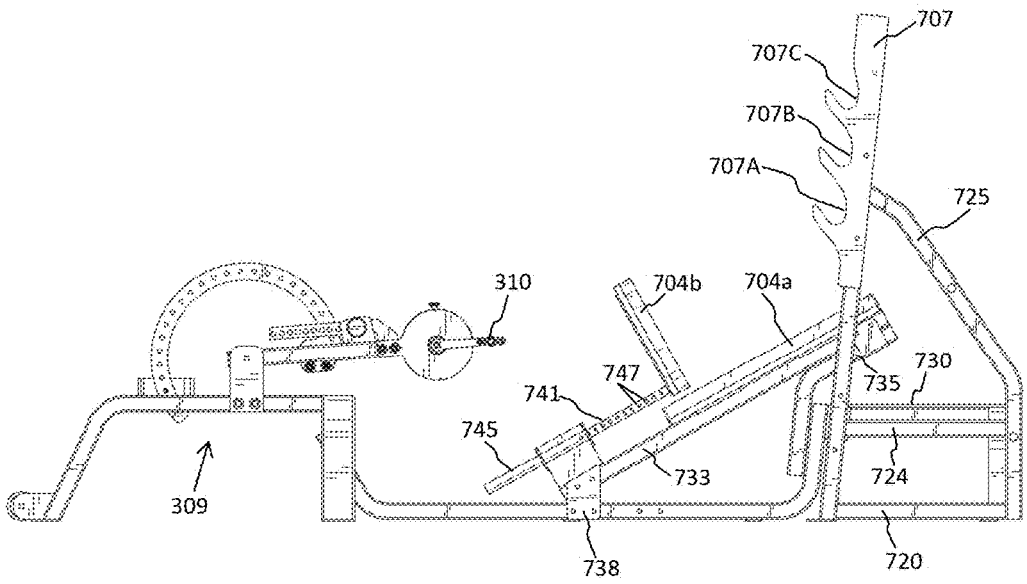
Figure 7F:
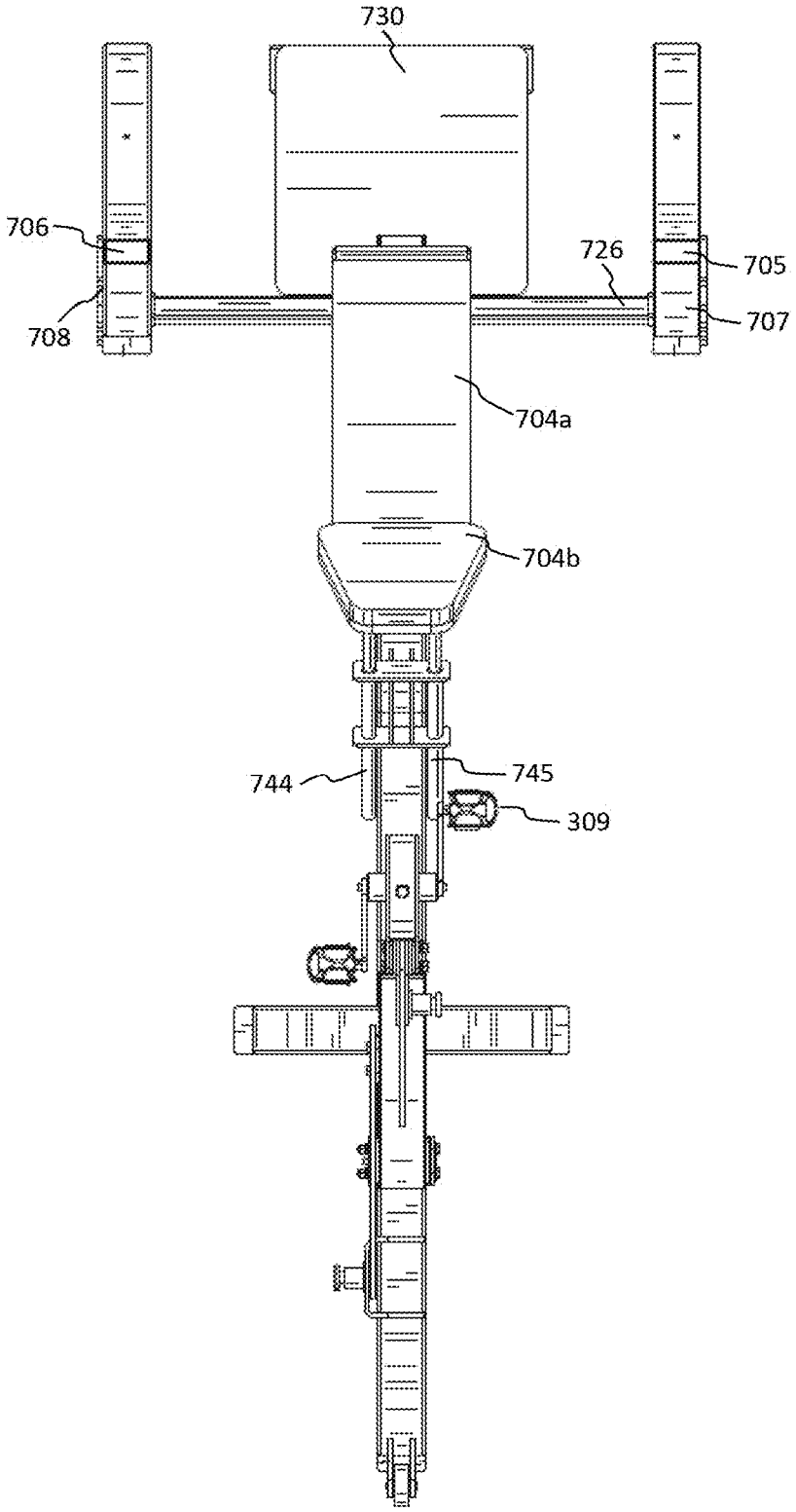
Figure 7G:
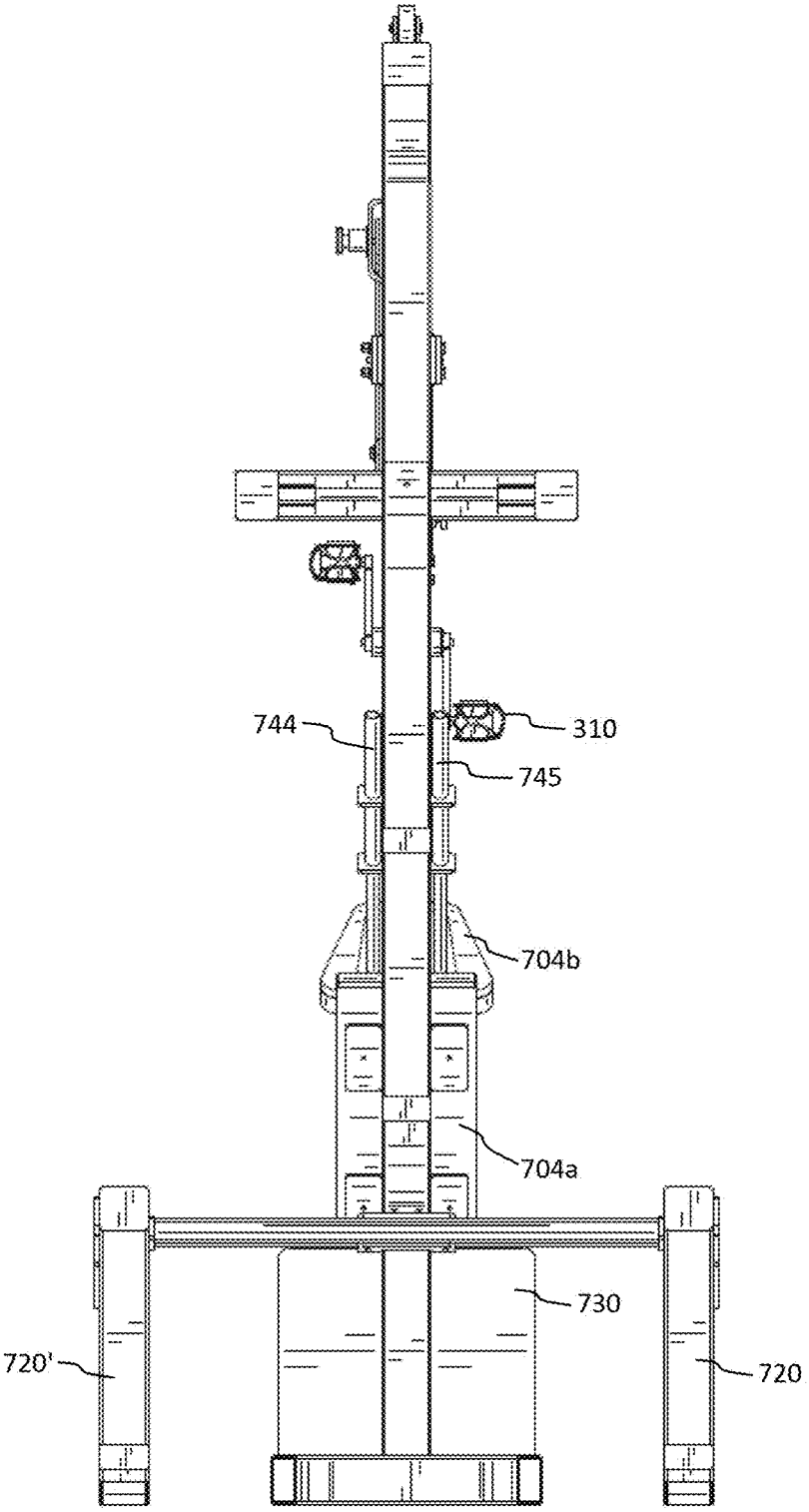

A frame portion 737 extends laterally below seat 704 and forward to connect to foot pedal assembly 309. Frame portion 737 is also connected to crossbar 726 at 727. As shown in FIGS. 7C and 7D, seat back support 704*a* is supported with an inclined support bar 733 that is mounted with a bracket 734 to the top of an elbow-shaped support element 735, and is mounted with a bracket 738 to frame portion 737 at the ground level. Support element 735 is further connected toward the back of frame portion 737. Thus, seat back support 504*a* is nonadjustable. However, the height of seat support 704*b* along the backward incline is adjustable via an attachment to two adjustment rods 740, 741 under seat support 704*b* that can be moved up and down at an approximately 44 degree incline within respective right and left tubular sleeves 744, 745 that are connected to the bottom of inclined support bar 733. The height adjustment of seat support 704*b* is based at least in part on an arm length of the user to provide the user with the access to the resistance load. Rods 740, 741 have respective sets of multiple slots 746, 747 spaced from one another along the rods so that the seat support 704*b* can be releasably secured into a location using, for example, a pin 745 inserted through holes in sleeves 744, 745 and slots 746, 747.

As an option, a platform 730 may be installed behind seat 704 and mounted above one or more support elements 731. Platform 730 may be used, for example, by a spotter to be positioned near the user of the apparatus 700, as a precaution.

Apparatus 700 is also shown with slots 722 on the sides of side frame portions 702*a*, 702*b* into which optional weight holding bars/pegs (not shown) may inserted to hold weight plates for barbell 309.

Weight supports 707, 708 are provided with frame 702 to store a resistance load, such as a weight like a barbell, dumbbell, kettlebell or other free weight, to be used for performing a target exercise for exercising a user's upper body. In the illustrated embodiment, supports 707, 708, which are mounted to respective left and right side frames, provide a choice of multiple vertical positions in which a weight may be stored when not in use. For example, a barbell 309 may be stored in a lowest position 707A, 708A, a middle position 707B, 708B, or a top position 707C, 708C of weight supports 707, 708. The weights are for exercising the user's upper body as a target exercise.

The movable foot pedal assembly 309 is provided for performing a cycling motion with a user's legs on foot pedals 310 as a distraction exercise simultaneously with the target upper body, weight lifting exercise. In embodiments, foot pedal assembly 309 is identical to foot pedal assembly 309 shown in the embodiment of FIGS. 3A to 3I. Thus, the above description of foot pedal assembly 309 applies to exercise apparatus 700 as well. Foot pedals 310 are rotationally and linearly adjustable by the user and the resistance is user adjustable as described above.

Typical adjustments of movable foot pedals 310 and seat support 704*b* on apparatus 700 for a user who is 4 feet tall has foot pedals 310 rotated downward approximately minus 5 degrees relative to the horizontal axis and fully extended toward the user, and the seat support 704*b* adjusted to its highest position. This may leave the outermost foot pedal 310 in a range of between 10 to 15 inches, or more preferably 12 inches, below the bottom of seat support 504*b* and in a range of between 8.5 to 9 inches, and more preferably 8.9 inches, from the front edge of seat support 704*b*. The lowest part of seat support 704*b* may be between 16 to 17 inches, or more preferably 16.3 inches, off of the ground. Typical adjustments for a 7 foot tall user has foot pedals 310 angled upward at a higher angle of between 35 to 45 degrees, or more preferably 40 degrees, from the horizontal axis, and seat support 704*b* adjusted to its lowest position. This may leave the outermost foot pedal 310 between 4 to 6 inches, or more preferably 5 inches, below the bottom of the inclined seat support 504*b* and between 18 to 20 inches, or more preferably 18.9 inches, from the front edge of inclined seat support 504*b*. In this embodiment, the lowest part of seat support 704*b* may be between 10-12 inches, or more preferably 10.9 inches, off of the ground.

Figure 8A:
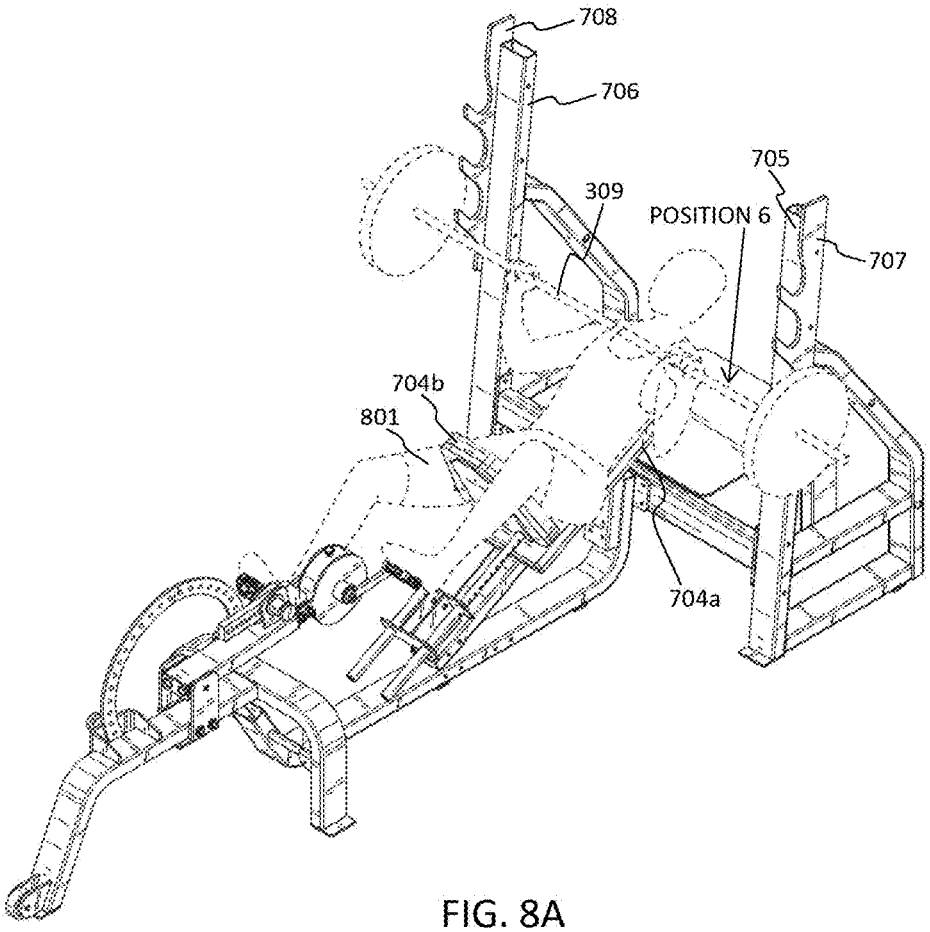
FIG. 8A is a perspective view showing a user using the physical exercise apparatus of FIG. 7A.
Figure 8B:
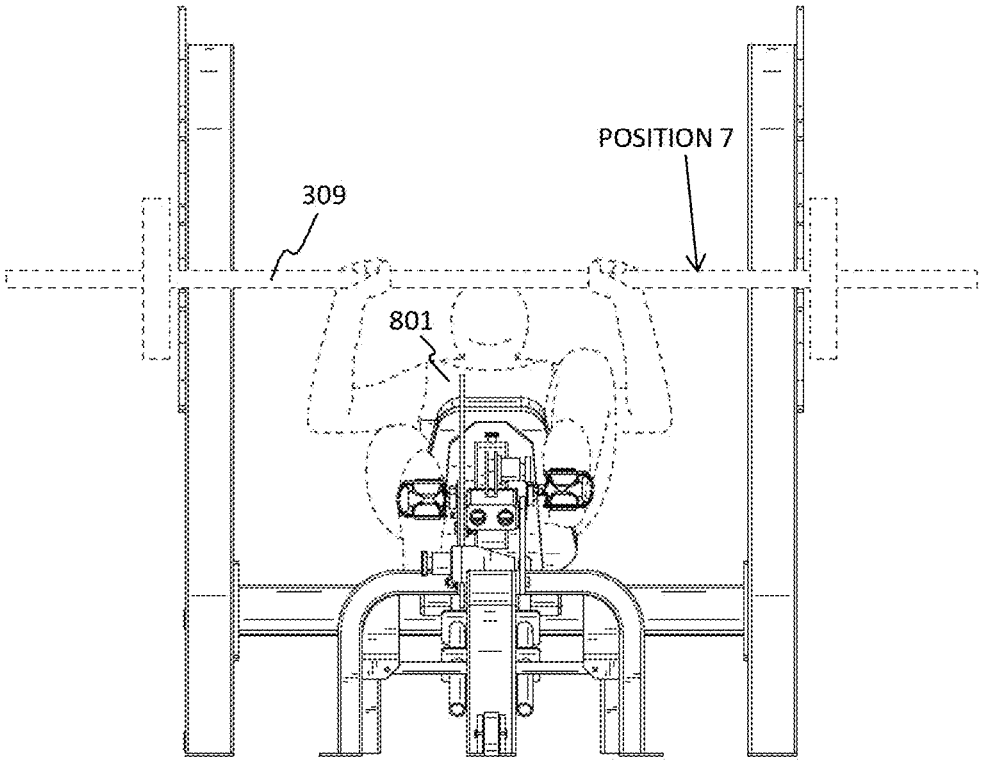
FIGS. 8B to 8G are front, rear, right side, left side, top and bottom views, respectively, that show the user using the apparatus shown in FIG. 7A.
Figure 8C:
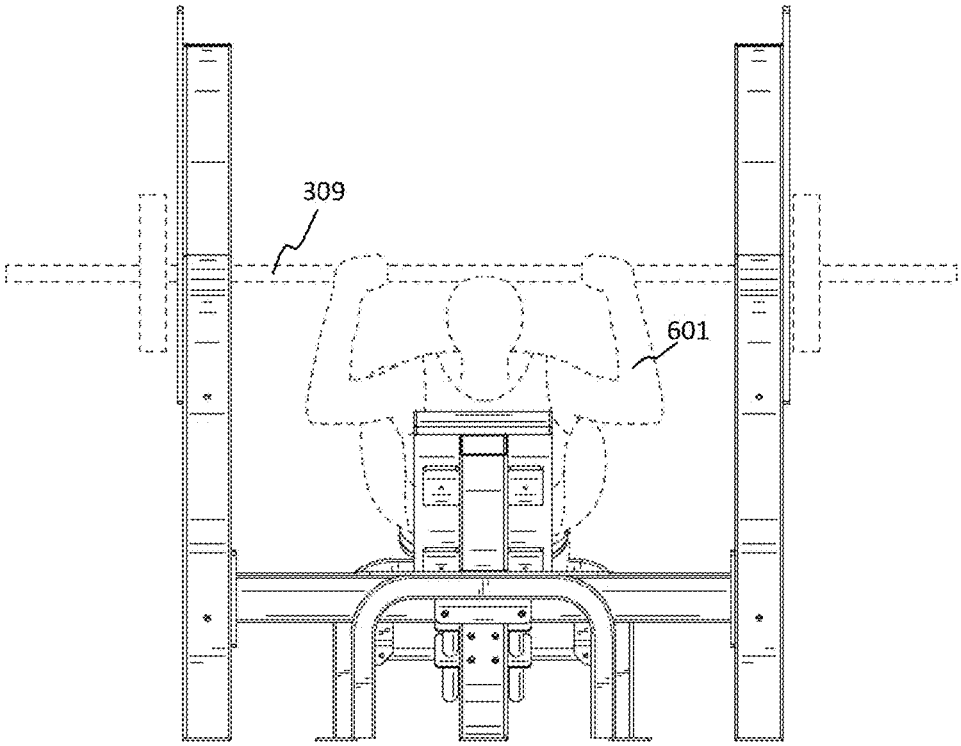
Figure 8D:
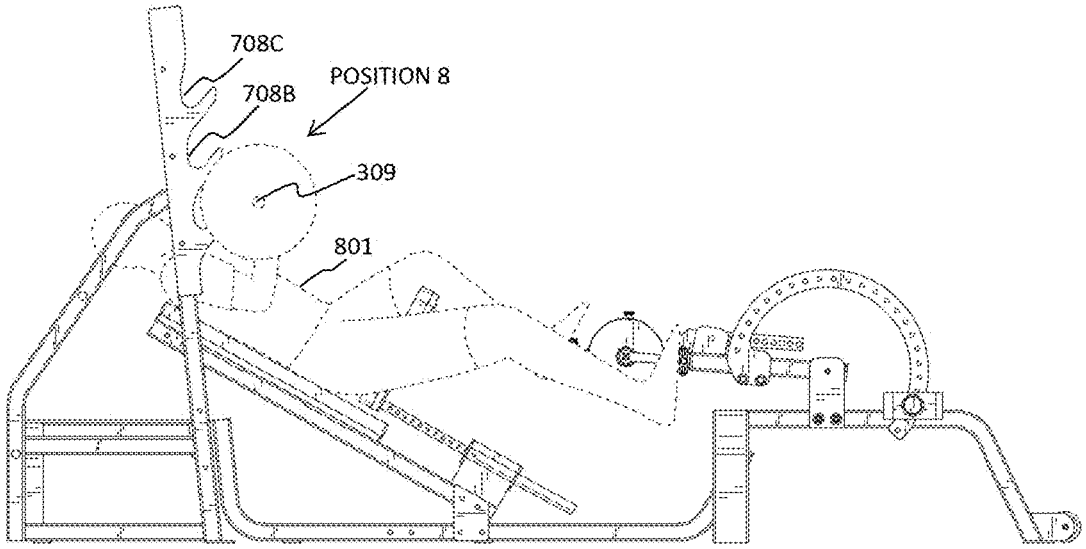
Figure 8E:
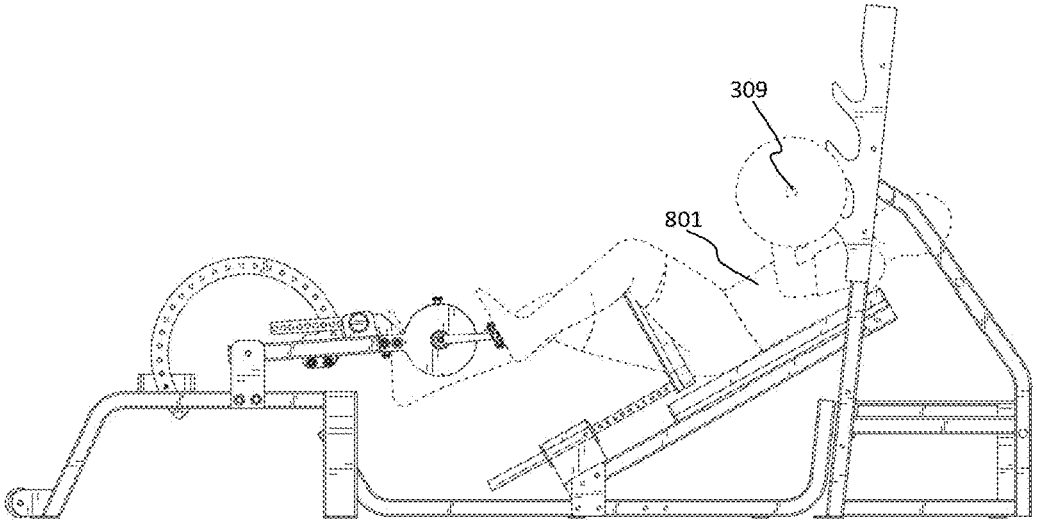
Figure 8F:
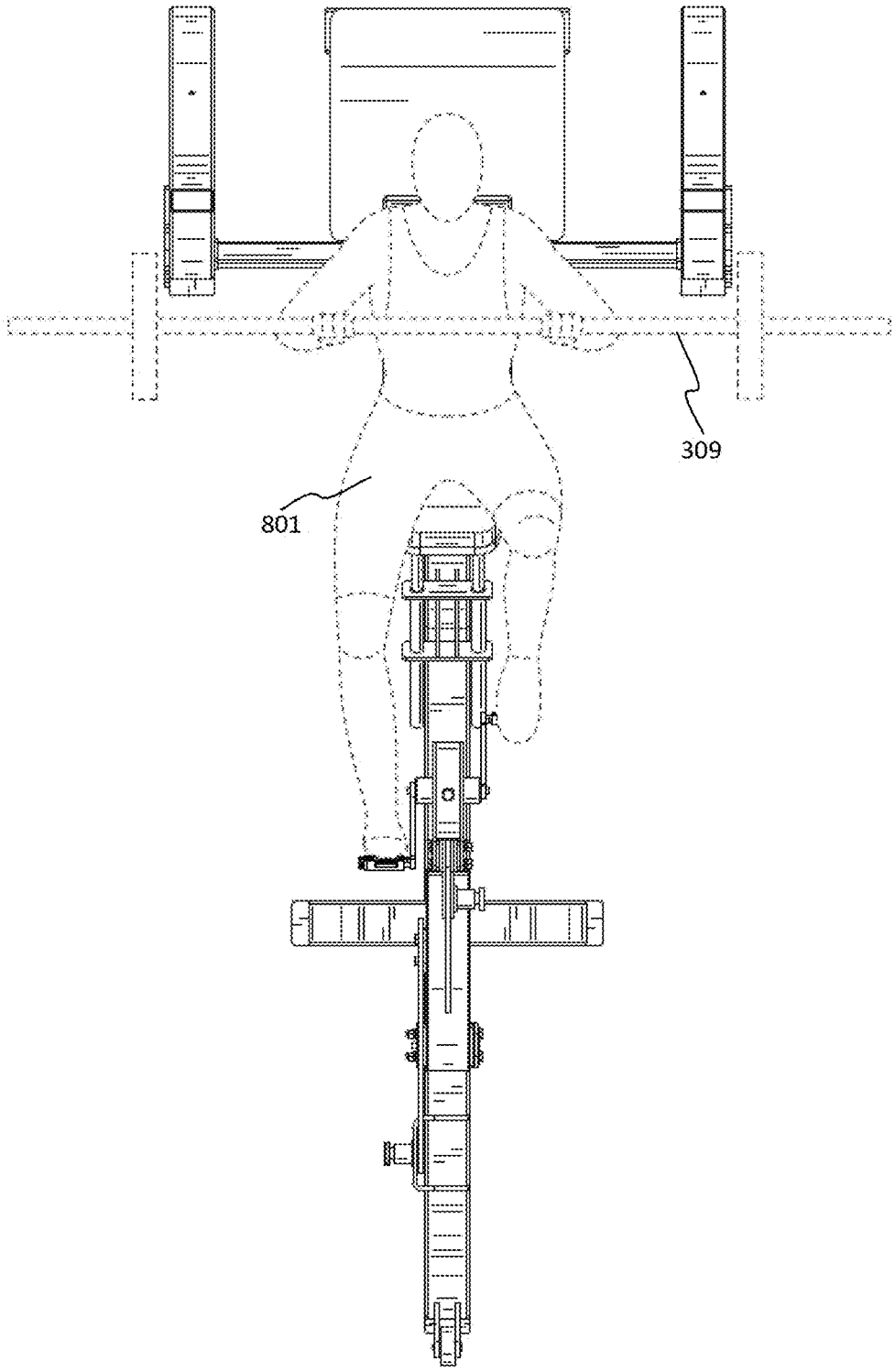
Figure 8G:
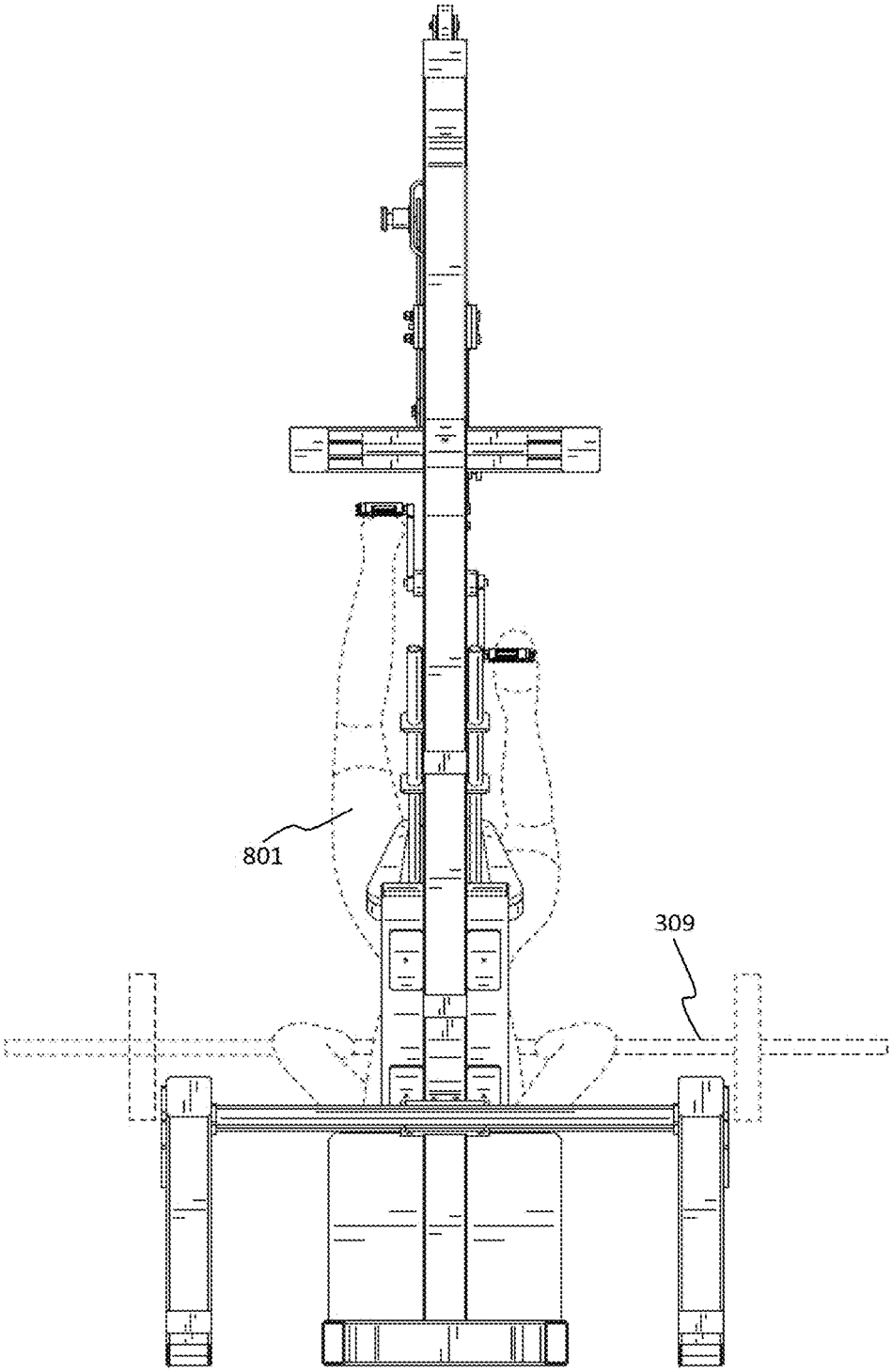
Figure 8H:
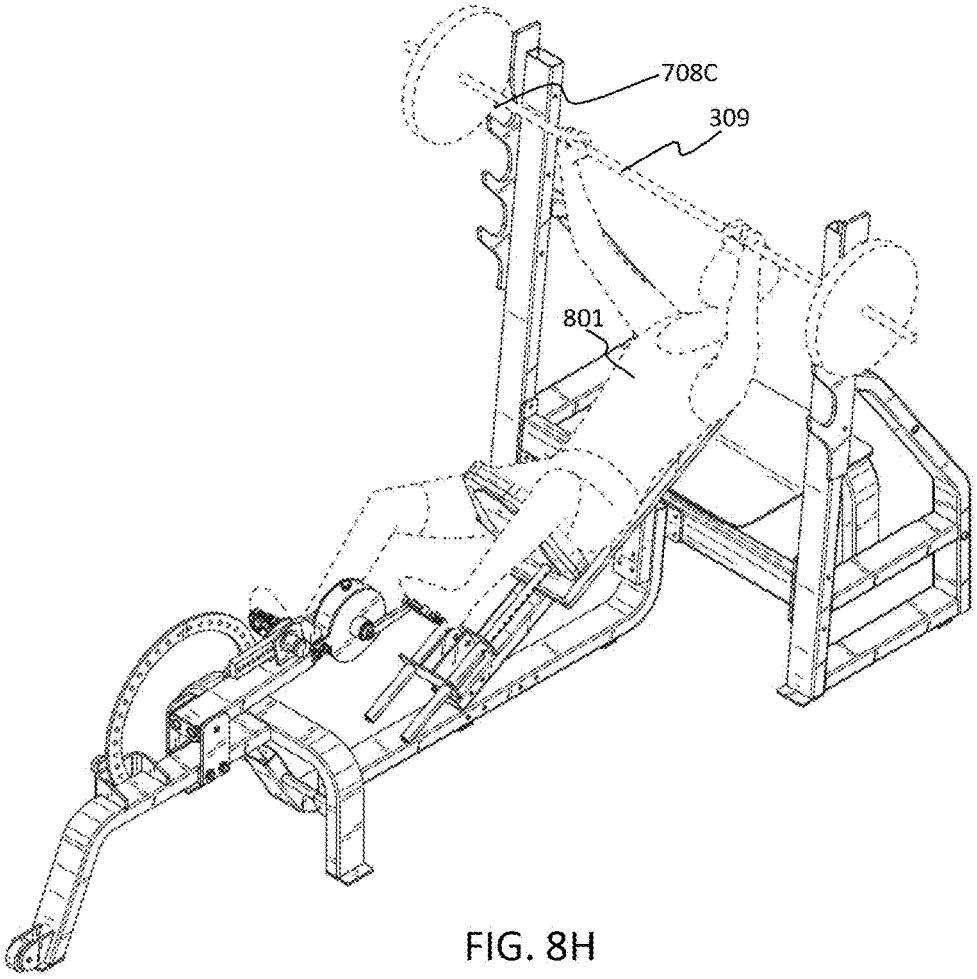
FIG. 8H is a perspective view of a user positioning the user's legs on the movable foot pedals of the apparatus of FIG. 7A before initiating the upper body, weight lifting exercise.
Figure 8I:
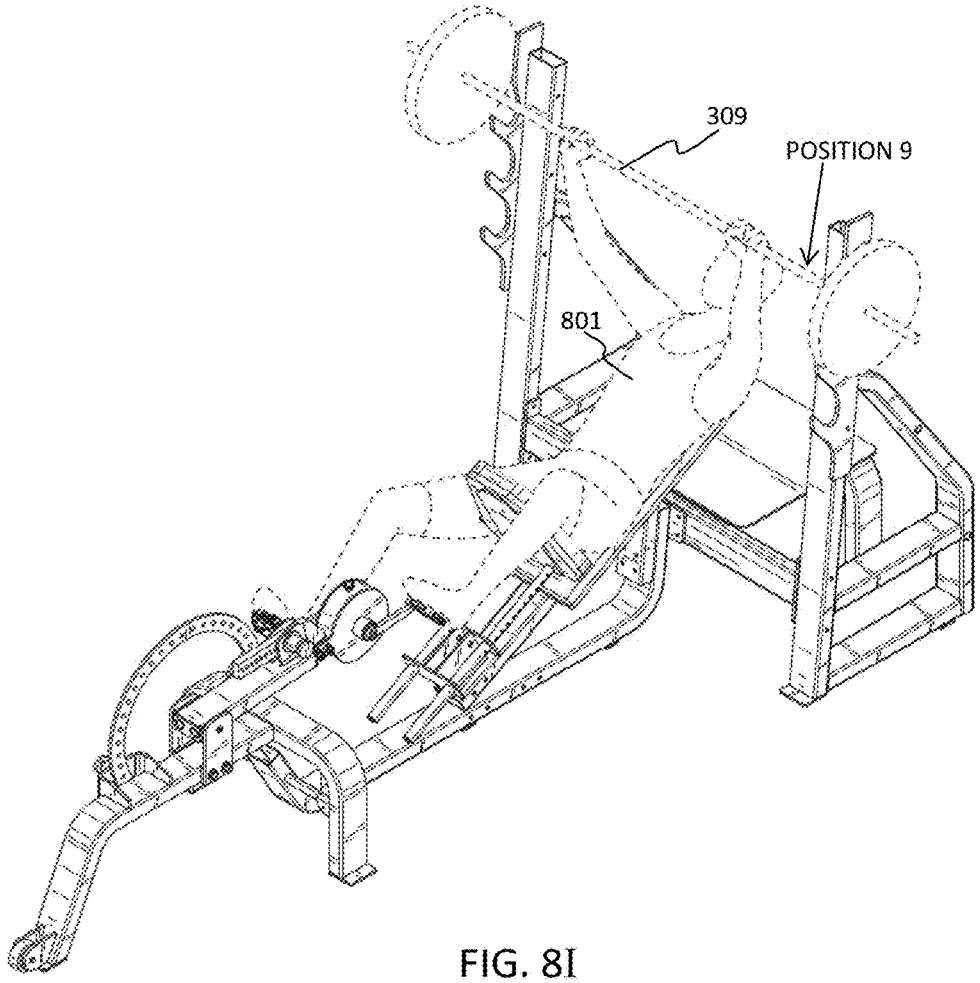
FIG. 8I is a perspective view of the user of FIG. 7H after initiating the upper body, weight lifting exercise.

FIGS. 8A to 8I illustrate how the physical exercise apparatus of FIGS. 7A to 7G may be used by a user 801 to perform an upper body weight lifting exercise as a target exercise using the resistance load, such as a barbell, while simultaneously performing a distraction exercise of cycling with the foot pedals 310. In FIG. 8A, user 801 is seated in seat 704, with the seat support 504*b* releasably secured in a raised position. User 801 is shown performing a shoulder press as a target exercise that preferably targets at least the user's upper pectoralis muscles, by raising and lowering barbell 309, while simultaneously cycling as a distraction exercise. User 801 is illustrated as being relatively short, which is why the pedals are rotated inward to a position "I" for cycling.

As with apparatus 500 of FIG. 5A, the selected position of seat support 704*b* along the inclined support bars 540, 541 may impact the optimal positioning of the foot pedals 310 to perform a distraction exercise and the rungs in which the user should optimally stow barbell 309 before initiating the target exercise (for reasons of best workout of muscles, comfort, and safety). Thus, for example, in FIG. 8H, a relatively short user 801 sitting in the fully raised seat might find it ideal to stow the barbell 309 in the uppermost position 707C, 708C of the weight supports 707, 708. If the user is taller than user 801, seat support 704*b* may be lowered and/or foot pedals 310 may be repositioned to provide additional clearance for longer arms and additional leg room.

FIGS. 8B to 8G are front, rear, right side, left side, top and bottom views, respectively, that show the user 801 using the apparatus 700 as shown in FIG. 8A. Although not specifically illustrated, it is understood that, after positioning the resistance load 309, the seat 704 and pedals 310, for safety and stability reasons, user 801 should preferably position the feet on the pedals 310 first before initiating the weight lifting as a target exercise. Likewise, to safely discontinue the exercise, the user will preferably first return the resistance load to the weight supports and then remove the feet from the pedals. Also illustrated by the figures are various positions through a barbell 309 passes when a user 601 raises and lowers barbell 309 during the target exercise, such as to a neck level (e.g., FIG. 8A—position "6"), in front of and toward the top of the user's head (e.g., FIG. 8B—position "7"), slightly raised above the neck (e.g., FIG. 8D—position "8") and fully raised (e.g., FIG. 8I—position "9"). Noticeably, the user in the figures is raising the weights in a substantially even manner across the right and left sides of the body to develop the upper body muscle's evenly on both sides of the body, as facilitated by the distraction exercise.

FIGS. 9A to 9H illustrate an exemplary embodiment of a physical exercise apparatus 900 in accordance with the present invention in which a flat bench is provided for a bench press. Apparatus 900 includes a frame 902, seat 904 mounted to frame 902, weight supports 907, 908 for storing a resistance load, such as a barbell, for a user in this case in a supine position to perform an upper body, weight lifting exercise as a target exercise to exercise the user's pectoralis muscles, and a movable foot pedal assembly 309 to simultaneously perform cycling with the user's feet as a distraction exercise.

Figure 9A:
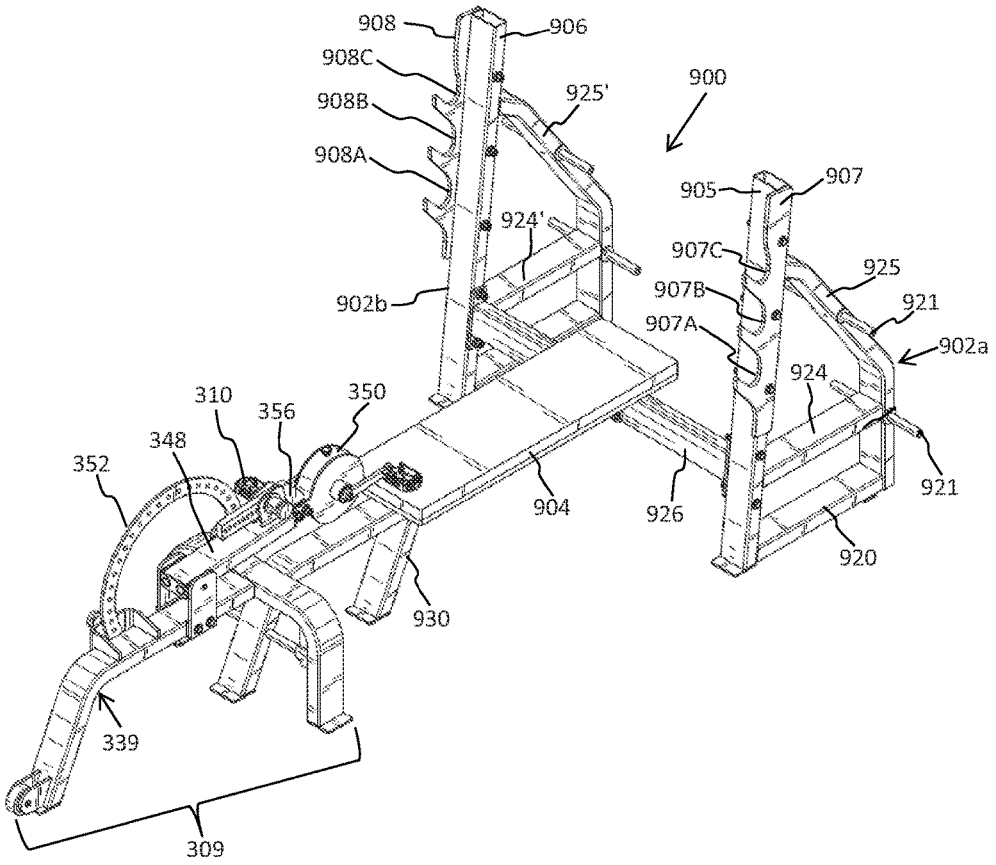
FIG. 9A is a perspective view of a physical exercise apparatus according to another exemplary embodiment of the present invention in which the apparatus has a flat bench on which a user lies in a supine position with relatively short legs positioned on the foot pedals in a first position.
Figure 9B:
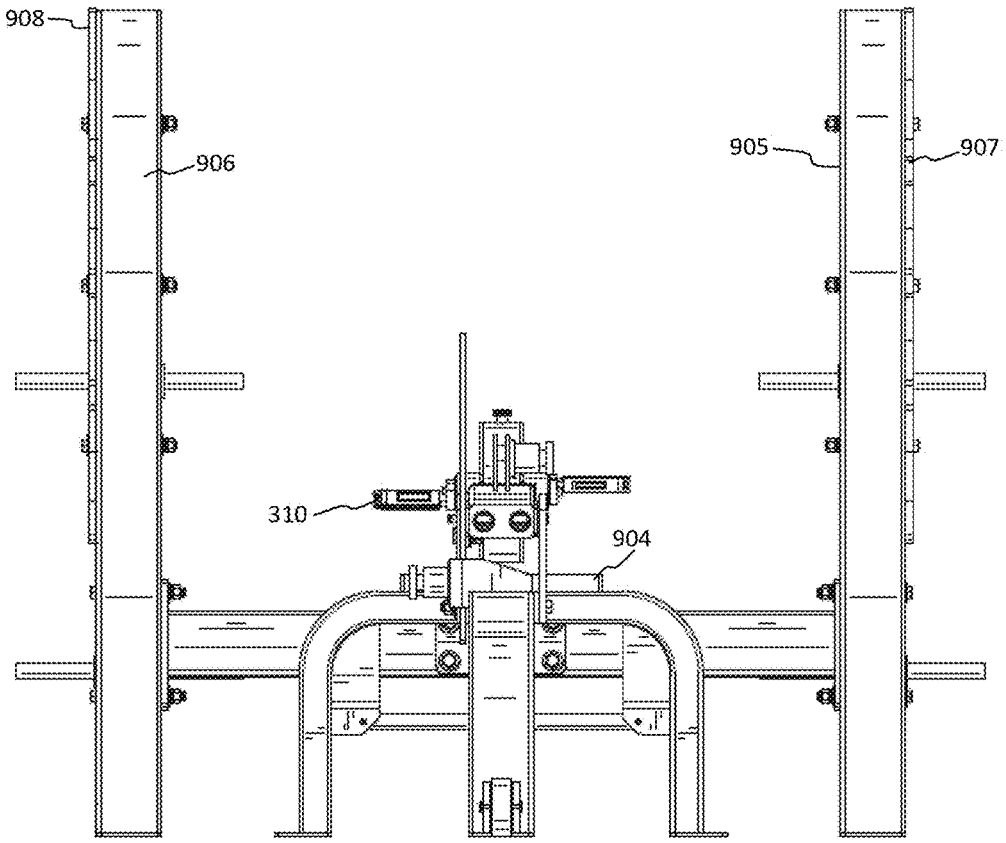
FIGS. 9B to 9G are front, rear, right side, left side, top and bottom views, respectively, of the physical exercise apparatus shown in FIG. 9A.
Figure 9C:
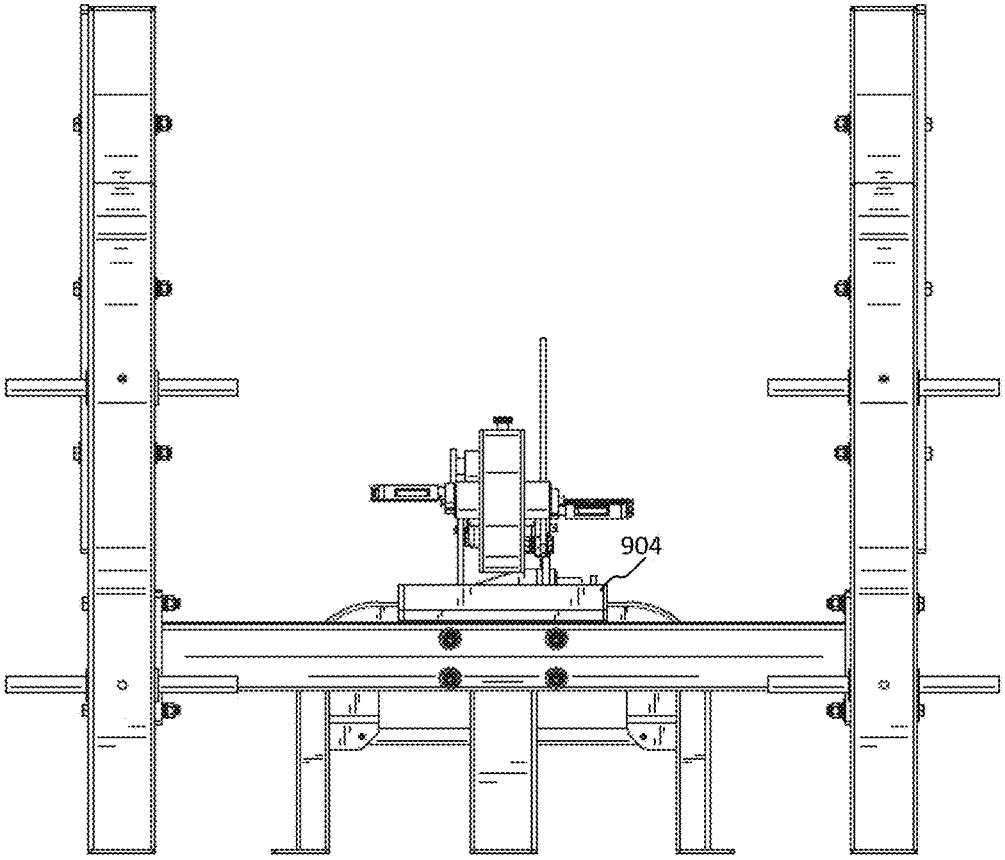
Figure 9D:
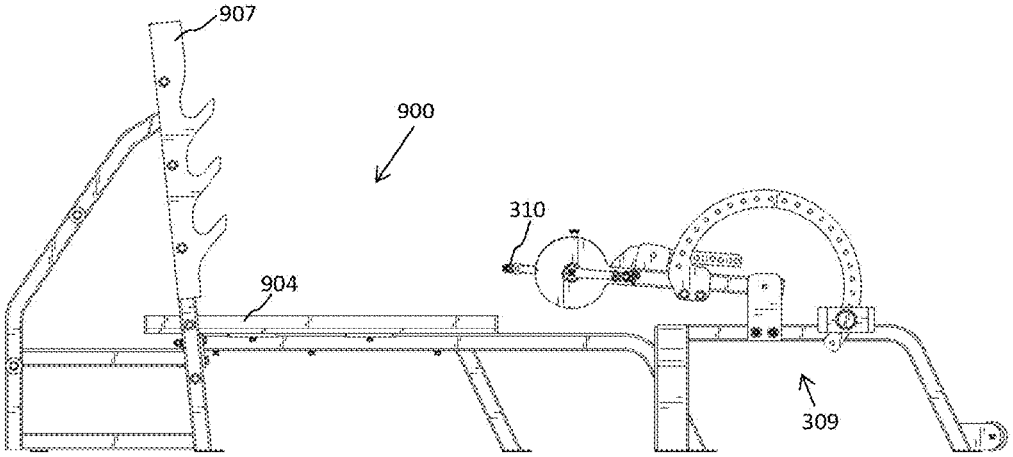
Figure 9E:
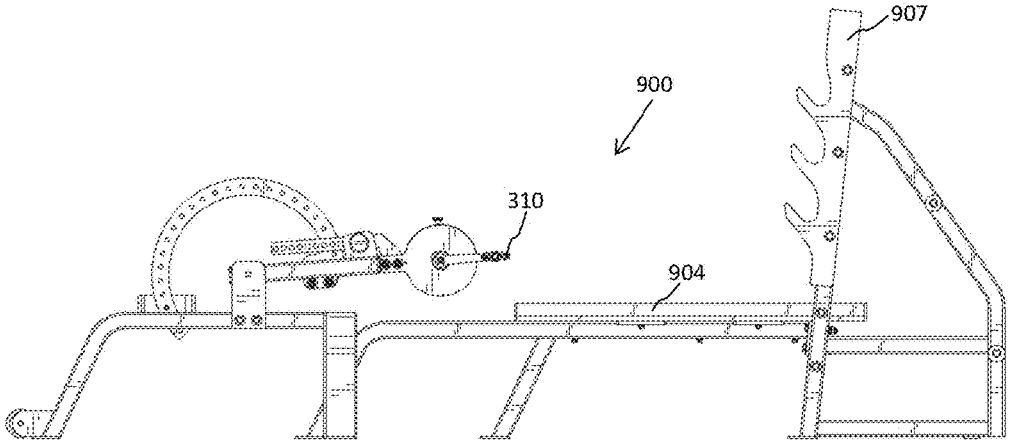
Figure 9F:
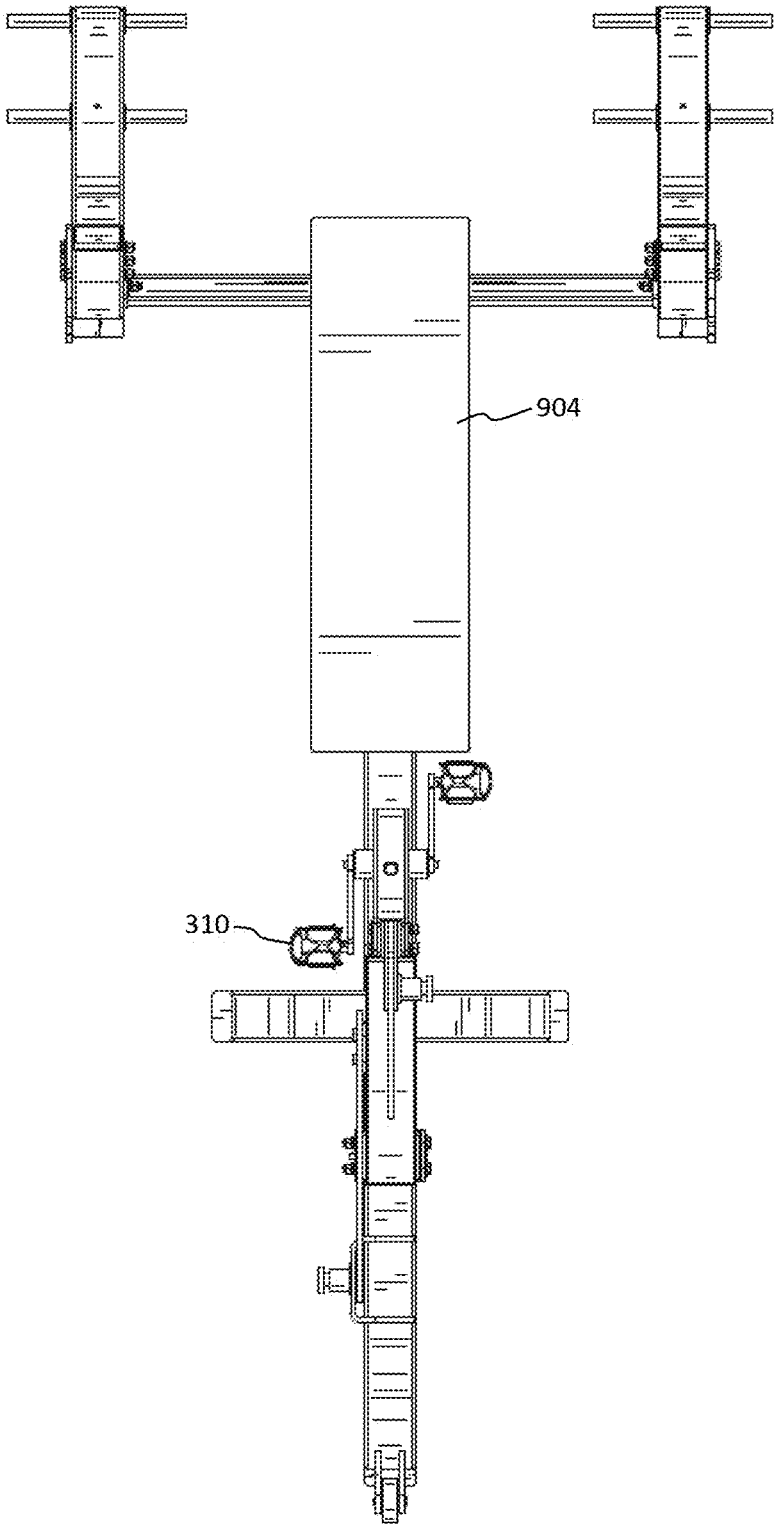
Figure 9G:
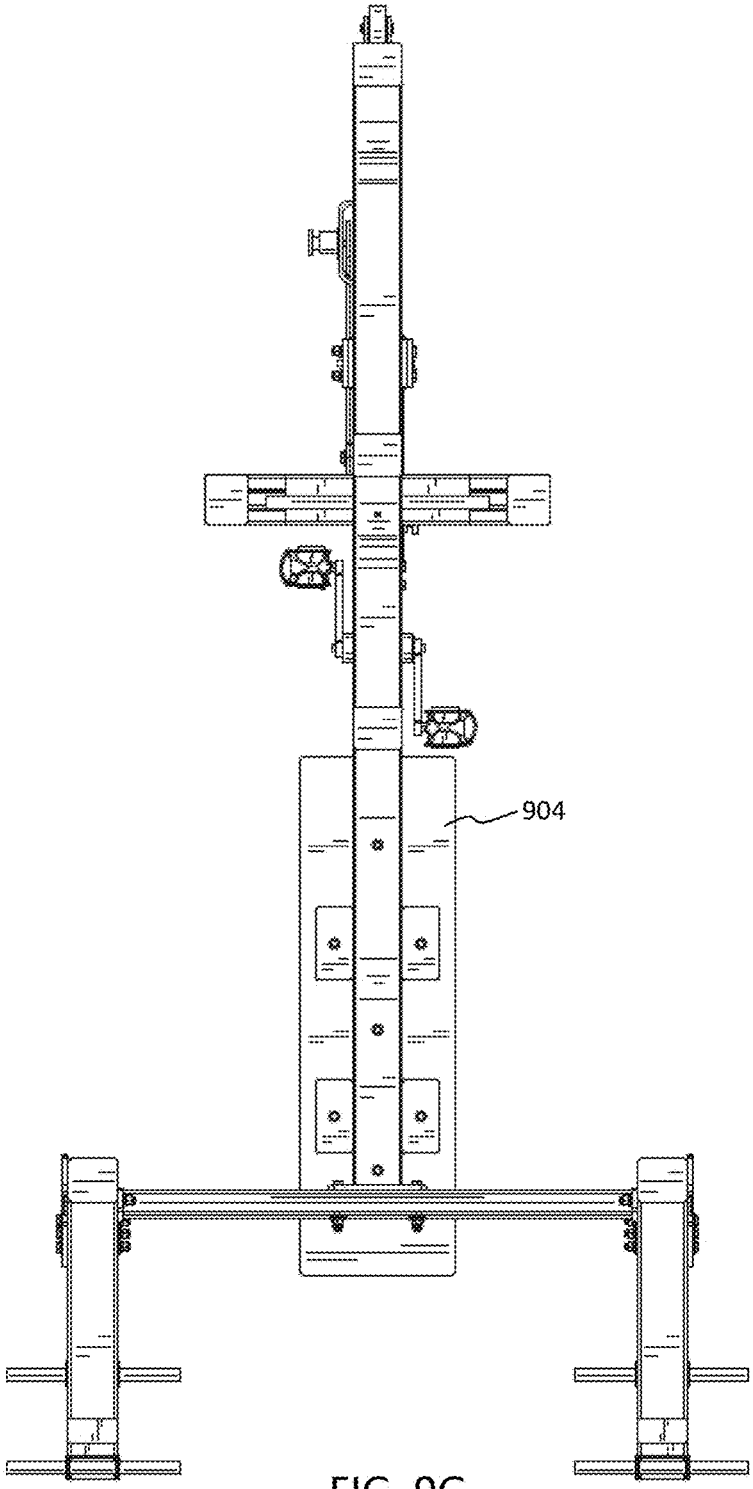

In FIG. 9A, frame 902 is shown with side frame portions 902*a*, 902*b*. The left side frame 902*a* includes a horizontal frame component 920 at the ground level, two vertical frame components 905 and 925 positioned at the front and back of the side frame, respectively, and another horizontal frame component 924 that connects vertical frame components 905 and 925 positioned above horizontal frame component 920. The right side frame 902*b* has a similar construction, with horizontal frame component 920' at approximately the ground level, vertical frame components 906 and 925' positioned at the front and back of the side frame, respectively, and another horizontal frame component 924' that connects vertical frame components 906 and 925'. An upper section of each of vertical frame components 925, 925' is angled forward at one or more bends to connect to vertical frame components 905, 906, respectively. Vertical frame components 905, 906 may be inclined backwards at an angle of between 5 and 7 degrees, or more preferably at an angle of 6 degrees, from a vertical axis. The right and left side frames are joined with crossbar 926. One skilled in the art will understand that the frame in accordance with the invention may vary from the illustrated configuration.

Apparatus 900 is shown with optional weight holding bars/pegs 921 on the sides of side frame portions 902*a*, 902*b* on which to hold weight plates for barbell 309. Weight holding bars 921 may be omitted from this embodiment. One or more embodiments described herein may also have weight holding bars 921 added to the frame.

Bench 904 is substantially flat and is positioned approximately parallel to the ground. A frame portion 937 extends underneath seat 904 from crossbar 926 to foot pedal assembly 309 preferably supported by an additional leg 930 that is positioned approximately beneath the front of bench 904. In embodiments, the bench may be between 15 to 17 inches, or more preferably 16.3 inches, above the ground. No optional platform for spotting need be provided in this embodiment as the weight supports for a resistance load are generally positioned lower than in the embodiments of the apparatuses with seats so a spotter can stand on the ground.

Weight supports 907, 908 are provided on the sides of frame 902 to store a resistance load, such as a weight like a barbell, dumbbell, kettlebell or other free weight, to be used for performing a bench press as a target exercise for exercising a user's upper body. In the illustrated embodiment, supports 907, 908 provide a choice of multiple vertical positions in which a weight may be stored when not in use. For example, a barbell may be stored in a lowest position 907A, 908A, a middle position 907B, 908B, or a top position 907C, 908C of weight supports 907, 908. In the illustrated embodiment, pedal housing 350 is adjusted relative to the rotating pedal arm 348 via a linearly adjustable bar 357 (see FIG. 3I) that is inserted within the rotating pedal arm 348.

Figure 9H:
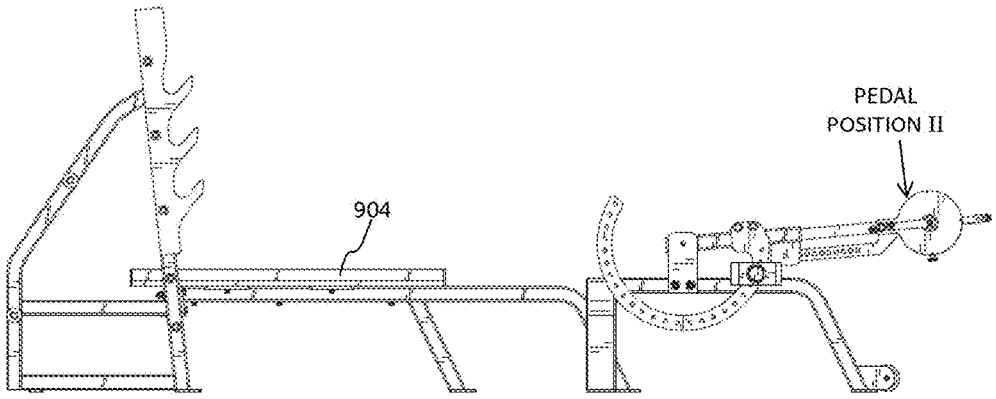
FIG. 9H is a right side view of the apparatus shown in FIGS. 9A to 9G with the movable foot pedals adjusted to a second, extended position to accommodate a user with relatively longer legs.

The movable foot pedal assembly 309, as shown in the embodiment of FIGS. 3A to 3I, is provided for performing a cycling motion with a user's feet on foot pedals 310 as a distraction exercise simultaneously with the target upper body, weight lifting exercise. FIGS. 9A to 9G show pedals 310 adjusted to a particular angular and linear position "I." FIG. 9H shows pedals 310 adjusted to a different position "II" in which the pedals are rotated completely forward and linearly adjustable bar 357 and attached bar 358 are extended fully outward for a user with longer legs. It should be understood, however, that the foot pedals 310 should be set to the individual comfort level of each individual so that the cycling motion can be performed without substantial effort. For example, an extremely tall user may find it best to raise the legs higher than in position "II".

Figure 9I:
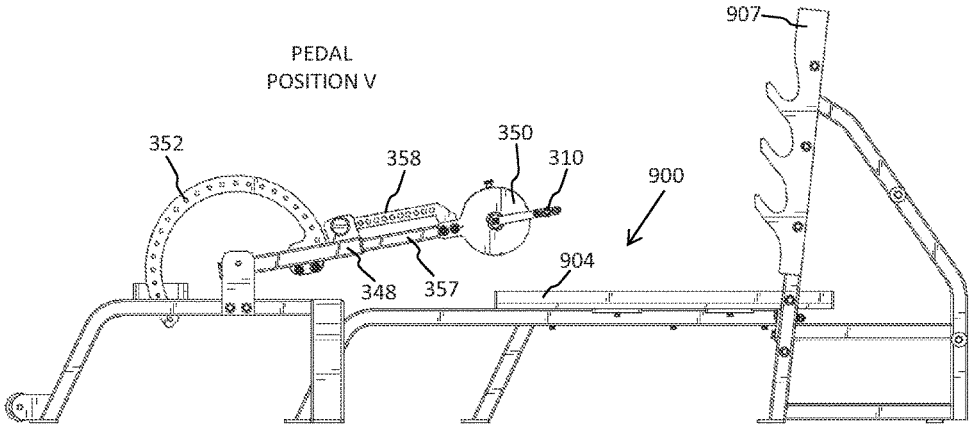
FIG. 9I is a left side view of the apparatus of FIG. 9A that shows the movable foot pedals adjusted to a fifth position.
Figure 9J:
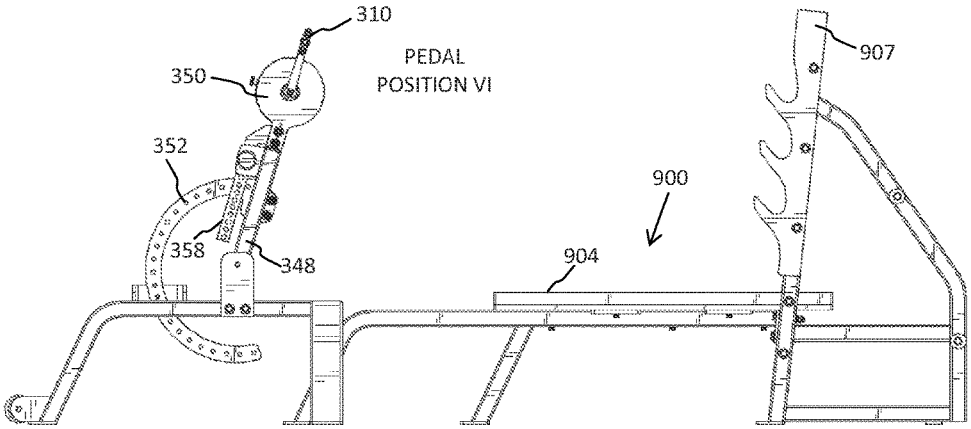
FIG. 9J is a left side view of the apparatus of FIG. 9A that shows the movable foot pedals adjusted to a sixth position.

FIGS. 9I and 9J show exemplary positions of how the movable foot pedals 310 on apparatus 900 are adjustable to accommodate the leg lengths of users. For example, a user who is 4 feet tall may find it optimal to adjust the foot pedals to the selected location, pedal position V, shown in FIG. 9I, to accommodate the user's leg length. In FIG. 9I, the foot pedals 310 are rotated upward between 5 to 15 degrees, and more preferably 10 degrees, relative to the horizontal axis and are fully extended toward the user. As another example, a user who is a different height, such as 7 feet tall, may find it optimal to adjust the foot pedals to the selected location, pedal position VI, shown in FIG. 9J. For example, in FIG. 9J, foot pedals 310 may be angled upward at a higher angle of between 70 to 80 degrees, and more preferably 75 degrees, from the horizontal axis and the linear adjustment is set to be fully retracted. Alternatively, pedals 310 may be raised higher or lower than these values as desired by a user. The pedals may be adjusted fully forward as in FIG. 9H but this distance is generally unnecessary for most users.

FIGS. 10A to 10J illustrate an example of how the physical exercise apparatus 900 may be used to by a user 1001, in the supine position on bench 904, to perform an upper body weight lifting exercise as a target exercise using the resistance load, such as a barbell, while simultaneously performing a distraction exercise of cycling with the foot pedals 310.

Figure 10A:
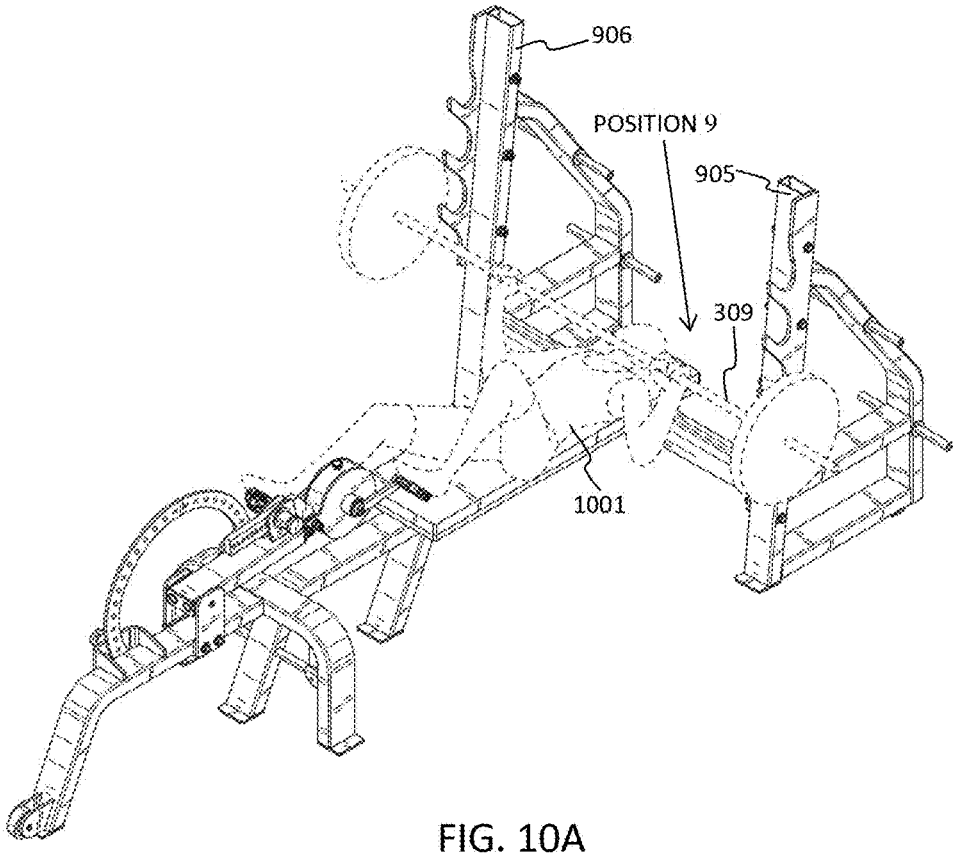
FIG. 10A is a perspective view showing a user using the physical exercise apparatus of FIG. 9A.
Figure 10B:
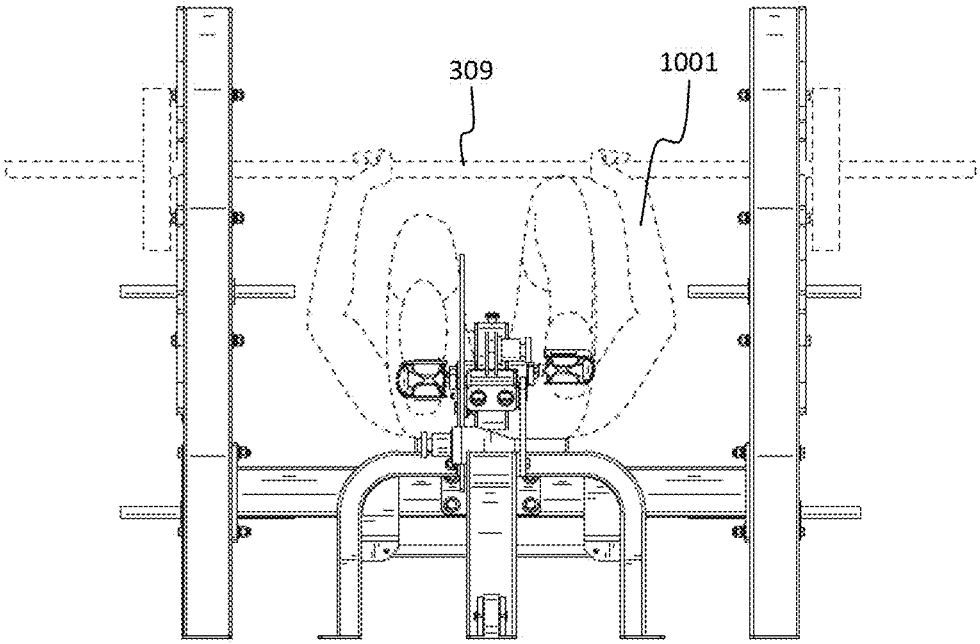
FIGS. 10B to 10G are front, rear, right side, left side, top and bottom views, respectively, that show the user using the apparatus shown in FIG. 9A.
Figure 10C:
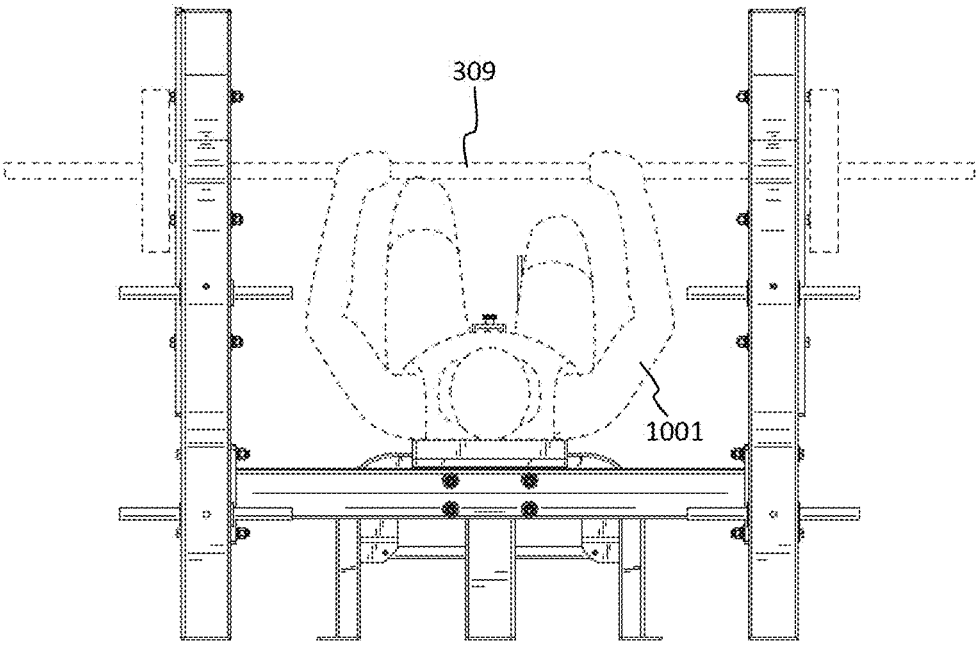
Figure 10D:
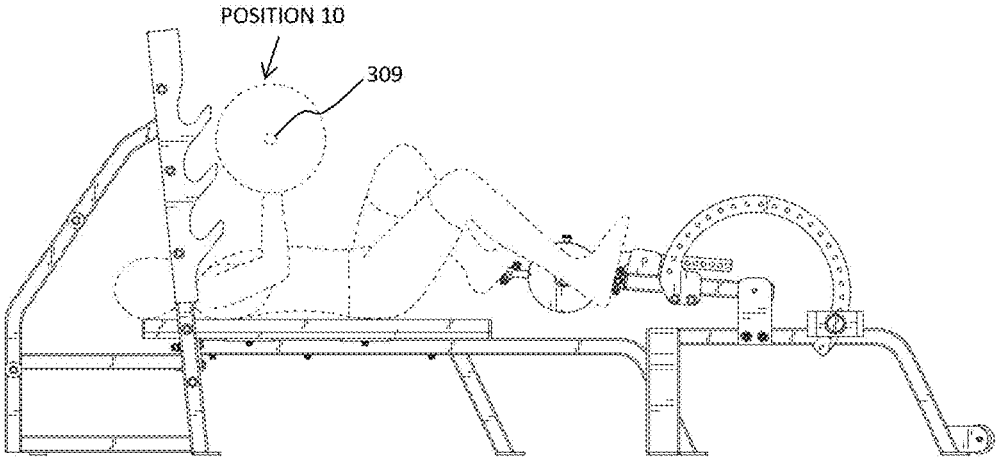
Figure 10E:
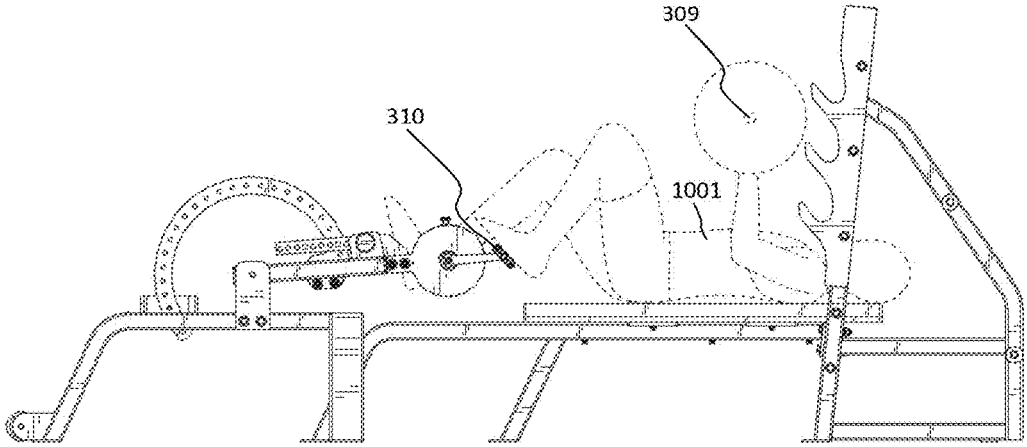
Figure 10F:
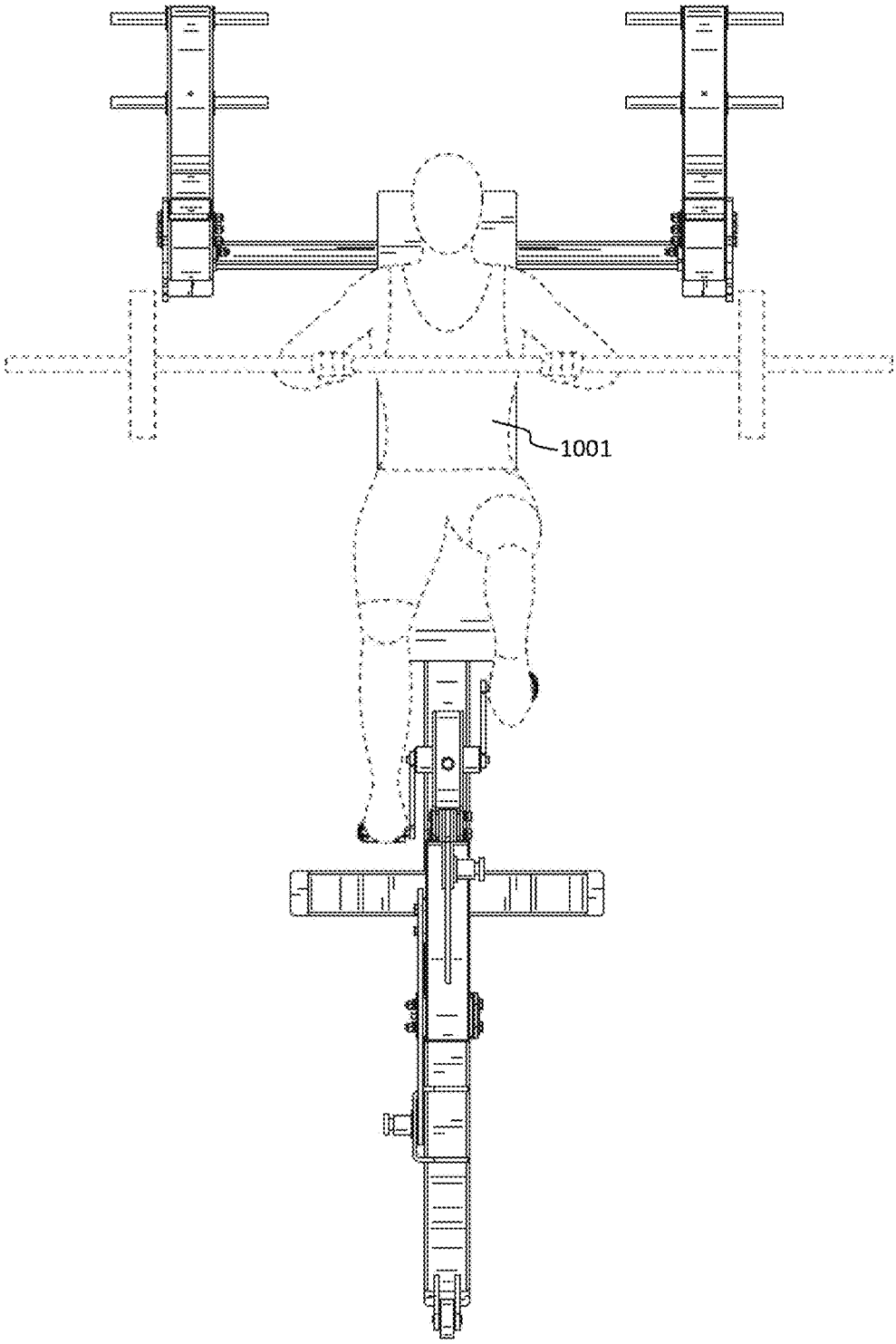
Figure 10G:
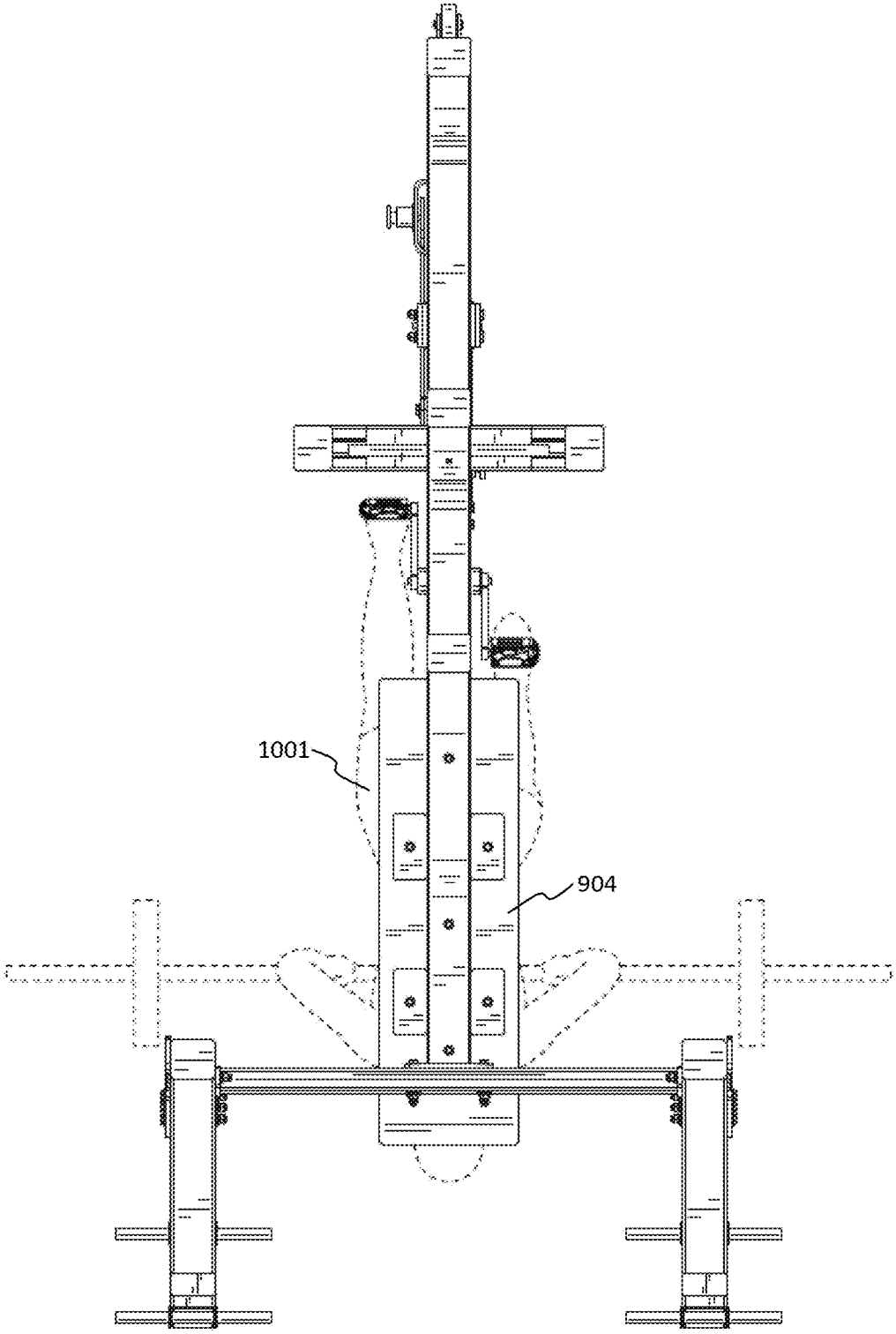

FIG. 10A shows the user 1001 lying flat on the user's back on bench 904, performing a bench press as a target exercise that preferably targets at least the user's pectoralis muscles, while simultaneously performing a cycling motion as a distraction exercise with foot pedals 310. User 1001 is shown performing the weight lifting with the user's upper body as a target exercise by raising and lowering barbell 309, while, at the same time, user 1001 is cycling with pedals 310. In this figure, user 1001 is illustrated as being relatively short, such that the pedals are rotated inward to position "I" by the user 1001 for performing the distraction exercise. A user of this height might typically stow the barbell in the lowest rung of the left and right weight supports 907A, 908A before beginning the exercises. See FIG. 10H.

FIGS. 10B to 10G are front, rear, right side, left side, top and bottom views, respectively, that show the user exercising on apparatus 900. The figures show various positions through which a user 1001 may raise and lowers barbell 309 during the target exercise, such as to a lowest level above the neck (e.g., FIG. 8A—position "9"), above the chest (e.g., FIG. 8B—position "10"—note that user's may move the top of his head a little beyond the bench if so desired), and to a fully raised position (e.g., FIG. 10I—position "11"). Noticeably, the user in the figures is raising the weights in a substantially even manner across the right and left sides of the body to develop the upper body muscle's evenly on both sides of the body, as facilitated by the distraction exercise.

Figure 10H:
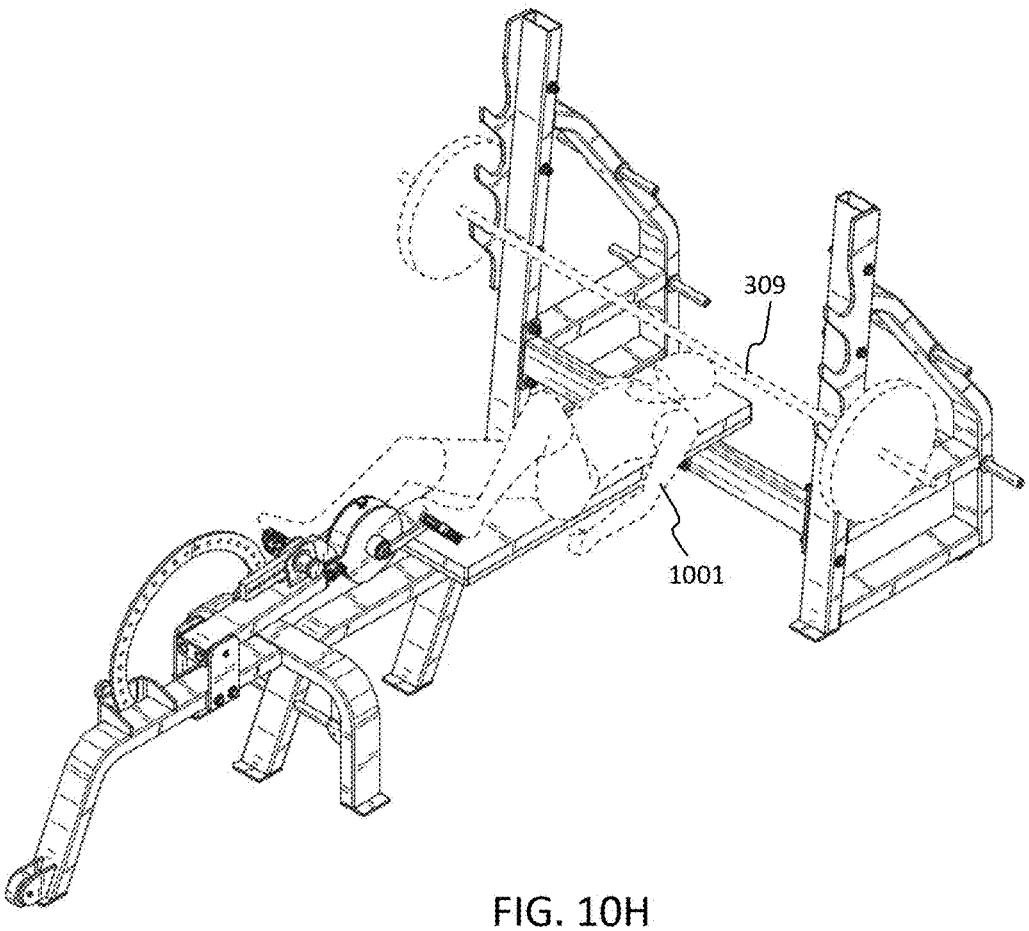
FIG. 10H is a perspective view of a user positioning the user's legs on the movable foot pedals of the apparatus of FIG. 10A before initiating the upper body, weight lifting exercise.
Figure 10I:
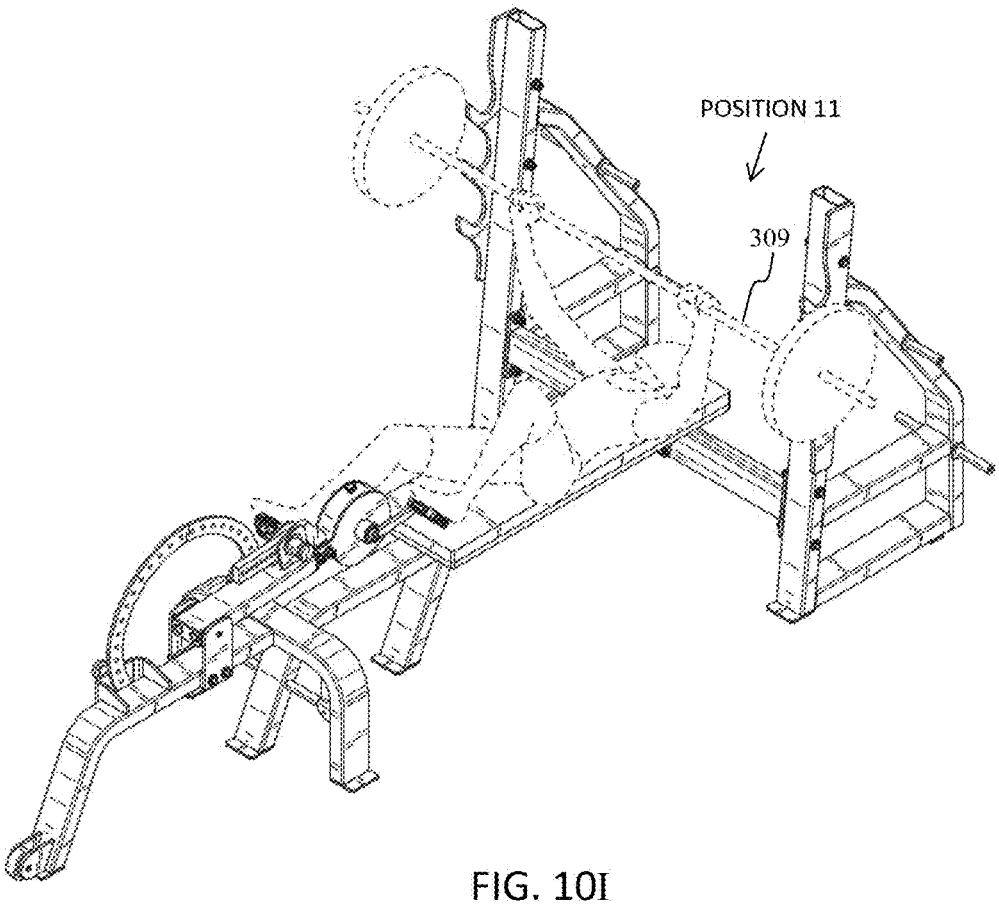
FIG. 10I is a perspective view of the user of FIG. 9H after initiating the upper body, weight lifting exercise.

As shown in FIG. 10H, after positioning the resistance load 309 and pedals 310, for safety and stability reasons, user 1001 should preferably position the feet on the pedals 310 first before initiating the weight lifting as a target exercise by lifting the barbell as shown in FIG. 10I. To safely discontinue the exercises, the user will preferably first return the resistance load to the weight supports and then remove the feet from the pedals.

Figure 10J:
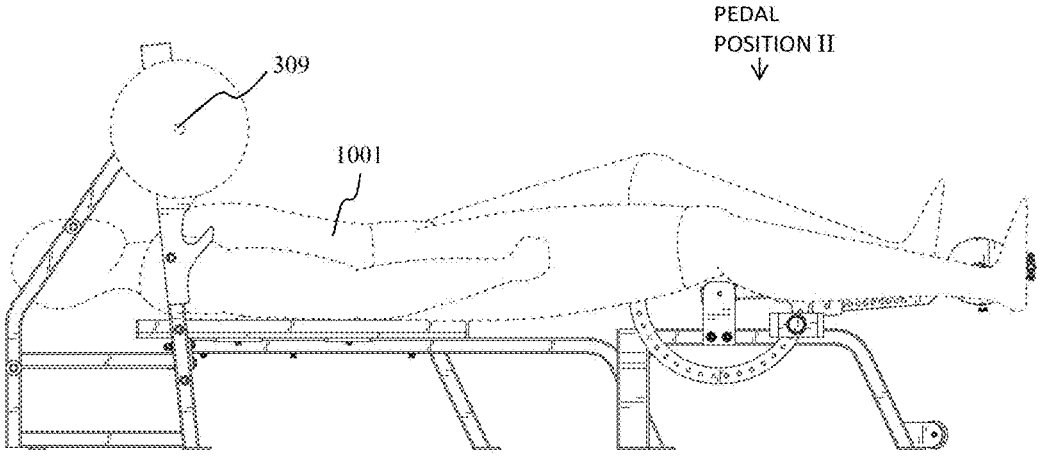
FIG. 10J is a right side view of the apparatus as shown in FIG. 9I, but with a user with relatively longer legs using the apparatus with the movable foot pedals adjusted to an extended position.

FIG. 10J illustrates use of exercise apparatus 1000 by a much taller user 1001' than user 1001 in FIGS. 10A to 10G. In this circumstance, user 1001' may find that the pedals 310 are most comfortably adjusted all of the way forward on exercise apparatus 1000, such as in position "II' shown in FIG. 9H, for performing cycling as a distraction exercise. Alternatively, user 1001' lying in the supine position may find that the pedals 310 are more stable, comfortable and relaxing to perform a distraction exercise to a position intermediate positions I and II, such as the position of pedals 310 shown in FIG. 9J.

By incorporating a distraction exercise of cycling, as described, the bench press of the present invention more fully develops the pectoralis muscles than occurs with a traditional bench press which lacks a distraction exercise. In the traditional bench press, the user just places the user's feet on the ground which leads to the contraction of leg muscles or keeps the hips and/or legs in the air. As a result, the hips contract, which leads to a slight contraction of the pectoralis muscles so that full engagement of the pectoralis muscle is not possible.

FIGS. 1A to 1H illustrate another exemplary embodiment of an exercise apparatus 1100 in accordance with the present invention in which a bench 1104 is adjustable from a flat position for use as a bench press to a seated position at varying levels of incline from the horizontal. This embodiment is similar to apparatus 900 in that it has weight supports for three barbell positions and a movable foot pedal assembly 309. However, bench 1104 comprises a fixed seat support 1104*b* and a movable back support 1104*a* that is adjustable upward from a generally flat position to an incline of one or more angles, such as at an incline of approximately 29, 44 or 89 degrees, from the horizontal position so as to form a seat similar to the seats 304, 504, and 704 described above. Back support 1104*a* is connected to an arcuate adjustment element 1180 (possibly attached to a rotating plate). Element 1180 has a plurality of apertures, thereby enabling a user to choose one of multiple possible angles at which to position back support 1104*s*. Arcuate adjustment element 1180 moves within a bracket 1182 that is mounted to frame 1102. A pin on a spring-loaded knob 1183 attached to bracket 1182 is inserted through a selected one of apertures 1181 to secure back support 1104*b* into a supine position or into a desired seated position.

In this embodiment, apparatus 1100 is illustrated as having three bar storage positions. However, to accommodate an even greater range of users, apparatus 1100 may alternatively have a taller weight support with more than three bar positions to stow a barbell. This enables the barbell to stowed at one of a group of the three illustrated positions, e.g. positions 1107A, 1108A, 1107B, 1108B, and 1107C, 1108C on FIG. 1E when back support 1104*a* is adjusted to the flat position. However, additional higher bar positions may be included in the weight supports. Such higher positions may be better for users particularly where back support is inclined such as at 29 degrees, 44 degrees or 89 degrees. Alternatively, weight supports 1107, 1108 may be raisable and locked into one of a plurality of vertical positions, such as with a conventional locking mechanism (e.g. heavy duty spring-loaded pins) so that the resistance load may be positioned higher or lower depending on the incline of the back support 1104*a*.

FIGS. 2A to 2I illustrate an example of how the physical exercise apparatus 1100 may be used to by a user 1201, in the supine position on bench 1104, to perform an upper body weight lifting exercise as a target exercise using the resistance load, such as a barbell, while simultaneously performing a distraction exercise of cycling with the foot pedals 310.

Figure 1A:
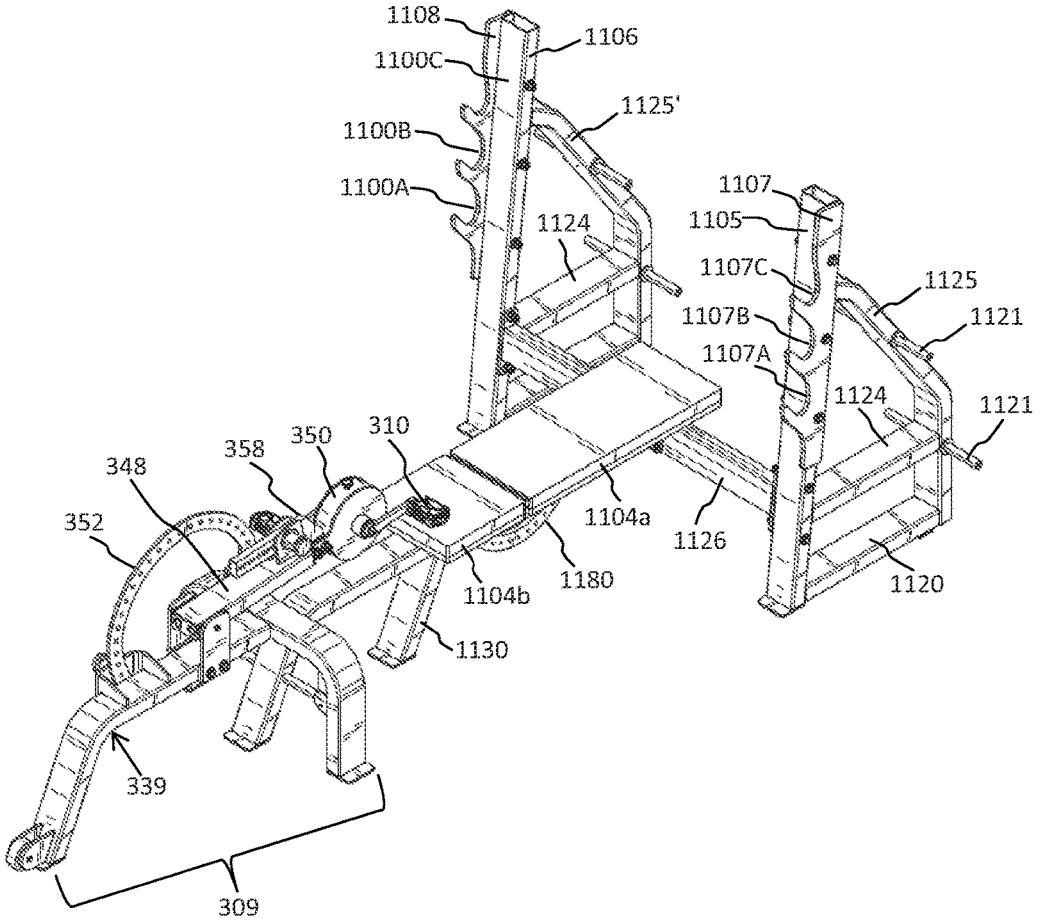
FIG. 1A is a perspective view of a physical exercise apparatus according to an exemplary embodiment of the present invention in which the apparatus has an adjustable bench and movable foot pedals that are adjusted to a first position for a user with relatively short legs.
Figure 1B:
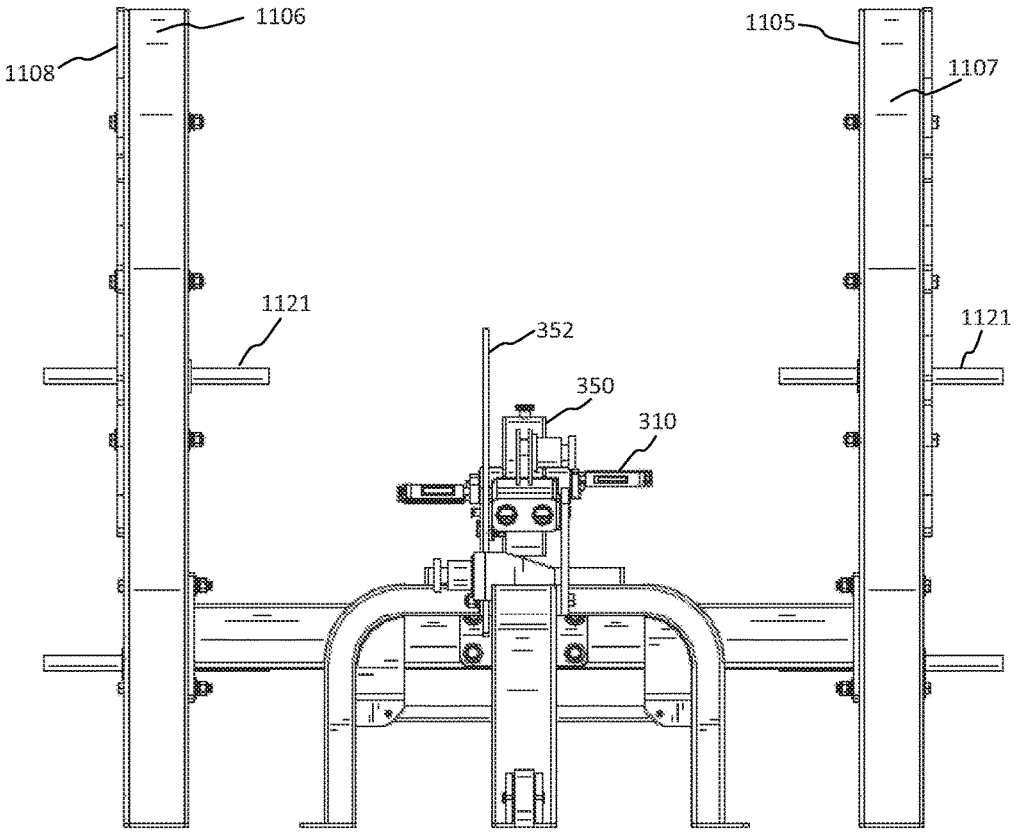
FIGS. 1B to 1G are front, rear, right side, left side, top and bottom views, respectively, of the physical exercise apparatus shown in FIG. 1A.
Figure 1C:
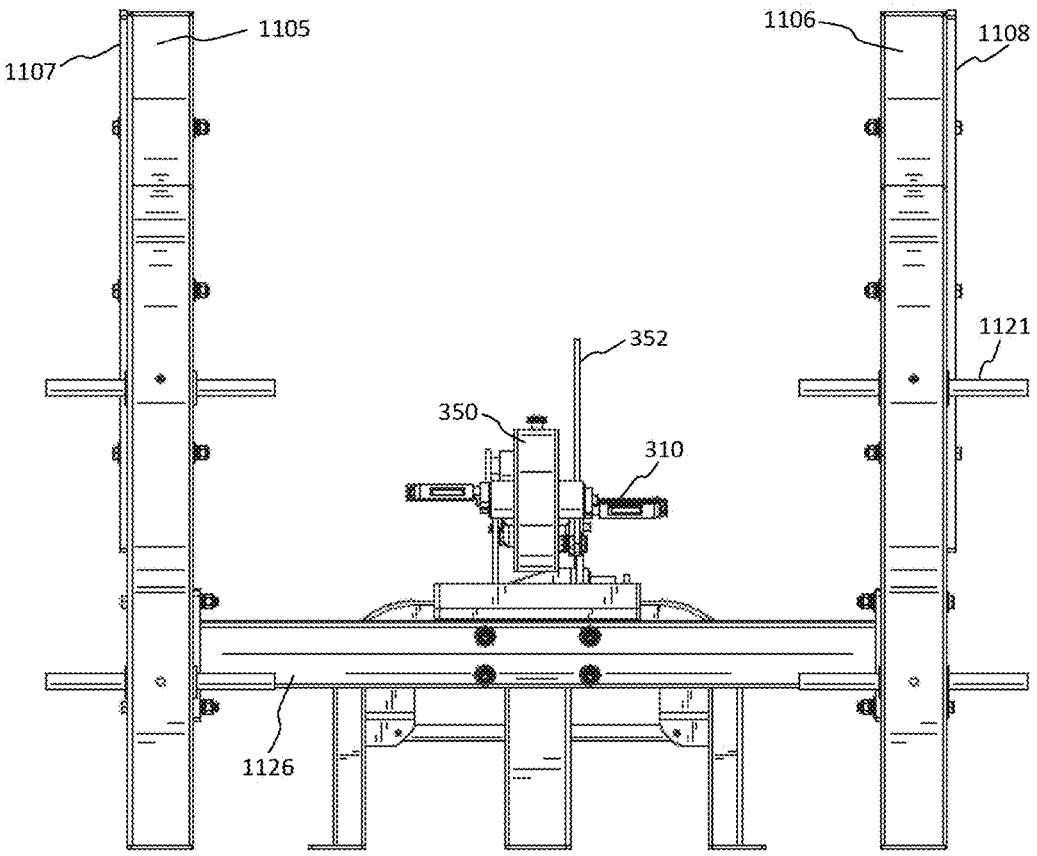
Figure 1D:
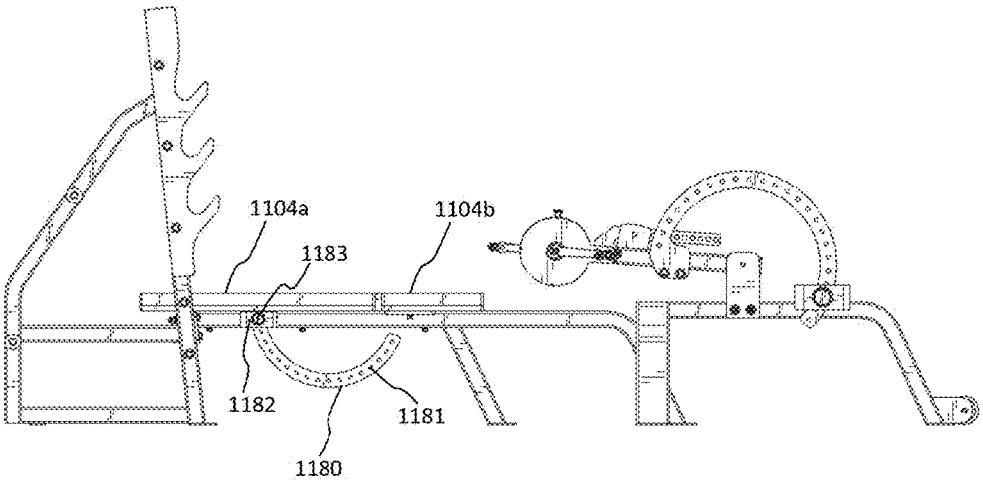
Figure 1E:
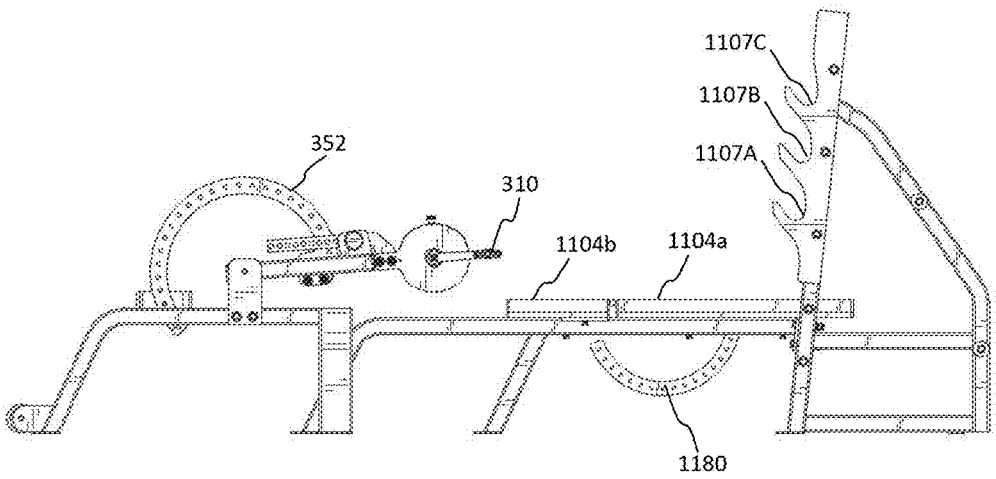
Figure 1F:
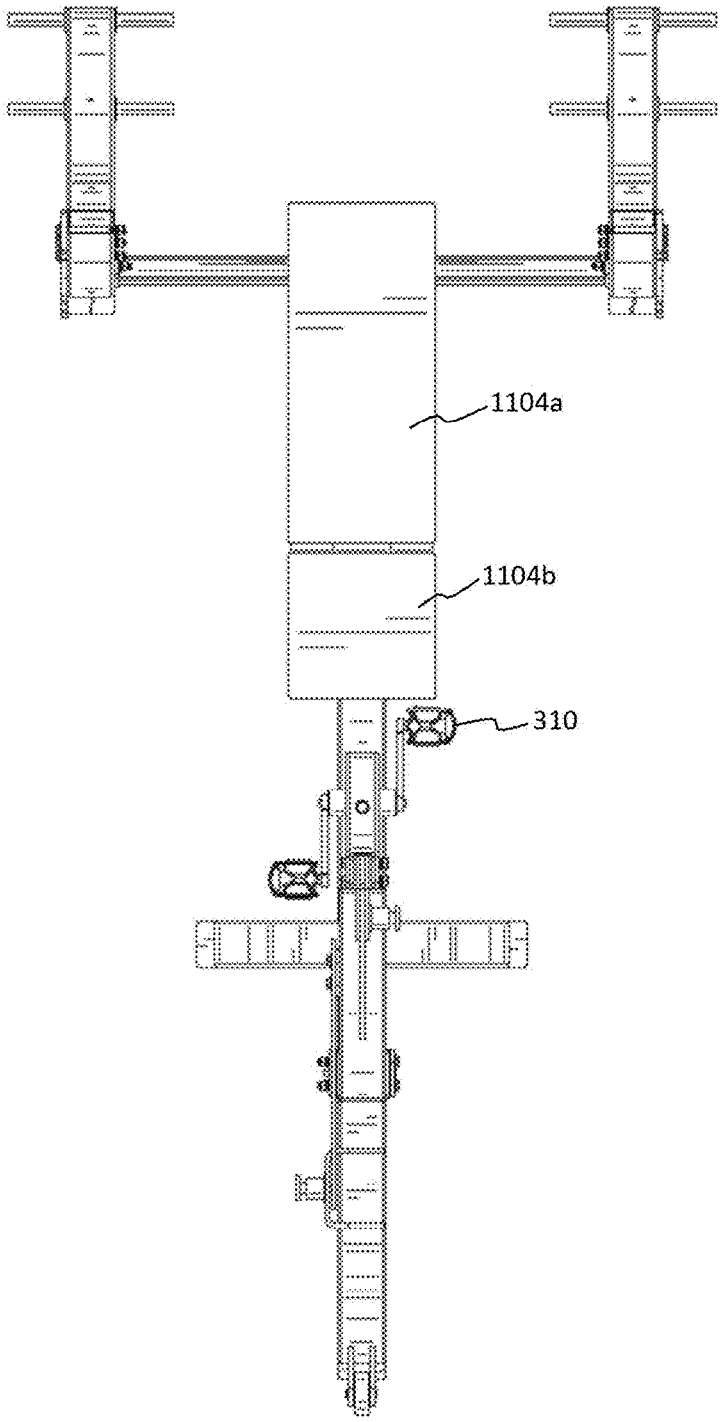
Figure 1G:
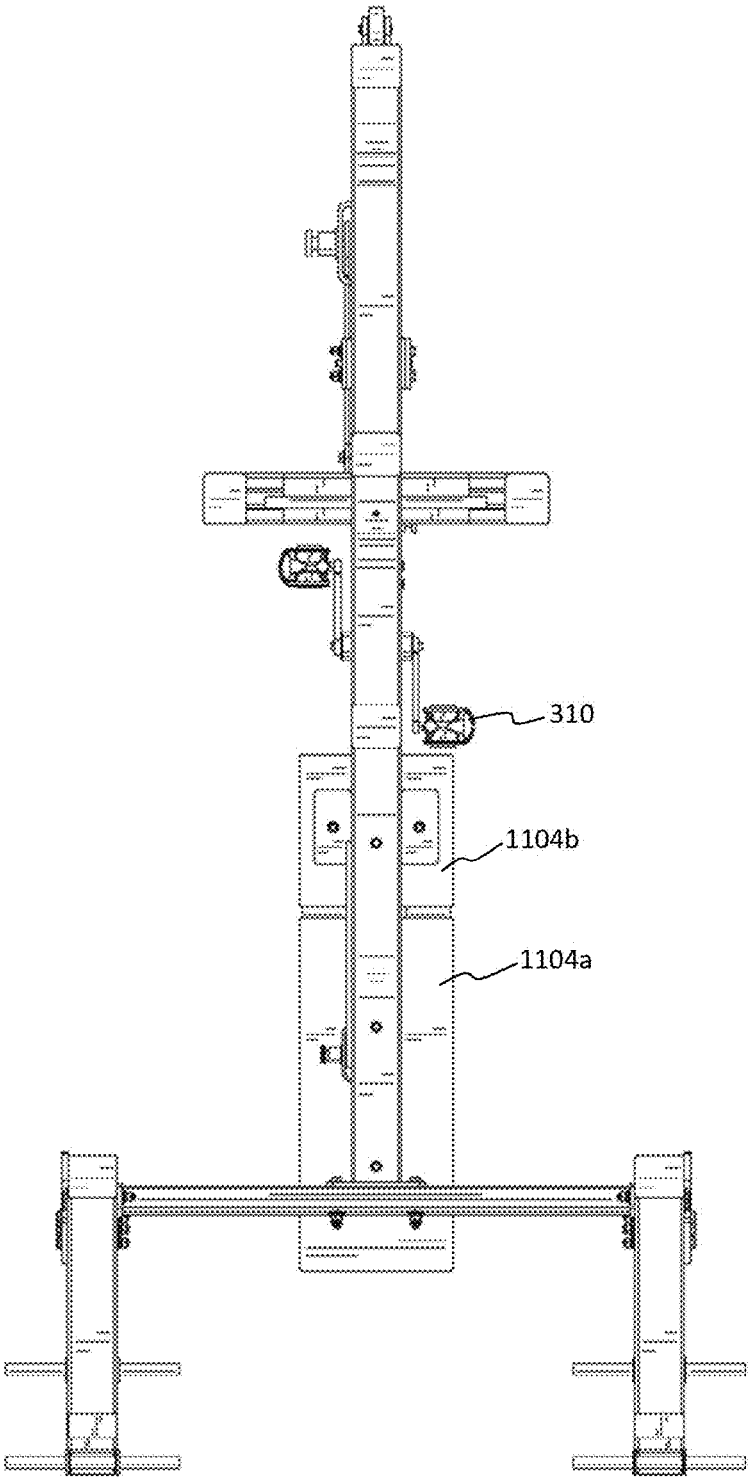
Figure 2A:
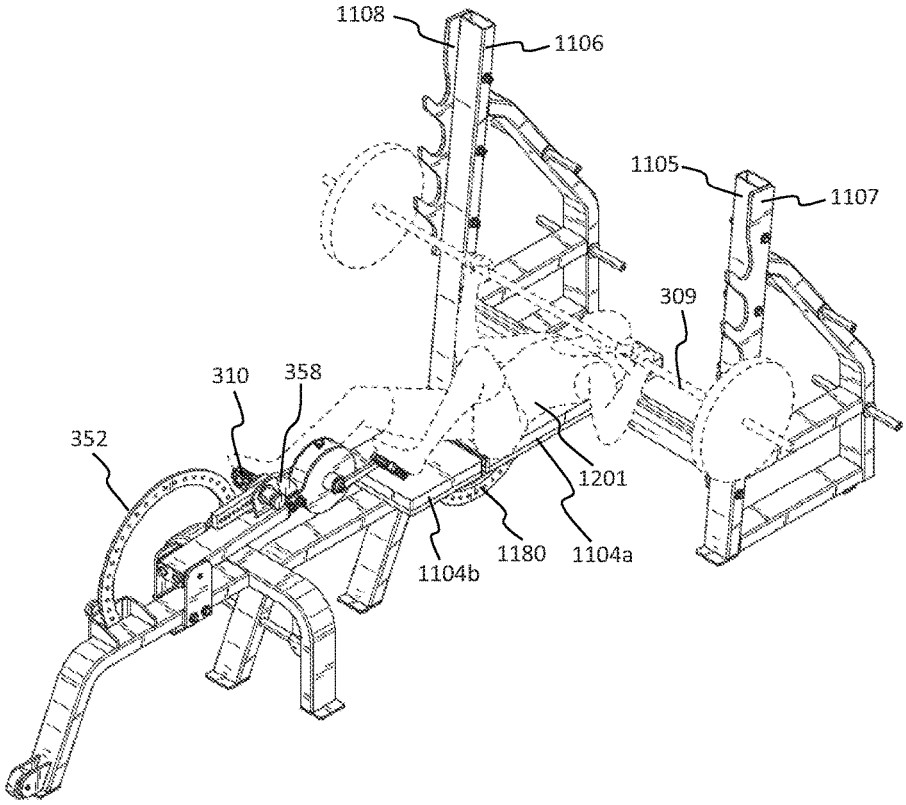
FIG. 2A is a perspective view showing a user using the physical exercise apparatus of FIG. 1A.
Figure 2B:
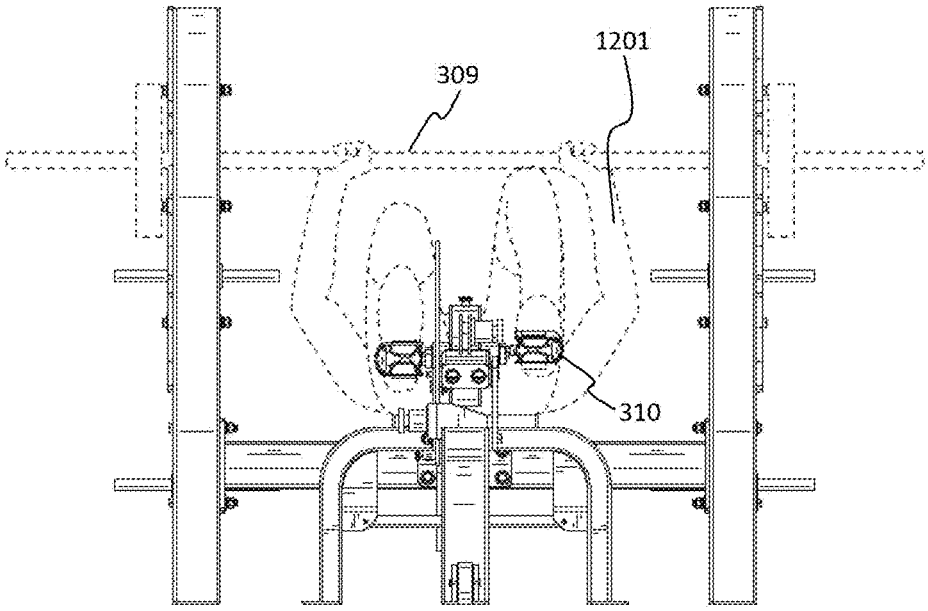
FIGS. 2B to 2G are front, rear, right side, left side, top and bottom views, respectively, that show the user using the apparatus shown in FIG. 1A.
Figure 2C:
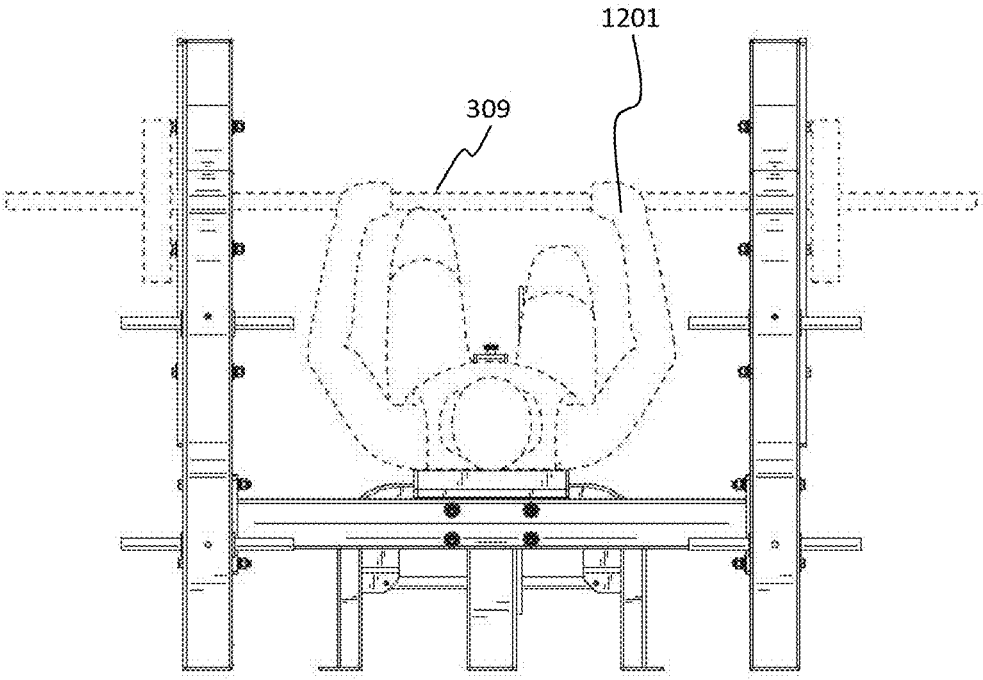
Figure 2D:
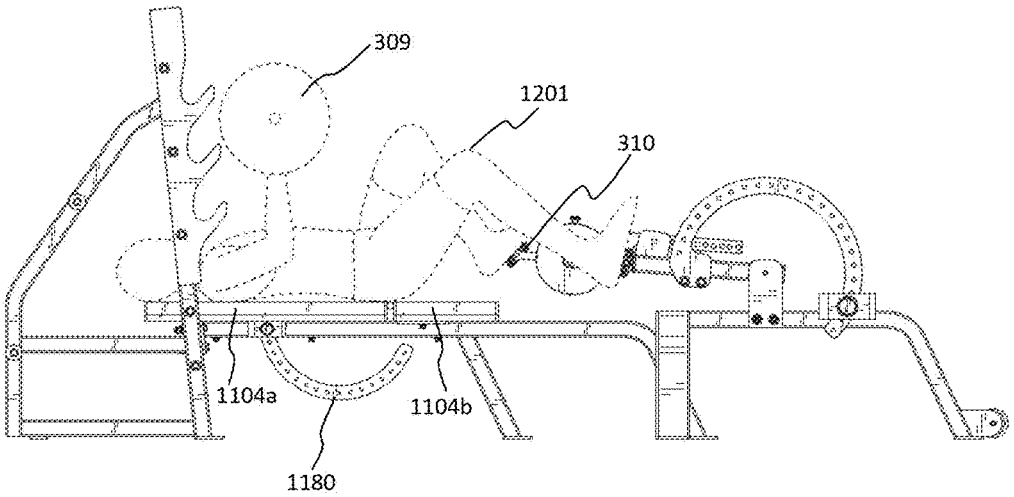
Figure 2E:
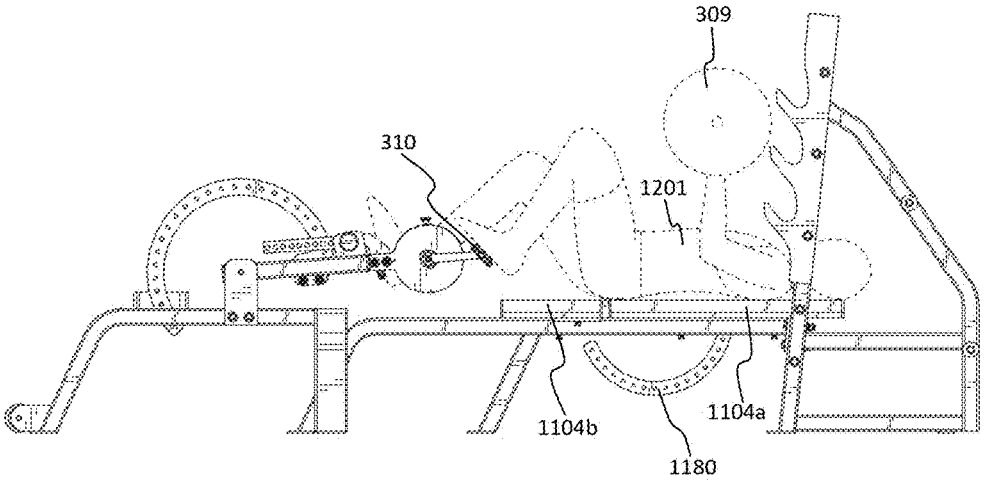
Figure 2F:
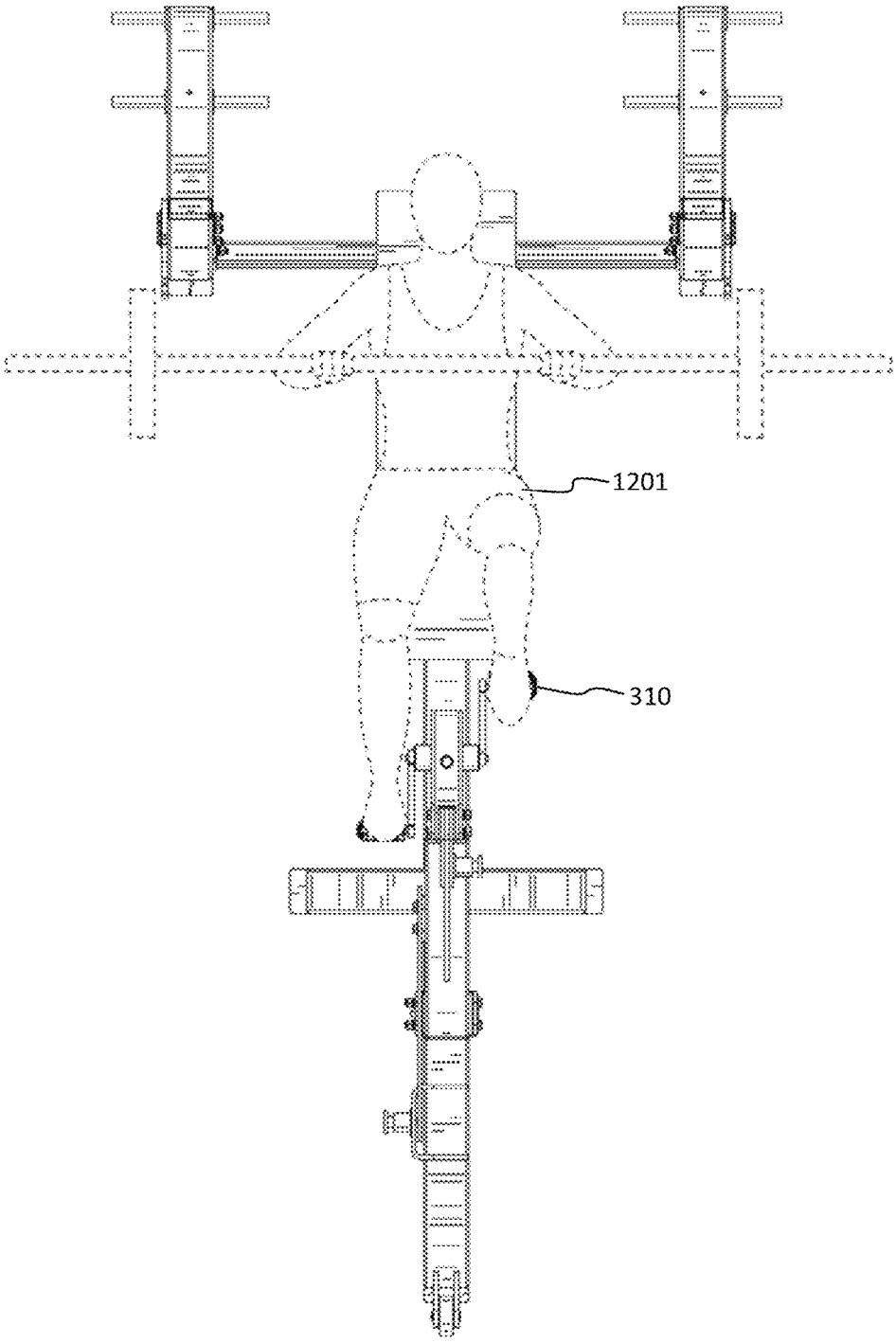
Figure 2G:
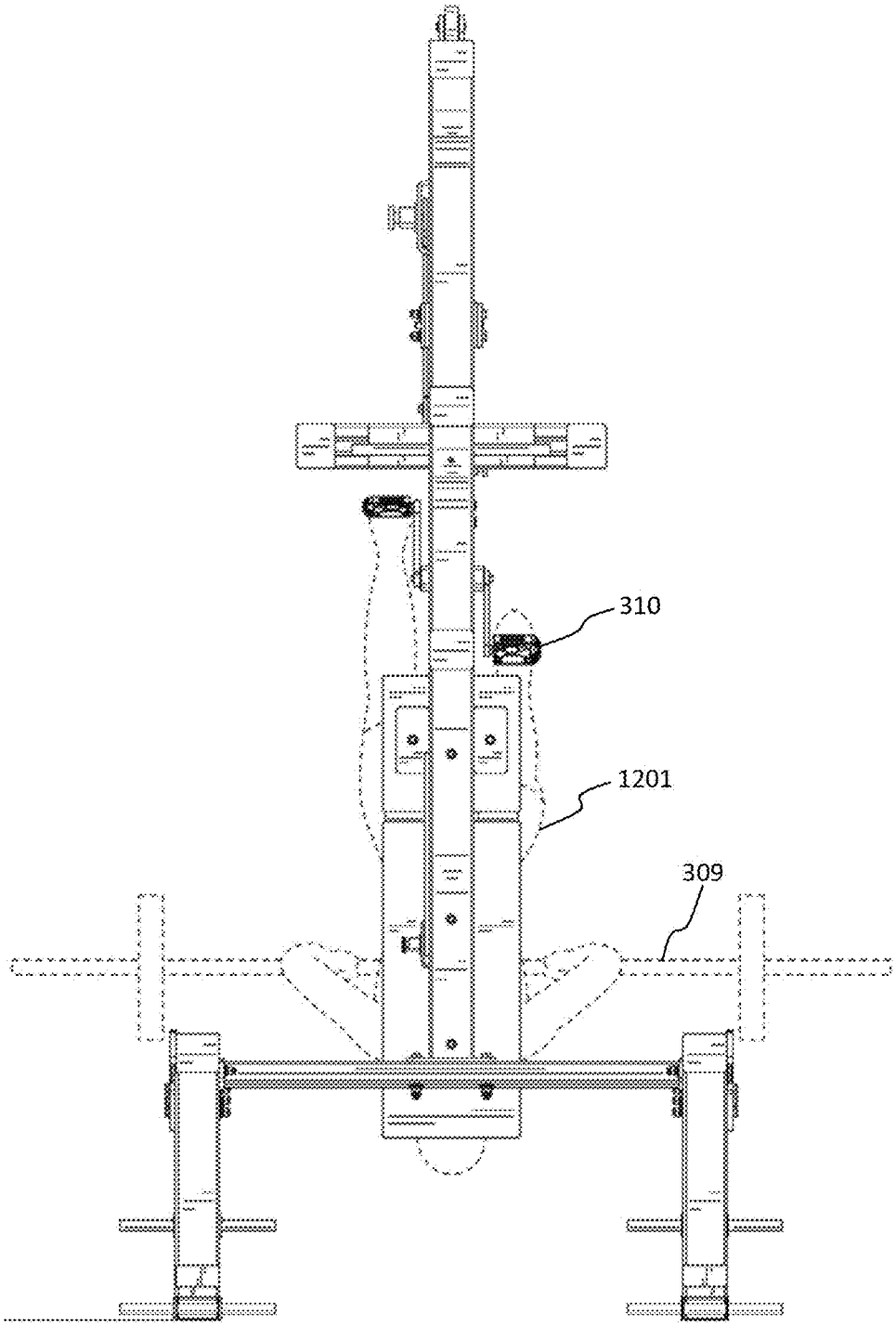

FIG. 2A shows the user 1201 lying flat on the user's back on bench 1104, performing a bench press as a target exercise that preferably targets at least the user's pectoralis muscles, while simultaneously performing a cycling motion as a distraction exercise with foot pedals 310. User 1201 is shown performing the weight lifting with the user's upper body as a target exercise by raising and lowering barbell 309, while, at the same time, user 1201 is cycling with pedals 310. In this figure, user 1201 is illustrated as being relatively short, such that the pedals are rotated inward to position "I" by the user 1201 for performing the distraction exercise. A user of this height might typically stow the barbell in the lowest rung of the left and right weight supports 907A, 908A before beginning the exercises. See FIG. 2H.

FIGS. 2B to 2G are front, rear, right side, left side, top and bottom views, respectively, that show the user exercising on apparatus 1100. The figures show various positions through which a user 1201 may raise and lower barbell 309 during the target exercise, Noticeably, the user in the figures is raising the weights in a substantially even manner across the right and left sides of the body to develop the upper body muscle's evenly on both sides of the body, as facilitated by the distraction exercise.

Figure 2H:
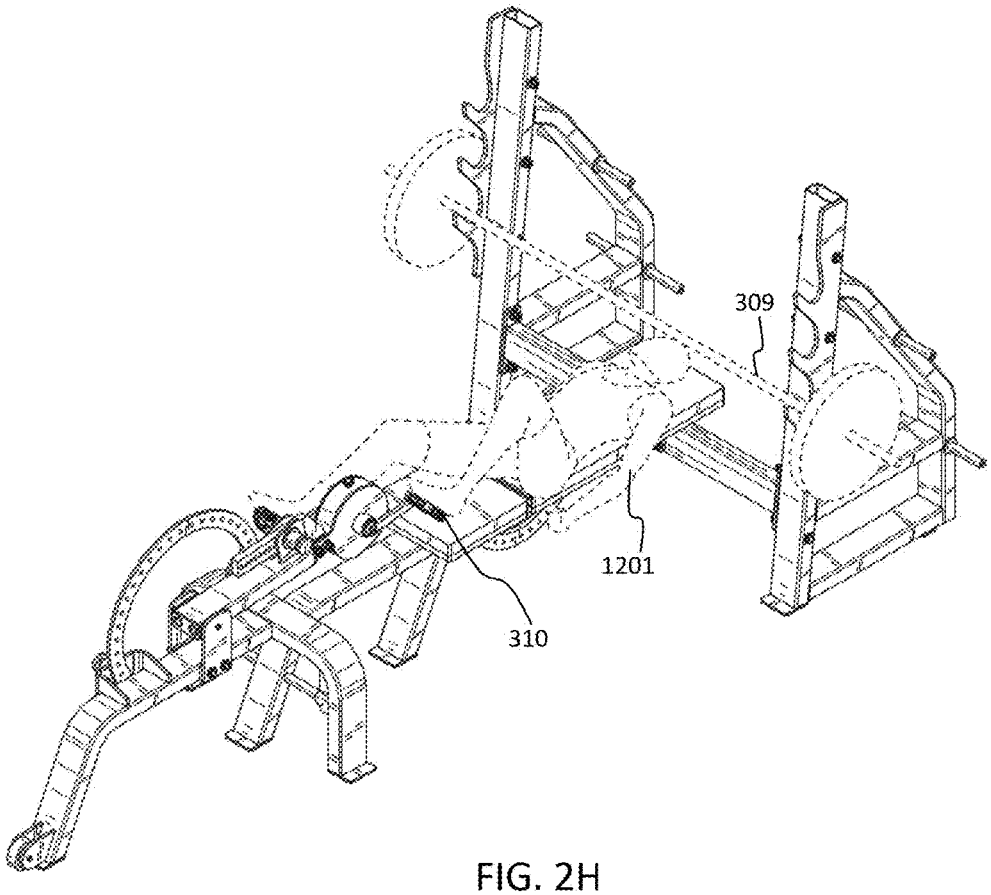
FIG. 2H is a perspective view of a user positioning the user's legs on the movable foot pedals of the apparatus of FIG. 2A before initiating the upper body, weight lifting exercise.
Figure 2I:
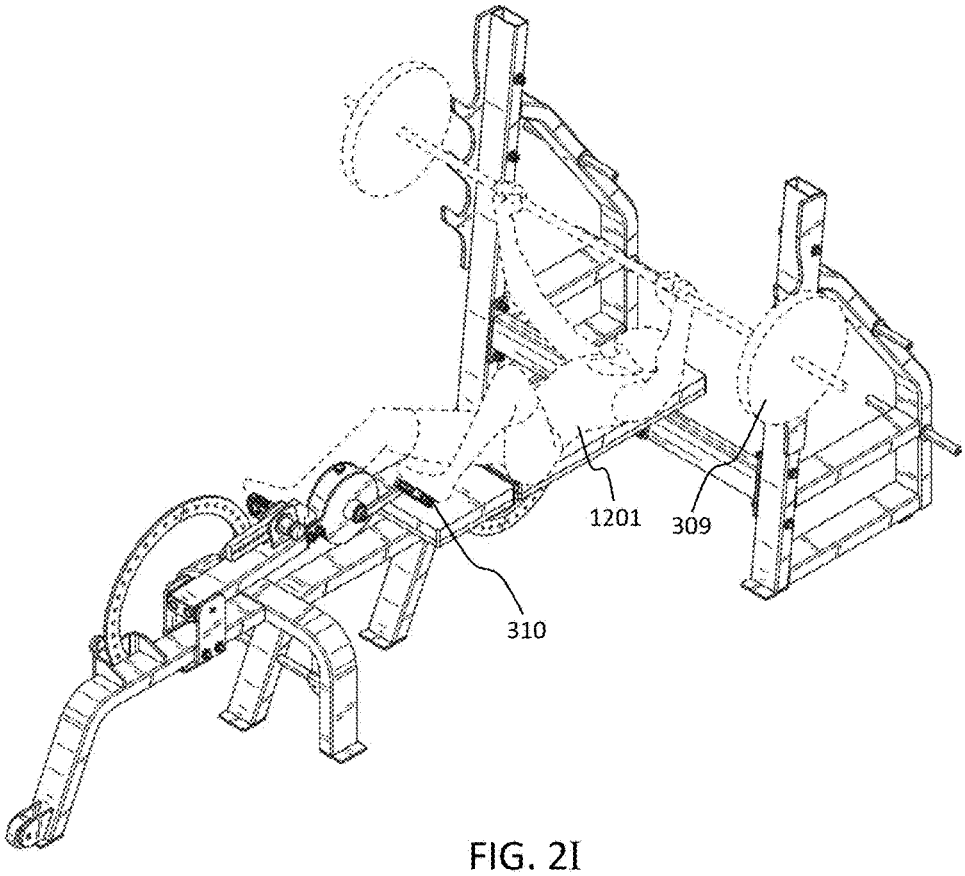
FIG. 2I is a perspective view of the user of FIG. 2H after initiating the upper body, weight lifting exercise.

As shown in FIG. 2H, after positioning the resistance load 309 and pedals 310, for safety and stability reasons, user 1201 should preferably position the feet on the pedals 310 first before initiating the weight lifting as a target exercise by lifting the barbell as shown in FIG. 2I. To safely discontinue the exercises, the user will preferably first return the resistance load to the weight supports and then remove the feet from the pedals.

User 1201 may also pivot back support 1104*a* of seat 1104 upward to one of various other angles up to a seated position. User 1201 may then adjust the position of foot pedals accordingly to a position in a two-dimensional plane for user 1201 to perform cycling as a distraction exercise. Before user 1201 performs the upper body weight lifting with a barbell, user 1201 pre-positions barbell 309 in the storage position best suited for user 1201. User 1201 then sits and begins pedaling before lifting barbell 309 as a target exercise. When dumbbells or other free weights used in lieu of a barbell, user 1201 may lift free weights from the ground and then sit and start the cycling as a distraction exercise before initiating upper body weight lifting.

Figure 11A:
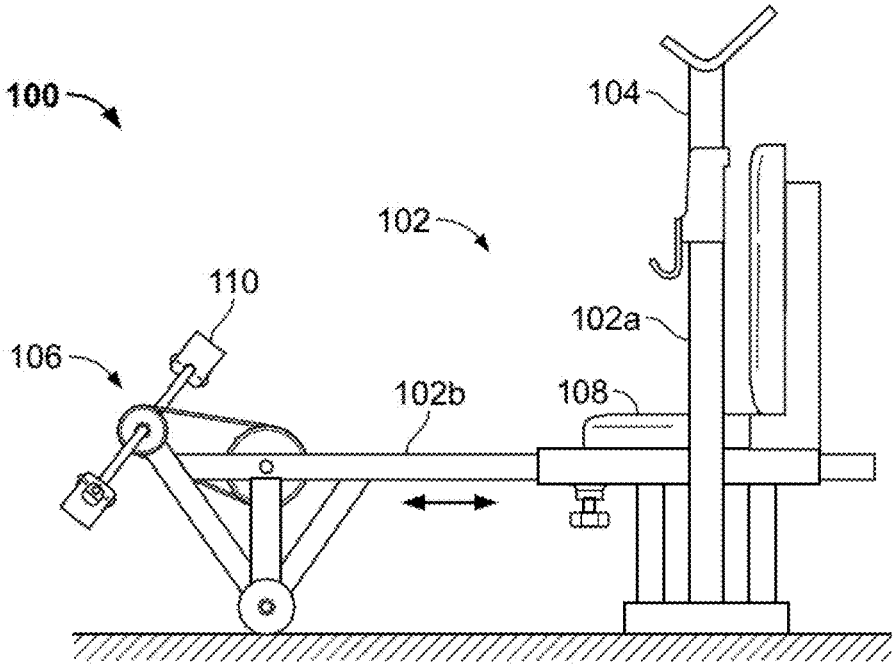
FIG. 11A is a side view of a physical exercise equipment apparatus according to another exemplary embodiment of the present invention.

Referring to FIG. 11A, an exercise equipment apparatus, e.g., a bench or shoulder press, according to an exemplary embodiment of the present disclosure, is generally designated by reference 100. In this embodiment, exercise equipment apparatus 100 may include a frame 102 having a vertical frame portion 102*a* and a horizontal frame portion

102*b*. Exercise equipment apparatus 100 may include an upper body portion 104, a lower body portion 106, and a seating portion, e.g., a bench 108. In this embodiment, bench 108 is shown as a seat having a back support disposed at an orthogonal angle, e.g., about 90 degrees, with respect to a seat support. Bench 108 may be supported by the frame 102. In embodiments, the components of upper body portion 104, lower body portion 106, and/or bench 108 may be integrally formed with or separable from frame 102. In embodiments, bench 108 may be separate from the frame 102, e.g., a wheeled bench that may be positioned along a portion of frame 102. Upper body portion 104 may comprise a portion of the frame 102 and be configured to support a resistance load, e.g., a barbell coupled with weight plates. In embodiments, a resistance load may be alternatively one of, e.g., a dumbbell, a kettlebell, or other free weight. Although FIG. 11A shows only a single position on which a barbell may be positioned, it should be understood that, in embodiments, weight supports may be provided with more than one vertical storage positions on which to store the barbell when it is not in use so that a user may pre-position the barbell at a comfortable level from which the user can initiate the upper body weight lifting. Lower body portion 106 may comprise movable foot pedals 110 attached, e.g., connected, to the frame 102 for engagement by a portion of the user's feet. As an alternative to using the embodiment of movable foot pedals 110 shown in FIG. 11A, a user may substitute a foot pedal assembly, such as foot pedal assembly 309 described above, that provides for the adjustability of the foot pedals in two dimensions.

In use, after adjusting the movable foot pedals 110 to a comfortable position (and pre-positioning a barbell, if used, on the weight support), a user may position his or her body in a seated position on the bench 108 and access, e.g., grasp, the barbell mounted on the frame 102 (not shown). Simultaneously, the user may raise, e.g., lift or press, the barbell overhead as a target exercise and engage the movable foot pedals 110 with his or her feet in a cycling motion as a distraction exercise from the seated position (not shown). It is advisable, in embodiments, for a user to first engage the pedals before starting the weight lifting. The cycling motion may distract the muscles of the lower body such that increased loading is experienced by, e.g., the deltoid muscles of the upper body, by the overhead pressing of the barbell (not shown). In this manner, a user may be inhibited from using the muscles of the lower body to cheat or leverage, e.g., assist, the upper body of the user in performing the overhead press of the barbell.

In embodiments, the distraction of the lower body caused by the cycling motion may place the user in a position that facilitates substantially even, e.g., symmetric with respect to an axial midline of the body, resistive loading across a target muscle group. The distraction of the lower body may position the user to access the barbell in a manner that discourages the user from, e.g., twisting, jerking, and/or shifting when using the exercise equipment apparatus 100. In this manner, exercise equipment apparatus 100 may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

Figure 11B:
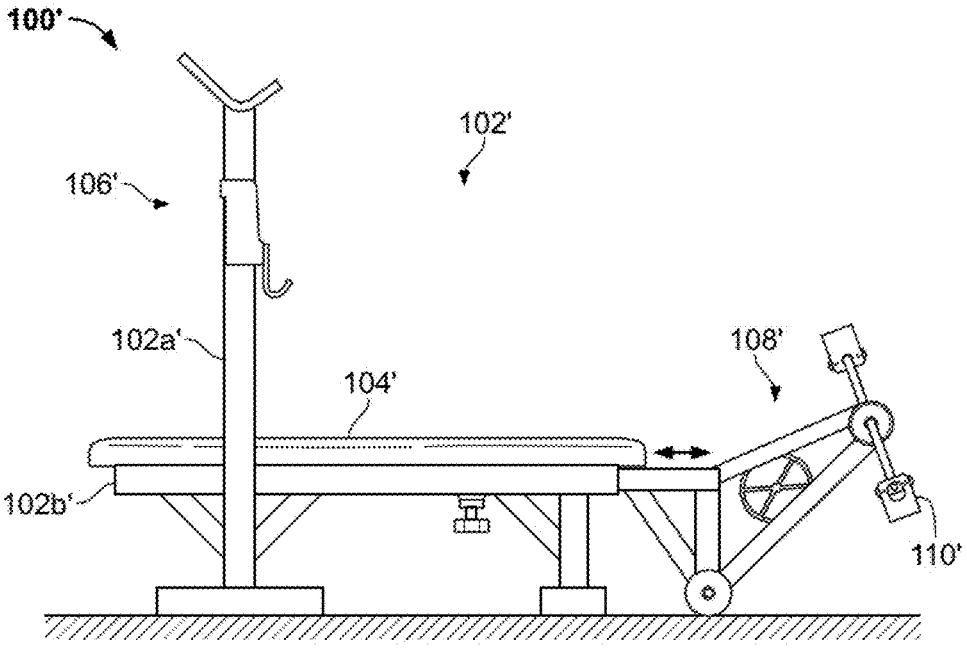
FIG. 11B is a side view of another exemplary embodiment of the present invention.
Figure 11C:
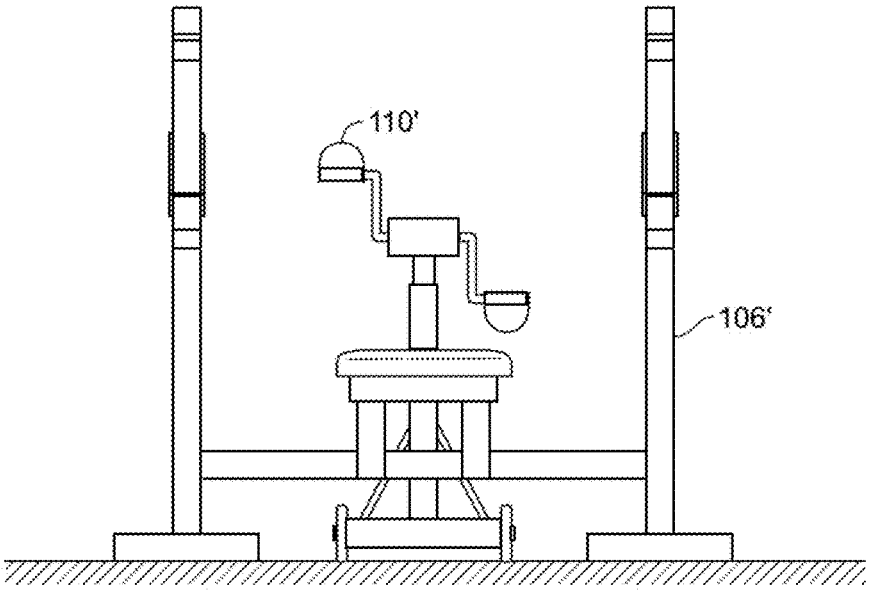
FIG. 11C is a rear side view of the physical exercise equipment apparatus shown in FIG. 11B.

Turning to FIGS. 11B and 11C, an exercise equipment apparatus, e.g., a bench press according to an exemplary embodiment of the present disclosure is generally designated by reference 100'. In this embodiment, exercise equipment apparatus 100' may include a frame 102' having a vertical portion 102*a'* and a horizontal portion 102*b'*. Exercise equipment apparatus 100' includes a bench 104' supported by frame 102', an upper body portion 106', and a lower body portion 108'. In embodiments, bench 104', upper body portion 106', and/or lower body portion 108' may be integrally formed with or separable from the frame 102'. Bench 104' may be configured as, e.g., a flat bench disposed orthogonal to the vertical portion 102*a'* of frame 102'. Bench 104' may include a back support and a seat support. In embodiments, exercise equipment apparatus 100' may incorporate a bench 104' that may be integral to the frame 102' or separate from the frame 102', e.g., a wheeled bench.

Upper body portion 106' may comprise a portion of frame 102' configured to support a resistance load, e.g., a barbell coupled with weight plates (not shown). In embodiments, a resistance load may alternatively be one of, e.g., a dumbbell, a kettlebell, or other free weight. Although FIG. 11B shows only a single storage position on which a barbell may be positioned, it should be understood that, in embodiments, weight supports may be provided with more than one vertical storage positions on which to store the barbell when it is not in use so that a user may pre-position the barbell at a comfortable level at which the user can initiate the upper body weight lifting. Lower body portion 108' may comprise movable foot pedals 110' attached, e.g., connected, to the frame 102' for engagement by the user's feet. As an alternative to using the embodiment of movable foot pedals 110' shown in FIG. 11B, a user may substitute a foot pedal assembly, such as foot pedal assembly 309 described above, that provides for the adjustability of the foot pedals in two dimensions.

In use, after adjusting the movable foot pedals 110 to a comfortable position (and pre-positioning a barbell, if used, on the weight support) a user may position his or her body in a supine position on the bench 104' and access, e.g., grasp, the barbell mounted on the of the frame 102' (not shown). Simultaneously, the user may raise, e.g., lift or press, the barbell overhead as a target exercise and engage the movable foot pedals 110' as a distraction exercise with his or her feet in a cycling motion from the at least partially supine position (not shown). The cycling motion may distract, the muscles of the lower body such that increased loading is experienced by, e.g., the pectoralis muscles of the upper body, by the overhead pressing of the barbell (not shown). In this manner, a user may be inhibited from using the muscles of the lower body to cheat or leverage, e.g., assist, the upper body of the user in performing the chest press of the barbell.

In embodiments, the distraction of the lower body caused by the cycling motion may place the user in a position that facilitates substantially even, e.g., symmetric with respect to an axial midline of the body, resistive loading across a target muscle group. The distraction of the lower body may position the user to access the barbell in a manner that discourages the user from, e.g., twisting, jerking, and/or shifting when using the exercise equipment apparatus 100'. In this manner, exercise equipment apparatus 100' may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

Figure 11D:
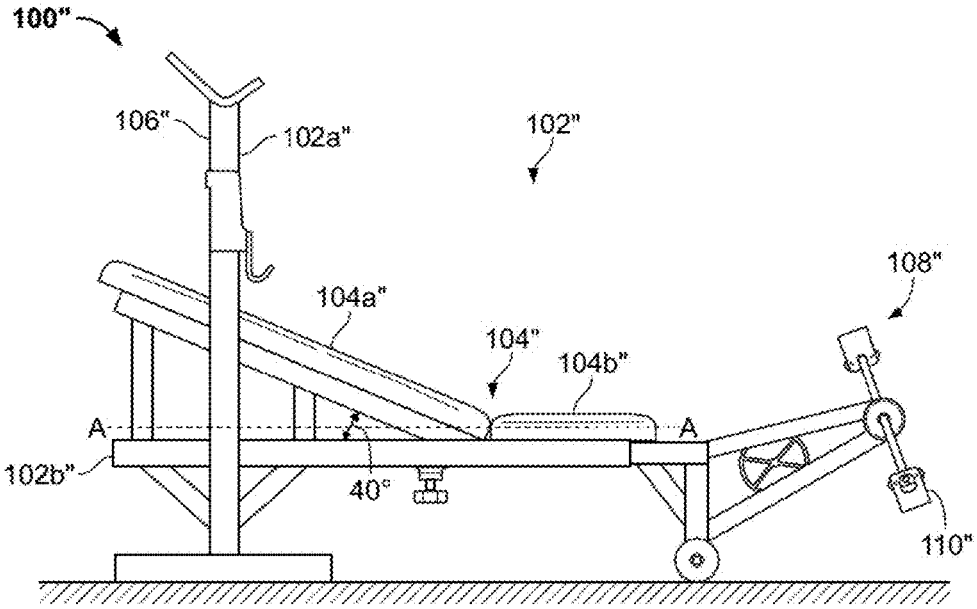
FIG. 11D is a side view of a physical exercise equipment apparatus according to another exemplary embodiment of the present invention.

Turning to FIG. 11D, an exercise equipment apparatus, e.g., a bench press, according to an exemplary embodiment of the present disclosure is generally designated by reference 100". In this embodiment, exercise equipment apparatus

100" may include a frame 102" having a vertical portion 102*a*" and a horizontal portion 102*b*". Exercise equipment apparatus 100" may include a seating portion, e.g., a bench 104" supported by frame 102", an upper body portion 106", and a lower body portion 108". In embodiments, components of bench 104", upper body portion 106", and/or lower body portion 108" may be integrally formed with or separable from frame 102". Bench 104" may incorporate a back support 104*a*" and a seat support 104*b*". Seat support 104*b*" may have a substantially horizontal configuration, e.g., seat support 104*b*" may be level with the ground beneath exercise equipment apparatus 100". Back support 104*a*" may be disposed at an oblique angle with respect to the seat support 104*b*", e.g., an angle of about 40 degrees with respect to a reference line A drawn through the seat support 104*b*". In embodiments, back support 104*a*" may be disposed at a fixed angle with respect to seat support 104*b*". In embodiments, back support 104*a*" may be adjustable, e.g., hingably or pivotably coupled, with seat support 104*b*" such that back support 104*a*" may be moved through a range of angles with respect to seat support 104*b*". In embodiments, back support 104*a*" may be fixedly or adjustably disposed at a range of angles with respect to seat support 104*b*" e.g., between and including about 180 degrees and about 90 degrees. Upper body portion 106" may comprise a portion of frame 102" configured to support a resistance load, e.g., a barbell coupled with weight plates. In embodiments, a resistance load may be alternatively be one of, e.g., a dumbbell, a kettlebell, or other free weight. Although FIG. 11D shows only a single storage position on which a barbell may be positioned, it should be understood that, in embodiments, weight supports may be provided with more than one vertical storage positions at to store the barbell when it is not in use so that a user may pre-position the barbell at a comfortable level at which the user can initiate the upper body weight lifting. Lower body portion 108" may comprise movable foot pedals 110" attached, e.g., connected, to the frame 102" for engagement by the user's feet. As an alternative to using the embodiment of movable foot pedals 110" shown in FIG. 11D, a user may substitute a foot pedal assembly, such as foot pedal assembly 309 described above, that provide for the adjustability of the foot pedals in two dimensions.

In use, after adjusting the movable foot pedals 110" to a comfortable position (and pre-positioning a barbell, if used on the weight support), a user may position his or her body in a partially supine position on the bench 104" and access, e.g., grasp, the barbell mounted on the frame 102" (not shown). Simultaneously, the user may raise, e.g., lift or press, the barbell overhead as a target exercise and engage the movable foot pedals 110" as a distraction exercise with his or her feet in a cycling motion from the partially supine position (not shown). The cycling motion may distract the muscles of the lower body such that increased loading is experienced by, e.g., the upper pectoralis muscles of the upper body, by the overhead pressing of the barbell (not shown). In this manner, a user may be inhibited from using the muscles of the lower body to cheat or leverage, e.g., assist, the upper body of the user in performing the overhead press of the barbell.

In embodiments, the distraction of the lower body caused by the cycling motion may place the user in a position that facilitates substantially even, e.g., symmetric with respect to an axial midline of the body, resistive loading across a target muscle group. The distraction of the lower body may position the user to access the barbell in a manner that discourages the user from, e.g., twisting, jerking, and/or shifting when using the exercise equipment apparatus 100". In this manner, exercise equipment apparatus 100" may be configured to position a user, via a distraction exercise, such that a target muscle group receives an even resistive loading to, e.g., minimize, prevent, and/or improve muscular imbalances, and/or encourage symmetrical development of muscles with respect to an axial midline of the body, within target muscle groups.

For all of the embodiments described above, it will be understood that the movable foot pedal assembly may be coupled with a section of the exercise apparatus frame in any suitable manner, e.g., soldering, welding, fasteners such as bolts or screws, straps, or interlocking features, to name a few. In embodiments, movable foot pedals may be supported by an independent frame.

It should also be understood that the movable foot pedals may be adjusted to a selected one of a choice of different positions within a two dimensional plane where the position is selected so that the user's legs are comfortable and relaxed for cycling. Various positions of the foot pedals are shown in the present disclosure. For example, six different pedal positions are shown in FIGS. 3A, 3I, 3J, 3K, 9I and 9J. However, these pedal positions are only shown as examples. The present invention does not require that the foot pedals be restricted to any one of the locations illustrated in the examples, as the selected location for the foot pedals is selected by a user from any one of the available positions for which the particular exercise apparatus is configured.

In embodiments, foot pedals 310 may be such as the foot pedals shown in parent applications, including U.S. patent application Ser. No. 14/104,664, filed Dec. 12, 2013, published as U.S. Patent Appl. Publ. No. 2014/0364282 on Dec. 11, 2014, U.S. patent application Ser. No. 14/154,957, filed Jan. 14, 2014, published as U.S. Patent Appl. Publ. No. 2014/0364284 on Dec. 11, 2014, U.S. patent application Ser. No. 14/296,107, filed Jun. 4, 2014, published as U.S. Patent Appl. Publ. No. 2014/0364283 on Dec. 11, 2014, and U.S. patent application Ser. No. 14/296,234, filed Jun. 4, 2014, published as U.S. Patent Appl. Publ. No. 2014/0364285 on Dec. 11, 2014, and provisional U.S. Application Ser. No. 61/872,207, filed Aug. 30, 2013, which are hereby incorporated by reference in their entirety.

It will be further understood that the embodiments of a physical exercise apparatus described in the present specification may be used for simultaneously heavy weight lifting (e.g., an 80 pound dumbbell or a 200 pound barbell) as a target exercise to develop the deltoid and/or pectoralis muscles of the user's upper body while simultaneously cycling in a stable, comfortable and relaxing manner as a distraction exercise. As such, the frame and other components of the physical exercise apparatus should preferably be fabricated from sturdy materials that are suitable for heavy upper body, weight lifting.

While this invention has been described in conjunction with the exemplary embodiments outlined above, it is evident that many alternatives, modifications and variations will be apparent to those skilled in the art. In particular, the frame, seating, and weight configurations disclosed above may be varied to suit the particular needs of the user, e.g., a modular or monolithically formed frame design, and resistance loads being configured as stacked or free weights. Accordingly, the exemplary embodiments of the invention, as set forth above, are intended to be illustrative, not limiting. Various changes may be made without departing from the spirit and scope of the invention.

What is claimed is:

1. A physical exercise apparatus, comprising:

(a) a frame having a first portion configured to support a resistance load for an upper body, weight lifting exercise that is a target exercise for developing pectoralis muscles in an upper body of a user;

(b) a flat bench, vertically spaced above the ground, supported by the frame and configured to provide the user with access to the resistance load and to support the user for performing the target exercise comprising the upper body, weight lifting exercise while the user is lying on the flat bench in a supine position with the user in a horizontal position lying on the user's back and facing upward, wherein the target exercise is configured to develop the pectoralis muscles in the upper body of the user;

(c) a pair of movable foot pedals connected to a second portion of the frame but not connected to the resistance load so that the resistance load that is associated with the target exercise is not applied to the pair of movable foot pedals, and configured for the user to perform the upper body, weight lifting exercise to develop the user's pectoralis muscles, while in the supine position on the flat bench, and simultaneously cycling with the pair of movable foot pedals as a physical distraction exercise to engage muscles of the lower body of the user with a physical distraction to inhibit the muscles of the lower body from assisting the user's pectoralis muscles of the upper body in the target exercise, wherein the movable foot pedals for cycling are adjustable to a selected location at a vertical level above a height of the flat bench in a two-dimensional plane at which the movable foot pedals are releasably secured to be configured for cycling by the user as the distraction exercise while in the supine position with the user's legs above the flat bench so that the user remains in postural alignment for performing the target exercise simultaneously with the distraction exercise, and (d) at least two adjustment members positionable above the height of the flat bench to adjust the selected location of the movable foot pedals to the vertical level above the height of the flat bench including:

(i) a first adjustment member comprising an arcuate member coupled to the movable foot pedals at a pivot point and having a first plurality of apertures arranged in an arc shape, such that the movable foot pedals are configured to be rotatable about the pivot point and releasably securable to one of the first plurality of apertures; and (ii) a second adjustment member, coupled to the movable foot pedals and the first adjustment member, the second adjustment member comprising a bar having arranged linearly thereon a second plurality of apertures, such that the movable foot pedals are configured to be linearly adjustable toward or away from the pivot point and releasably securable to one of the second plurality of apertures located along the bar.

2. The physical exercise apparatus of claim 1, wherein the physical exercise apparatus further comprises the resistance load comprising a barbell, and wherein the first portion of the frame that is configured to support the resistance load is configured to store the barbell when the barbell is not in use.

3. The physical exercise apparatus of claim 1, wherein the flat bench is fixed in a flat position.

4. The physical exercise apparatus of claim 1, wherein the flat bench comprises a seat support and a back support that are pivotably coupled to one another.

5. The physical exercise apparatus of claim 1, wherein the selected location for the movable foot pedals is configured to be based at least in part upon a leg length of the user.

6. A method of physical exercise training, comprising:

(a) providing a physical exercise apparatus, comprising:

(i) a frame having a first portion configured to support a resistance load for an upper body, weight lifting exercise that is a target exercise for developing pectoralis muscles in an upper body of a user;

(ii) a flat bench, vertically spaced above the ground, supported by the frame and configured to provide the user with access to the resistance load and to support the user for performing the target exercise comprising the upper body, weight lifting exercise while the user is lying on the flat bench in a supine position with the user in a horizontal position lying on the user's back and facing upward, wherein the target exercise is configured to develop the pectoralis muscles in the upper body of the user; and (iii) a pair of movable foot pedals connected to a second portion of the frame but not connected to the resistance load so that the resistance load that is associated with the target exercise is not applied to the pair of movable foot pedals, and configured so that the user is capable of performing the upper body, weight lifting exercise to develop the user's pectoralis muscles, while in the supine position, and simultaneously cycling in the horizontal position on the flat bench with the pair of movable foot pedals as a physical distraction exercise to engage muscles of the lower body of the user with a physical distraction to inhibit the muscles of the lower body from assisting the user's pectoralis muscles of the upper body in the target exercise, wherein the movable foot pedals for cycling are adjustable to a selected location at a vertical level above a height of the flat bench in a two-dimensional plane at which the movable foot pedals are releasably secured to be configured for cycling by the user as the distraction exercise while in the supine position with the user's legs above the flat bench so that the user remains in postural alignment for performing the target exercise simultaneously with the distraction exercise;

(b) adjusting the movable foot pedals to the selected location above the flat bench in the two-dimensional plane;

(c) positioning at least a portion of a body of a user in the supine position on the flat bench and positioning the user's feet on the movable foot pedals at the vertical level above the height of the flat bench;

(d) accessing the resistance load by the user in the supine position and performing the target exercise with the upper body of the user, comprising lifting weight using the resistance load when the user is in the supine position on the flat bench; and (e) while performing the target exercise of lifting weight with the pectoralis muscles of the upper body, simultaneously performing the cycling motion of the distraction exercise with the movable foot pedals by the user in the supine position to distract the user to inhibit the muscles of the lower body from assisting the user's pectoralis muscles in the target exercise.

7. The method of claim 6, wherein the distraction exercise is initiated by the user before the user initiates the target exercise.

8. The method of claim 6, wherein the physical exercise apparatus further comprises the resistance load comprising a barbell, wherein the first portion of the frame that is configured to support the resistance load is configured to store the barbell when the barbell is not in use, and wherein the target exercise is initiated by the user by accessing the barbell from the first portion of the frame for the upper body, weight lifting after the user initiates the cycling motion with the movable foot pedals.

9. The method of claim 8, wherein the first portion of the frame comprises a plurality of storage positions that are spaced apart vertically and are simultaneously available for storing the barbell at one of different vertical levels when the barbell is not in use, and wherein the method further comprises pre-positioning the barbell at a selected one of the different vertical levels for the user to access the barbell before performing the target exercise.

10. The method of claim 6, wherein the flat bench is fixed in a flat position.

11. The method of claim 6, wherein the flat bench comprises a seat support and a back support that are pivotably coupled to one another.

12. The method of claim 6, wherein the selected location for the movable foot pedals is configured to be based at least in part upon a leg length of the user.

13. The method of claim 6, wherein the physical exercise apparatus further comprises:

at least two adjustment members to adjust the selected location of the movable foot pedals including:

a first adjustment member comprising an arcuate member coupled to the movable foot pedals at a pivot point and having a first plurality of apertures arranged in an arc shape, such that the movable foot pedals are configured to be rotatable about the pivot point and releasably securable to one of the first plurality of apertures; and a second adjustment member, coupled to the movable foot pedals and the first adjustment member, the second adjustment member comprising a bar having arranged linearly thereon a second plurality of apertures, such that the movable foot pedals are configured to be linearly adjustable toward or away from the pivot point and releasably securable to one of the second plurality of apertures located along the bar.

14. The method of claim 6, further comprising a rotating arm coupled to the movable foot pedals and a linearly adjustable bar coupled to the movable foot pedals to provide for respective rotational and linear adjustment of the movable foot pedals to the selected location in the two-dimensional plane at which the movable foot pedals are releasably secured to be configured for the cycling by the user as the distraction exercise.

15. The physical exercise apparatus of claim 1, wherein the movable foot pedals are further configured to be rotatable about the pivot point between 5 to 80 degrees relative to a horizontal axis.

16. The physical exercise apparatus of claim 1, wherein the first portion of the frame that is configured to support a resistance load for an upper body, weight lifting exercise physical exercise comprises a plurality of storage positions that are spaced apart vertically and are simultaneously available for storing the resistance load at one of different vertical levels when the resistance load is not in use.

17. The physical exercise apparatus of claim 16, wherein the first portion of the frame is angled backwards at an angle of between 5 to 7 degrees from a vertical axis.

18. The physical exercise apparatus of claim 1, wherein the resistance load comprises a kettlebell or a dumbbell.

19. The physical exercise apparatus of claim 1, wherein the physical exercise apparatus is configured for performing the upper body, weight lifting exercise with heavy weights including a 200 pound barbell or an 80 pound dumbbell.

20. The method of claim 6, wherein the first portion of the frame that is configured to support a resistance load for an upper body, weight lifting exercise physical exercise comprises a plurality of storage positions that are spaced apart vertically and are simultaneously available for storing the resistance load at one of different vertical levels when the resistance load is not in use.

21. The method of claim 20, wherein the first portion of the frame is angled backwards at an angle of between 5 to 7 degrees from a vertical axis.

22. The method of claim 6, wherein the resistance load comprises a kettlebell or a dumbbell.

23. The method of claim 6, wherein the physical exercise apparatus is configured for performing the upper body, weight lifting exercise with heavy weights including a 200 pound barbell or an 80 pound dumbbell.

24. The method of claim 14, wherein the rotating arm is rotatable about a pivot point between 5 to 80 degrees relative to a horizontal axis.

25. The physical exercise apparatus of claim 1, wherein the pair of movable foot pedals have zero or nominal resistance applied thereto.

26. The physical exercise apparatus of claim 25, wherein the pair of movable foot pedals have no more than ¼ pound of resistance applied thereto.

27. The method of claim 6, wherein the physical exercise apparatus further comprises two linear adjustment mechanisms coupled to the movable foot pedals to adjust the movable foot pedals to the selected location in the two-dimensional plane at which the movable foot pedals are releasably secured to be configured for cycling.

28. The method of claim 27, wherein the two linear adjustment mechanisms of the physical exercise apparatus are perpendicular to one another.

29. The method of claim 6, wherein the pair of movable foot pedals have zero or nominal resistance applied thereto.

30. The method of claim 29, wherein the pair of movable foot pedals have no more than ¼ pound of resistance applied thereto.

* * * * *